US009709248B2

(12) United States Patent
Zhang et al.

(10) Patent No.: US 9,709,248 B2
(45) Date of Patent: Jul. 18, 2017

(54) METHOD FOR CONSTRUCTING UNIVERSAL LED BULB, SNAP RING STRUCTURED LED BULB AND LED LAMP

(71) Applicant: GUIZHOU GUANGPUSEN PHOTOELECTRIC. CO., LTD, Guizhou (CN)

(72) Inventors: Jiqiang Zhang, Guizhou (CN); Zheyuan Zhang, Guizhou (CN)

(73) Assignee: GUIZHOU GZGPS CO., LTD., Guizhou (CN)

( * ) Notice: Subject to any disclaimer, the term of this patent is extended or adjusted under 35 U.S.C. 154(b) by 65 days.

(21) Appl. No.: 14/416,345

(22) PCT Filed: Jul. 23, 2013

(86) PCT No.: PCT/CN2013/000880

§ 371 (c)(1),
(2) Date: Jan. 22, 2015

(87) PCT Pub. No.: WO2014/015656

PCT Pub. Date: Jan. 30, 2014

(65) Prior Publication Data

US 2015/0184837 A1 Jul. 2, 2015

(30) Foreign Application Priority Data

Jul. 23, 2012 (CN) ..... 2012 1 0253481
Jul. 23, 2012 (CN) ..... 2012 1 0253483
(Continued)

(51) Int. Cl.
*F21V 17/06* (2006.01)
*F21S 8/00* (2006.01)
(Continued)

(52) U.S. Cl.
CPC ..... *F21V 17/06* (2013.01); *F21K 9/20* (2016.08); *F21K 9/232* (2016.08); *F21S 8/00* (2013.01);
(Continued)

(58) Field of Classification Search
CPC ..... F21V 17/06; F21V 29/50; F21V 29/70; F21V 29/74; F21V 15/01; F21V 21/03;
(Continued)

(56) References Cited

FOREIGN PATENT DOCUMENTS

CN 201944619 U 8/2011
CN 102213370 A 10/2011
(Continued)

OTHER PUBLICATIONS

Search Report issued in International Application No. PCT/CN2013/000880, ten (10) pages.

*Primary Examiner* — Mary Ellen Bowman
(74) *Attorney, Agent, or Firm* — Nath, Goldberg & Meyer; Joshua B. Goldberg; Christopher Thomas

(57) ABSTRACT

The present invention provides a method for constructing a universal LED bulb, a snap ring structured LED bulb and a lamp. The constructing method comprises: supporting an optical engine core member of the LED bulb in the lens snap ring (8) using a lens snap ring (8) as a supporting main body, using an inner snap ring (81) provided on the inner side of a light distribution optical lens (7) in the optical engine core member as an auxiliary supporting structure, and further using the inner snap ring (81) as an installation base of an optical engine module (4) and a heat conductive bracket (3) or an installation base of an LED bulb radiator (103); the optical engine core member of the LED bulb is composed of the heat conductive bracket (3), the optical engine module (4), the inner snap ring (81) and the light distribution optical lens (7).

25 Claims, 50 Drawing Sheets

(30) Foreign Application Priority Data

| | | |
|---|---|---|
| Jul. 23, 2012 | (CN) | 2012 1 0253682 |
| Jul. 23, 2012 | (CN) | 2012 1 0253702 |
| Jul. 23, 2012 | (CN) | 2012 1 0253729 |
| Jul. 23, 2012 | (CN) | 2012 1 0253730 |
| Jul. 23, 2012 | (CN) | 2012 1 0253766 |
| Jul. 23, 2012 | (CN) | 2012 1 0253802 |
| Jul. 23, 2012 | (CN) | 2012 1 0253816 |

(51) Int. Cl.

| | |
|---|---|
| ***F21V 23/06*** | (2006.01) |
| ***F21V 15/01*** | (2006.01) |
| ***F21V 21/30*** | (2006.01) |
| ***F21V 29/74*** | (2015.01) |
| ***F21V 31/00*** | (2006.01) |
| ***F21V 29/50*** | (2015.01) |
| ***F21V 29/70*** | (2015.01) |
| ***F21V 21/03*** | (2006.01) |
| ***F21K 9/20*** | (2016.01) |
| ***F21K 9/232*** | (2016.01) |
| *F21S 8/02* | (2006.01) |
| *F21W 131/10* | (2006.01) |
| *F21W 131/103* | (2006.01) |
| *F21Y 113/00* | (2016.01) |
| *F21Y 115/10* | (2016.01) |

(52) U.S. Cl.

CPC ..... *F21V 15/01* (2013.01); *F21V 21/03* (2013.01); *F21V 21/30* (2013.01); *F21V 23/06* (2013.01); *F21V 29/50* (2015.01); *F21V 29/70* (2015.01); *F21V 29/74* (2015.01); *F21V 31/00* (2013.01); *F21S 8/026* (2013.01); *F21W 2131/10* (2013.01); *F21W 2131/103* (2013.01); *F21Y 2113/00* (2013.01); *F21Y 2115/10* (2016.08)

(58) Field of Classification Search

CPC ..... F21V 21/30; F21V 31/00; F21K 9/135; F21K 9/30; F21S 8/00

See application file for complete search history.

(56) References Cited

FOREIGN PATENT DOCUMENTS

| | | | |
|---|---|---|---|
| CN | 102777798 | A | 11/2012 |
| CN | 102777823 | A | 11/2012 |
| CN | 102777829 | A | 11/2012 |
| CN | 102798005 | A | 11/2012 |
| CN | 102818171 | A | 12/2012 |
| CN | 102818175 | A | 12/2012 |
| CN | 102818180 | A | 12/2012 |
| CN | 102818199 | A | 12/2012 |
| CN | 102927463 | A | 2/2013 |
| TW | 201221843 | A | 6/2012 |

METHOD FOR CONSTRUCTING UNIVERSAL LED BULB, SNAP RING STRUCTURED LED BULB AND LED LAMP

This is a National Phase Application filed under 35 U.S.C. 371 as a national stage of PCT/CN2013/000880, filed Jul. 23, 2013, and claims priority benefit from Chinese Application No. 201210253702.1, filed Jul. 23, 2012, Chinese Application No. 201210253483.7, filed Jul. 23, 2012, Chinese Application No. 201210253682.8, filed Jul. 23, 2012, Chinese Application No. 201210253802.4, filed Jul. 23, 2012, Chinese Application No. 201210253816.6, filed Jul. 23, 2012, Chinese Application No. 201210253481.8, filed Jul. 23, 2012, Chinese Application No. 201210253766.1, filed Jul. 23, 2012, Chinese Application No. 201210253730.3, filed Jul. 23, 2012, Chinese Application No. 201210253729.0, filed Jul. 23, 2012, the content of each of which is hereby incorporated by reference in its entirety.

FIELD OF THE INVENTION

The present invention relates to a method for constructing a universal LED bulb, a snap ring structured LED bulb and an LED lamp, which involve the field of LED lighting technology.

BACKGROUND OF THE INVENTION

As a new generation of lighting technology, LED semiconductor lighting has five energy-saving advantages incomparable by the existing other lighting technologies, such as high photoelectric conversion efficiency, easy control of light source direction, easy control of lighting time and manner, high light source color rendering property, and a high power factor under reasonable design, thus being warmly welcomed by worldwide investors and vigorously supported by the governments of all countries. The luminous efficiency of most current LED lamps may exceed 70 LM/W, thus having better energy saving advantages than the traditional energy saving lamps. The luminous efficiency of green LEDs may be up to 683 LM/W theoretically; the theoretical efficiency of white LED is also up to 182.45 LM/W, so the improvement space of LED lighting efficiency is huge.

In the current design of high power LED lighting products, especially high power LED lamps, due to heat dissipation, when a high power LED lamp is assembled, an LED light module, a driving power supply and a lamp are integrally designed, namely such components as the LED light module, the driving power supply and the lamp must be produced collectively, thus forming a situation of "LED having lamp while lacking bulb". This brings a series of fatal problems to the LED lighting products, such as high manufacturing cost, inconvenience for use, maintenance difficulty, and the like. First of all, national and even global uniform standardized production could not be achieved on manufacture, leading to numerous product specifications, few batches and high prices; second, the products of producers are varied, not universal, let alone interchangeable; third, the LED light module, the driving power supply, the lamp and the like need to be integrally detached for maintenance in the case of product failure, thus the maintenance is very inconvenient, and such defects as expanded failure, delayed maintenance and high maintenance cost and the like are very liable to form. These defects greatly restrict the popularization and use of LED lighting and are inherent problems in the popularization of the LED lighting products.

SUMMARY OF THE INVENTION

The object of the present invention is to provide a method for constructing a universal LED bulb, a snap ring structured LED bulb and an LED lamp. It is simple and stable in structure, convenient to install, capable of being provided with a radiator to independently operate and may also be installed on the radiator of the lamp, thus being used flexibly. By adopting the present invention, the LED bulb is independently produced and used with such products as lamp and lighting control and the like on production, thereby greatly reducing the production procedures of the LED lighting products, improving mass production and facilitating the industrialization of LED energy-saving lighting products.

The technical solutions of the present invention are as follows: a method for constructing a universal LED bulb, comprising: supporting an optical engine core member of the LED bulb in the lens snap ring using a lens snap ring as a supporting main body of the bulb, using an inner snap ring provided on an inner side of a light distribution optical lens in the optical engine core member of the LED bulb as an auxiliary supporting structure of the bulb, and using the inner snap ring as an installation base of an optical engine module and a heat conductive bracket or an installation base of a radiator of the LED bulb, the LED bulb optical engine core member is composed of the heat conductive bracket, the optical engine module, the inner snap ring and the light distribution optical lens, wherein an inner cover is provided outside the optical engine module, and an electric connector is provided to the heat conductive bracket; an installation flange is provided to the lens snap ring for installing the bulb; the optical engine module is made up of an optical engine die plate, an LED chipset and a relevant wiring by bonding and packging, or is further integrated with a power supply drive chip.

In the above-mentioned method for constructing the universal LED bulb, the diameter of the lens snap ring is a bulb outer diameter D, the bulb outer diameter D and an upper limit of power W of the constructed LED bulb satisfy a relationship $W=1.1812e^{0.0361D}$, discrete values are selected on the relationship curve $W=1.1812e^{0.0361D}$ to construct a plurality of LED bulbs having fixed bulb outer diameters D, so as to improve the interchangeability and universality of the LED bulbs; on the relationship curve $W=1.1812e^{0.0361D}$, with 20 mm used as the lower limit and 130 mm used as the upper limit of the bulb outer diameter D, the relationship curve is divided into 12 segments each of which is set 10 mm to form a limited number of bulb outer diameter specifications, and the interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then substracting a margin of 0.8-4 mm from the bulb outer diameter D; a diameter D2 of a radiator interface opening pore of the LED bulb on a lamp is a value obtained by subtracting two times of a diameter of a fixing screw cap and then substracting two times of the margin corresponding to the diameter D1 from the bulb outer diameter D. The installation interface of the LED bulb includes a surface in contact with the LED bulb and a hole connected to the LED bulb, on the lamp.

In the foregoing method for constructing the universal LED bulb, a step is provided at the upper part of the inner snap ring, an integral structure formed by adhering the heat conductive bracket and the optical engine module is adhered in the step, the inner snap ring surrounds outside the optical engine module, or an inner ring cover is further provided between the inner snap ring and the inner cover, the light distribution optical lens is adhered at the bottom part of the inner snap ring for sealing the optical engine module in a sealed waterproof space among the heat conductive bracket, the inner snap ring and the light distribution optical lens, or the inner snap ring is further used as the installation base of the LED bulb radiator; the thicknesses of the light distribution optical lens, the inner snap ring and the heat conductive bracket are adjusted to enable the heat conductive bracket to closely lean against the radiator when the lens snap ring is installed; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology. Due to this structure, the structure between the LED light source chip and the radiator is simpler, heat generated by the chip will be quickly transferred to the optical engine die plate for dispersion, thus being conducive to cool the LED chip and prolong the service life of the LED light source.

In the foregoing method for constructing the universal LED bulb, for a small size LED bulb, the heat conductive bracket, the optical engine module, the inner snap ring and the light distribution optical lens are sequentially overlapped and adhered to form an integral LED bulb optical engine core member, or the inner ring cover is further provided between the inner snap ring and the inner cover, and components packaged on the optical engine die plate in the optical engine module are packaged in the sealed waterproof space among the heat conductive bracket, the inner snap ring and the light distribution optical lens; or, the inner cover and the inner snap ring are of an integral structure (namely, an inner cover with a function of the inner snap ring), the components packaged on the optical engine die plate are packaged in the waterproof space between the optical engine die plate and the integral structure formed by the inner cover and the inner snap ring; or the inner snap ring is further used as the installation base of the LED bulb radiator; the thicknesses of the light distribution optical lens, the inner snap ring and the heat conductive bracket are adjusted to enable the heat conductive bracket to closely lean against the radiator when the lens snap ring is installed; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

In the foregoing method for constructing the universal LED bulb, a radiator is provided to the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by extrusion moulding an ultrafine nonmetal heat conductive material (such as alumina, silicon carbide or the like with fineness smaller than 300 meshes) at a low temperature to form a screen mesh shape and sintering the same at a high temperature, the contact surfaces thereof are adhered into an entirety by coating a heat conductive adhesive, the heat conductive conversion bracket is overhead, the nonmetal radiator takes the shape of a screen mesh, and the nonmetal radiator is overhead by the heat conductive conversion bracket, for enabling the air to enter the screen mesh of the nonmetal radiator from the heat conductive conversion bracket. A rubber sheath or screw fixing glue is filled in the fixing screw hole of the nonmetal radiator for connecting a fixing screw, and a radiator outer cover, which may be made of a metal material by stamping or from plastics by die casting to beautify the appearance of the bulb, is provided outside the nonmetal radiator; or the radiator is a metal radiator, the heat conductive pad is provided between the metal radiator and the heat conductive bracket, the metal radiator is of a hollow structure, a foam metal is filled in the hollow part, superconductive liquid is filled in the hollow structure, upper and lower stoppers are pressed by interference fit or screwed by a threaded seal gum in the hollow structure to form a sealed space, and the sealed space is vacuumized; a radiator fixing screw is penetrated through a fixing through hole on the inner snap ring, in order to be connected to the radiator fixing screw hole of the nonmetal radiator or the metal radiator.

In the foregoing method for constructing the universal LED bulb, fluorescent powder is spray coated on the LED chip on the optical engine module, and transparent silica gel is covered thereon; or the number of the LED chips is configured according to the proportion of blue and red lights necessary for plants, and only the transparent silica gel is covered on the welded LED chip for package; or, the LED chip on the optical engine module is merely packaged by the transparent silica gel, and then, an inner cover coated with fluorescent powder on the inner side is provided outside the packaged optical engine module; or no silica gel is covered on the LED chip on the optical engine module, a concave inner cover filled with transparent insulating heat conductive liquid is provided outside the optical engine module, the fluorescent powder is provided in the transparent insulating heat conductive liquid, and the concave inner cover is an elastic inner cover of a thin inner concave structure.

The fluorescent powder is spray coated on the LED chip on the optical engine module, and the transparent silica gel is covered thereon; or the number of the LED chips on the optical engine module is configured according to the proportion of blue and red lights necessary for plants, and only the transparent silica gel is covered on the welded LED chip; or, the LED chip on the optical engine module may also be packaged by the traditional package solution, namely, the fluorescent powder is spray coated on the LED chip and the transparent silica gel is covered thereon, while no inner cover is used; when the present invention is applied to agricultural production lighting, the number of the LED chips on the optical engine module is configured according to the proportion of blue and red lights necessary for plants, and only the transparent silica gel is covered on the welded LED chip.

In the foregoing method for constructing the universal LED bulb, the LED chip on the optical engine module is packaged by transparent silica gel, then the inner cover coated with fluorescent powder on the inner side is provided outside the packaged optical engine module, this structure ensures the fluorescent powder has better uniformity compared with that being directly sprayed on the chip, the fluorescent powder is away from the LED heating chip, the LED chip may operate at a relatively higher temperature, thereby perfecting the LED operation condition, effectively reducing the luminous decay of the LED bulb and ensuring a better LED light emission effect, and the dosage of the fluorescent powder is not increased to a larger extent; or no silica gel is covered on the LED chip on the optical engine module, the concave inner cover filled with transparent insulating heat conductive liquid is provided outside the optical engine module, the fluorescent powder is provided in the transparent insulating heat conductive liquid, and the concave inner cover is an elastic inner cover of a thin inner concave structure, in this structure, when the LED is electrified to generate heat, the transparent insulating heat conductive liquid is heated to flow to take away the heat of the LED chip, in order to exchange the heat with the radiator on a larger area, thus avoiding local high heat of the LED chip and the surrounding fluorescent powder in the traditional solution and effectively reducing the generation of LED luminous decay, and when the transparent insulating heat conductive liquid is heated to expand, the concave inner cover protrudes outwards to increase the volume for receiving the expanded liquid, in order to prevent expanding of the liquid from resulting in ineffective seal of the inner cover.

In the foregoing method for constructing the universal LED bulb, a connector plug fixing hole is provided to the heat conductive bracket, a connector plug with a contact pin is inserted into the connector plug fixing hole and is fixed with the part inserted into the bulb as a fixed end, the tail end of the contact pin is welded with the optical engine die plate in the universal LED bulb, to form a simple electric interface on the outer surface of the universal LED bulb, during installation, as long as the connector plug is in butt joint with a connector socket with a cable, and the universal LED bulb is fixed, the electric connection of the universal LED bulb is achieved; the eccentric position of the hole of the connector plug on the heat conductive bracket and the size of the fixed end of the connector plug are limited, such that the optical engine die plate in the LED bulb may meet the demands of arranging the LED chip and the driving power supply chip and the alignment demand; the connector plug with the contact pin is of a four-pin structure, wherein two pins are used for power supply access, and the other two pins are used for control access; the fixed end is in a nut fixing manner or a fusion ring fixing manner; when the fixed end is in the nut fixing manner, a waterproof rubber ring is added between the connector plug and the heat conductive bracket to prevent water; in order to prevent rotation, an antiskid groove is provided to the connector plug, and a corresponding projection is provided at the through hole of the heat conductive bracket; a three-hole flange is provided to the connector socket and is fixed on the lamp radiator through a fixing screw, and an adjusting rubber pad is provided between the connector socket and the radiator to adjust the thickness, in order to ensure tightness of a waterproof surface; or external threads are provided to the electric connector plug to match with the internal threads of the fixing nut on the connector socket provided with the waterproof rubber ring to prevent water; an slot is provided to the connector socket, and the waterproof rubber ring is provided in the slot to prevent water.

A snap ring structured LED bulb constructed by the foregoing method, including a lens snap ring with an installation flange, wherein at least a heat conductive bracket, an optical engine module, an inner snap ring and a light distribution optical lens are provided in the lens snap ring sequentially, a connector plug is fixed on the heat conductive bracket, and an inner cover is further provided outside the optical engine module; the optical engine module is composed of an optical engine die plate, an LED chipset and a relevant wiring by bonding and packging, or a power supply drive chip is further integrated therein.

In the foregoing snap ring structured LED bulb, a step is provided at the upper part of the inner snap ring, the heat conductive bracket is provided in the step, the optical engine module is adhered on the heat conductive bracket, the inner snap ring surrounds outside the optical engine module, or an inner ring cover is further provided between the inner snap ring and the inner cover; the upper end of the inner snap ring is adhered with the heat conductive bracket, the lower end of the inner snap ring is adhered with the light distribution optical lens, and a sealed waterproof space for packaging the optical engine module is formed by the three components; or, the inner snap ring is further used as the installation base of an LED bulb radiator; when the lens snap ring is installed, it could be ensured the upper surface of the heat conductive bracket closely leans against the radiator; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

In the foregoing snap ring structured LED bulb, for a small size LED bulb, the heat conductive bracket, the optical engine module, the inner snap ring and the light distribution optical lens are sequentially overlapped and adhered, or the inner ring cover is further provided between the inner snap ring and the inner cover, and the optical engine die plate of the optical engine module, the inner snap ring and the light distribution optical lens form a sealed waterproof space used for packaging components packaged on the optical engine die plate; or, the inner snap ring is further used as the installation base of the LED bulb radiator; or the inner snap ring and the inner cover are processed to an inner cover having a function of the inner snap ring and having an integral structure; when the lens snap ring is installed, it can ensure that the upper surface of the heat conductive bracket closely leans against the radiator; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

In the foregoing snap ring structured LED bulb, a radiator is provided to the heat conductive bracket; the radiator is a nonmetal radiator assembly, the nonmetal radiator assembly includes a nonmetal radiator and an overhead heat conductive conversion bracket at the lower side thereof, a rubber sheath or screw fixing glue is filled in the radiator fixing screw hole of the nonmetal radiator for connecting a fixing screw, and a radiator outer cover is provided outside the nonmetal radiator; or the radiator is a metal radiator, a heat conductive pad is provided between the metal radiator and the heat conductive bracket, the metal radiator includes a cooling fin, a superconductive fluid cavity is provided at the middle of the cooling fin, a foam metal is filled in the superconductive fluid cavity and superconductive fluid is filled therein, an upper stopper and a lower stopper are provided at the two ends of the superconductive fluid cavity, and a vacuum suction pipe is provided to the upper stopper or the lower stopper; a cable hole used for penetration of a cable and a radiator fixing screw hole are further provided to the radiator. A radiator fixing screw is penetrated through the radiator fixing through hole on the inner snap ring to be connected to the radiator fixing screw hole of the nonmetal radiator or the metal radiator.

Only transparent silica gel for package is provided outside the LED chip on the optical engine module, an inner cover is provided outside the optical engine module with the transparent silica gel, and fluorescent powder coating is provided to the inner layer of the inner cover; or, no silica gel is packaged on the LED chip on the optical engine module, a concave inner cover filled with transparent insulating heat conductive liquid is provided outside the optical engine module, the LED chip on the optical engine module is soaked in the transparent insulating heat conductive liquid, fluorescent powder is provided in the transparent insulating heat conductive liquid, and the concave inner cover is an elastic inner cover of a thin inner concave structure.

In the foregoing snap ring structured LED bulb, an electric connector is provided to the heat conductive bracket, the electric connector includes an electric connector plug, a contact pin is provided to the electric connector plug, and a contact pin welding spot on a tail end of the contact pin is welded with the optical engine module; after penetrating through a fixing hole of the electric connector plug on the universal LED bulb, the connector plug is provided with a fixed end for fixing; the connector plug is cooperatively connected to a connector socket with a jack, and the connector socket is connected to a cable; the contact pin of the electric connector has a four-pin structure, wherein two pins are used for power supply access, and the other two pins are used for control access.

In the foregoing snap ring structured LED bulb, the fixed end is a fusion ring; or the fixed end is a fixing nut, a waterproof rubber ring slot is further provided to the connector plug, and a waterproof rubber ring is provided in the waterproof rubber ring slot; in order to prevent rotation, an antiskid groove is provided to the connector plug, and a corresponding projection is provided at the through hole of the heat conductive bracket; a three-hole flange is provided to the connector socket, and the connector socket is fixed with the radiator or a heat conductive converting plate on the lamp through the three-hole flange and a fixing screw of the connector socket, and a fixed adjusting rubber pad is provided between the flange and the radiator or the heat conductive converting plate on the lamp to ensure the tightness of a waterproof surface; or the connector plug is provided with external threads to match with the internal threads of the fixing nut on the connector socket provided with the waterproof rubber ring so as to be fixed to the connector plug; a slot is provided to the connector socket, and the waterproof rubber ring is provided in the slot.

On another aspect, the present invention further provides a variety of lamps using the foregoing LED bulb. The lamp provided by the present invention is simple in structure, low in manufacturing cost, quick, cheap and convenient to install, use and maintain and is unlikely to expand failure, achieves independent production and use of the bulb, lamp and the lighting control product of the LED bulb, greatly reduces the production procedures, achieves mass production and facilitates the application and the industrial scale of the LED energy-saving lighting products.

An LED tunnel lamp using a double-faced radiator structure, including an extrusion type double-faced radiator extrusion formed by a metal, wherein an LED bulb is provided to the extrusion type double-faced radiator, the extrusion type double-faced radiator is installed on an installation support, and an installation interface used for installing the LED bulb is provided to the extrusion type double-faced radiator.

In the foregoing LED tunnel lamp using the double-faced radiator structure, the extrusion type double-faced radiator includes a substrate, and fins are provided at the two sides of the substrate; the installation interface used for installing the LED bulb is provided on one side of the substrate, and circular or elliptic conical spaces are formed by cutting the fins around the installation interface of the substrate according to the illumination angle of the light emitted by the bulb to the extent of not to shield the light emitted by the LED bulb; the installation interface includes a surface in contact with the LED bulb and a hole connected to the LED bulb on the extrusion type double-faced radiator; the LED tunnel lamp using the double-faced radiator structure further includes a wire harness connector, and the wire harness connector is used for connecting a plurality of LED bulbs to a power supply and a control circuit.

In the foregoing LED tunnel lamp using the double-faced radiator structure, the extrusion type double-faced radiator is installed on the installation support through a turning connecting plate; the turning connecting plate is fixed on a diversion bracket, and the diversion bracket is fixed on the installation support, such that the angle of the extrusion type double-faced radiator may be simultaneously adjusted in a horizontal direction and a vertical direction; the wire harness connector is provided to the installation support.

In the foregoing LED tunnel lamp using the double-faced radiator structure, or the extrusion type double-faced radiator is connected to a radiator bracket; the radiator bracket is used for installing the double-faced radiator on the installation support through the turning connecting plate, the radiator bracket is connected to the turning connecting plate, the turning connecting plate is fixed on the diversion bracket, and the diversion bracket is fixed on the installation support, such that the angle of the extrusion type double-faced radiator may be simultaneously adjusted in a horizontal direction and a vertical direction; the wire harness connector is provided to the radiator bracket.

In the foregoing LED tunnel lamp using the double-faced radiator structure, an installation support turning locking groove is engraved on the installation support, after the illumination angle of the lamp is adjusted, an installation support rotation fixing screw (the screw is used for locking the lamp along the gravity direction to prevent loosening) and a diversion bracket fixing screw may be screwed, meanwhile, an installation support turning locking screw is screwed in the installation support turning locking groove to prevent the illumination direction from changing. The illumination angle may be simultaneously adjusted in the horizontal and vertical directions by adjusting the diversion bracket fixing screw and the installation support rotation fixing screw.

In the foregoing LED tunnel lamp using the double-faced radiator structure, 6 flange fixing holes on the installation interface of the extrusion type double-faced radiator are uniformly distributed at a diameter D1, and the diameter D1 is a value obtained by subtracting a diameter of a fixing screw cap and then substracting a margin of 0.8-4 mm from an outer diameter D of the LED bulb.

An LED street lamp using an extrusion type radiator structure, including an extrusion type radiator extrusion formed by a metal, wherein an installation interface is provided to the extrusion type radiator, and an LED bulb is provided to the installation interface; the extrusion type radiator is installed on a lamp post; a lamp housing punch-formed by a metal or die-cast by plastics is provided outside the extrusion type radiator; the LED street lamp using the extrusion type radiator structure further includes a wire harness connector, and the wire harness connector is used for connecting a plurality of LED bulbs to a power supply and a control circuit.

In the foregoing LED street lamp using the extrusion type radiator structure, the extrusion type radiator includes a substrate, fins are provided at one side of the substrate, and a cable hole is provided to the substrate; the installation interface used for installing the LED bulb is provided at the other side of the substrate; a conducting wire bracket is provided at the side with the fins of the substrate, and the conducting wire bracket is used for connecting a conducting wire led out from the LED bulb to the wire harness connector; the installation interface includes a surface in contact with the LED bulb and a hole connected to the LED bulb, on the extrusion type radiator.

In the foregoing LED street lamp using the extrusion type radiator structure, one side of the substrate of the extrusion type radiator is connected to a L-shaped connecting plate, and the L-shaped connecting plate is connected to the lamp post; the wire harness connector is provided to the extrusion type radiator.

In the foregoing LED street lamp using the extrusion type radiator structure, a bracket installation hole is provided to the substrate or the center of the extrusion type radiator, and the extrusion type radiator is fixed on the lamp post by a street lamp installation fixing bolt by means of the bracket installation hole and a lamp post fixing ring; the wire harness connector is provided in the lamp post connected to the extrusion type radiator.

In the foregoing LED street lamp using the extrusion type radiator structure, 6 flange fixing holes on the installation interface are uniformly distributed at a diameter D1, and the diameter D1 is a value obtained by subtracting the diameter of a fixing screw cap and then substracting a margin of 0.8-4 mm from the outer diameter D of the LED bulb.

An LED projection lamp using a lamp housing as an installation interface bracket structure, including the lamp housing punch-formed by sheet metal by a stamping process, wherein an installation interface is provided to the lamp housing, an LED bulb provided with a radiator is provided to the installation interface, the middle part of the lamp housing is connected to a lamp post fixing sleeve through a lamp post fixing member, and a decorative cover is provided at the bottom of the lamp housing.

In the foregoing LED projection lamp using the lamp housing as the installation interface bracket structure, the lamp housing is circular, a group of circular ring-shaped installation interfaces are provided around the lamp post fixing sleeve at the top of the center of the lamp housing, and an edgefold for reinforcing the structural strength is provided at the edge of the lamp housing; the decorative cover is provided at the center of the bottom of the lamp housing; the installation interface includes a surface in contact with the LED bulb and a hole connected to the LED bulb, on the lamp housing; a wire harness connector is provided to the lamp post fixing sleeve, and the wire harness connector is used for connecting a plurality of LED bulbs to a power supply and a control circuit.

In the foregoing LED projection lamp using the lamp housing as the installation interface bracket structure, the lamp post fixing member includes a fixing sleeve flange, a lamp post fixing sleeve bolt and a reinforcing plate; the lamp post fixing sleeve is fixedly connected to the lamp housing through the fixing sleeve flange, the lamp post fixing sleeve bolt and the reinforcing plate.

In the foregoing LED projection lamp using the lamp housing as the installation interface bracket structure, 6 flange fixing holes and a radiator interface opening are provided to the installation interface, the flange fixing holes are used for fixing the LED bulb, and the radiator interface opening is used for enabling the radiator of the LED bulb to penetrate through the installation interface of the bulb; the flange fixing holes are uniformly distributed at a diameter D1, and the diameter D1 is a value obtained by subtracting a diameter of a fixing screw cap and then substracting a margin of 0.8-4 mm from the outer diameter D of the LED bulb; the diameter D2 of the radiator interface opening on the installation interface is a value obtained by subtracting two times of a diameter of a fixing screw cap and then substracting two times of the margin corresponding to the diameter D1 from the outer diameter D of the bulb.

An LED projection lamp using a lamp housing bracket as an installation interface bracket structure, including the lamp housing bracket and an LED bulb, wherein the lamp housing bracket is a rectangular box with an open surface, an extrusion type double-faced radiator is provided in the lamp housing bracket, an opening used for installing the extrusion type double-faced radiator is provided to the surface opposite to the opening of the lamp housing bracket, vent holes are provided to surfaces other than the open surface and the surface provided with the opening, of the lamp housing bracket, and the lamp housing bracket is installed and fixed through fixing assemblies provided at the two sides; an installation interface used for installing the LED bulb is provided to the extrusion type double-faced radiator.

In the foregoing LED projection lamp using the lamp housing bracket as the installation interface bracket structure, each fixing assembly includes a lamp fixing bracket and a reinforcing plate, the reinforcing plate is fixedly provided in the lamp housing bracket, and the lamp fixing bracket is connected to the reinforcing plate outside the lamp housing bracket for fixing the entire lamp housing bracket; the LED projection lamp using the extrusion type radiator further includes a wire harness connector, and the wire harness connector is used for connecting a plurality of LED bulbs to a power supply and a control circuit.

In the foregoing LED projection lamp using the lamp housing bracket as the installation interface bracket structure, the LED projection lamp using the extrusion type double-faced radiator further includes an angle adjusting assembly and a lamp housing rear cover, the angle adjusting assembly is provided at the joint of the lamp fixing bracket and the reinforcing plate, the lamp housing rear cover is provided at the opening of the lamp housing bracket, and a vent hole is provided to the lamp housing rear cover.

In the foregoing LED projection lamp using the lamp housing bracket as the installation interface bracket structure, the extrusion type double-faced radiator includes a substrate, and fins are provided at the two sides of the substrate; the installation interface used for installing the LED bulb is provided at one side of the substrate, and circular or elliptic conical spaces are formed by cutting on the fins around the installation interface of the substrate according to the illumination angle of the light emitted by the bulb to the extent of not to shield the light emitted by the LED bulb; the installation interface includes a surface in contact with the LED bulb and a hole connected to the LED bulb on the extrusion type double-faced radiator.

In the foregoing LED projection lamp using the lamp housing as the installation interface bracket structure, 6 flange fixing holes on the installation interface of the extrusion type double-faced radiator are uniformly distributed at a diameter D1, and the diameter D1 is a value obtained by subtracting a diameter of a fixing screw cap and then subtracting a margin of 0.8-4 mm from the outer diameter D of the LED bulb.

An LED lawn lamp using an installation interface bracket combined member, including the installation interface bracket combined member, wherein an LED bulb provided with a radiator is provided to the installation interface bracket combined member; a lampshade assembly punch-formed by a metal or die-cast by plastics is provided outside the installation interface bracket combined member; the installation interface bracket combined member includes a pipe bracket which is formed by segmenting a standard pipe, a lamp fixing flange and a lampshade and bulb fixing bracket, the pipe bracket, the lamp fixing flange and the lampshade and bulb fixing bracket are connected, an installation interface used for installing the LED bulb is provided to the lampshade and bulb fixing bracket, and the pipe bracket is connected to the lamp fixing flange and the lampshade and bulb fixing bracket; the lampshade assembly is connected to the installation interface bracket combined member through the lampshade and bulb fixing bracket.

In the foregoing LED lawn lamp using the installation interface bracket combined member, the installation interface includes a surface in contact with the LED bulb and a hole connected to the LED bulb, on the lampshade and bulb fixing bracket; the lampshade and bulb fixing bracket is punch-formed by a metal, a central portion of the lampshade and bulb fixing bracket is connected to the pipe bracket, the lampshade and bulb fixing bracket is engraved to be hollowed around its portion connected to the pipe bracket, so that passage of a cable and formation of a chimney effect in the lampshade are facilitated to ensure the ventilating and radiating effects; a screw hole used for installing the lampshade assembly is provided at the edge of the lampshade and bulb fixing bracket.

In the foregoing LED lawn lamp using the installation interface bracket combined member, the lampshade assembly includes a lampshade, a ventilating cover, a light emitting cover and a shielding cover, which are cooperatively used, the lampshade is covered outside the lampshade or bulb fixing bracket, the ventilating cover is covered outside the pipe bracket, the shielding cover is installed at the upper part of the LED bulb and between the lampshade and the ventilating cover, in order to prevent light from emitting into the ventilating cover and decrease mosquitoes entering the ventilating cover, and the light emitting cover is provided at the top of the lampshade; or, the lampshade assembly includes a lampshade, a ventilating cover, an elongation cover, a light emitting cover gland and a shielding cover, which are cooperatively used, the lampshade is covered outside the lampshade or bulb fixing bracket, the ventilating cover is covered outside the pipe bracket, the shielding cover is installed at the upper part of the LED bulb and between the lampshade and the ventilating cover, in order to prevent light from emitting into the ventilating cover and decrease mosquitoes entering the airtight ventilating cover, the elongation cover is provided at the bottom of the ventilating cover, and the light emitting cover gland is covered at the top of the lampshade; or, the lampshade assembly includes a lampshade, a ventilating cover, an elongation cover, a light emitting cover gland, a light emitting cover and a shielding cover, which are cooperatively used, the lampshade is covered outside the lampshade and bulb fixing bracket, the ventilating cover is covered outside the pipe bracket, the elongation cover is provided at the bottom of the ventilating cover, the shielding cover is installed at the upper part of the LED bulb and between the lampshade and the ventilating cover, in order to prevent light from emitting into the ventilating cover and decrease mosquitoes entering the airtight ventilating cover, the light emitting cover is provided in the lampshade and at the top of the shielding cover for locking the LED bulb, and the top of the light emitting cover (114) is fixed by the light emitting cover gland provided at the top of the lampshade.

In the foregoing LED lawn lamp using the installation interface bracket combined member, 6 flange fixing holes provided to the installation interface are uniformly distributed at a diameter D1, and the diameter D1 is a value obtained by subtracting a diameter of a fixing screw cap and then subtracting a margin of 0.8-4 mm from the outer diameter D of the LED bulb.

An LED screw lamp, including a screw lamp fitting, wherein an installation interface is provided to a radiator on the screw lamp or a heat conductive converting plate connected to the top of the radiator for fixedly installing an LED bulb, and the lampshade of the screw lamp fitting is connected to the radiator or the heat conductive converting plate in an adhesion, threaded connection or clamping manner. The installation interface includes a surface in contact with the LED bulb and a hole connected to the LED bulb of the radiator or the heat conductive converting plate.

In the foregoing LED screw lamp, the screw lamp fitting includes a screw lamp cap, an intermediate connecting element, a radiator, a lampshade, or further includes a driving power supply provided in the screw lamp cap; an electric connector assembly is provided at the joint of the LED bulb and the screw lamp; the intermediate connecting element on the screw lamp cap is connected to the radiator through threads thereon, or through a lamp cap fixing screw or in a direct adhesion manner, or the heat conductive converting plate is further provided to the radiator.

In the foregoing LED screw lamp, the electric connector assembly includes an connector socket, a fixing screw and an adjusting rubber pad; the connector socket is cooperatively connected to a connector plug on the LED bulb, a three-hole flange is provided to the connector socket, the connector socket is fixed with the radiator or the heat conductive converting plate through the three-hole flange and the fixing screw of the connector socket, and a fixed adjusting rubber pad is further provided between the flange and the radiator or the heat conductive converting plate to ensure the tightness of a waterproof surface; a conducting wire led out from the connector socket is welded on the lamp cap.

In the foregoing LED screw lamp, the radiator is a columnar radiator, the radiator is provided with a radiator substrate thickness inwards at the maximal outer diameter of the cylinder and is provided with fins towards the center of the cylinder in a radial line, 2-3 layers of interrupted grooves are provided to the columnar radiator along a sealed circular arc with the substrate as thickness, after the radiator is heated, external air naturally flows into the center of the radiator through the interrupted grooves to form convection so as to achieve a cooling effect.

In the foregoing LED screw lamp, the radiator is a convection radiator, the radiator is provided with a radiator substrate thickness outwards from the cylindrical surface (using the outer diameter of a straightly fixed connector socket as the diameter) at the center and is provided with fins outwards from the substrate in a radial line, and an arched shape is formed on the surface of each fin upwards to gradually increase the open area; the surface of the each fin is covered with a radiator outer cover, and a plurality of through air flow channels are formed between the outer cover and the fins; after the radiator is heated, the air enters from the flow channel opening at the lower end and flows out from the flow channel opening at the higher end, of the radiator to form a chimney effect, in order to achieve air convection to dissipate heat.

An LED cylindrical lamp using a base bracket as an installation interface, including a cylindrical lamp, wherein the cylindrical lamp includes the base bracket and spring fixing clips, and the spring fixing clips are provided at two sides of the base bracket; the cylindrical lamp is provided with the installation interface on the base bracket for fixedly installing an LED bulb.

In the foregoing LED cylindrical lamp using the base bracket as the installation interface, the cylindrical lamp further includes a lampshade piece and a lampshade piece supporting cover; the lampshade piece is provided beneath the base bracket, and the lampshade piece supporting cover is provided beneath the lampshade piece.

In the foregoing LED cylindrical lamp using the base bracket as the installation interface, the installation interface includes a surface in contact with the LED bulb and a hole connected to the LED bulb, on the base bracket.

In the foregoing LED cylindrical lamp using the base bracket as the installation interface, the installation interface on the base bracket includes a radiator interface opening and 6 flange fixing holes, the flange fixing holes are used for fixing the LED bulb, and the radiator interface opening is used for enabling the LED bulb to penetrate through the installation interface; the flange fixing holes are uniformly distributed at a diameter D1, and the diameter D1 is a value obtained by subtracting a diameter of a fixing screw cap and then subtracting a margin of 0.8-4 mm from the outer diameter D of the LED bulb; the diameter D2 of the radiator interface opening on the installation interface is a value obtained by subtracting two times of a diameter of a fixing screw cap and then subtracting two times of the margin corresponding to the diameter D1 from the outer diameter D of the bulb.

An LED ceiling lamp, including a ceiling lamp, wherein the ceiling lamp includes a ceiling lamp base and a radiator, a bulb installation interface is provided to the ceiling lamp base, and the radiator is provided to the bulb installation interface; an installation interface is provided at the center of the lower part of the radiator for fixedly installing the LED bulb.

In the foregoing LED ceiling lamp, a plurality of ventilation gaps are provided at the edge of the upper part of the ceiling lamp base, the radiator is fixed on the base through a fixing screw, after the radiator is heated during operation of the LED ceiling lamp, external air naturally flows into the center of the radiator along the ventilation gaps of the base to form convection so as to achieve a cooling effect; the installation interface includes a surface in contact with the LED bulb and a hole connected to the LED bulb, on the radiator.

In the foregoing LED ceiling lamp, the ceiling lamp lamp further includes a ceiling lampshade, and the ceiling lampshade is connected to the ceiling lamp base in a clamping or screw connecting manner.

In the foregoing LED ceiling lamp, a vent hole A is provided at the edge of the bulb installation interface of the ceiling lamp base, and in order to prevent mosquitoes from entering, the vent hole A is coated with a gauze; a vent hole B is provided to the ceiling lampshade, and in order to prevent mosquitoes from entering, the vent hole B is coated with a gauze; external air may enter from the vent hole B and flow out from the vent hole A to achieve a convection radiating effect.

In the foregoing LED ceiling lamp, 6 flange fixing holes on the installation interface of the radiator are uniformly distributed at a diameter D1, and the diameter D1 is a value obtained by subtracting a diameter of a fixing screw cap and then subtracting a margin of 0.8-4 mm from the outer diameter D of the LED bulb.

Compared with the prior art, the present invention uses the lens snap ring as a supporting member of the entire lamp and uses the inner snap rings in the lens snap ring as an auxiliary support, then a structure of the LED bulb as a light source body constructed by the inner snap rings as well as the optical engine module and the heat conductive bracket adhered to the inner snap rings is formed finally, therefore such a structure is very stable. Moreover, the optical engine module in the present invention is sealed in the sealed section defined by the inner snap rings, the heat conductive bracket and the lens, therefore the waterproof performance of the bulb is greatly improved under the condition of not adding other waterproof elements. The snap ring structured LED bulb in the present invention is used for establishing the lamp in a simple, easy, flexible and variable manner, in this way, the bulb, the lamp and the lighting control product of the LED bulb are independently produced and used, thereby greatly reducing the production procedures of LED lighting products, improving mass production and facilitating the industrialization of LED energy-saving lighting products. Moreover, in the present invention, one connector plug with a contact pin is fixed in the hole on the LED bulb in a trepanning manner, and circuit welding and mechanical fixing are performed in the bulb, thus the peripheral structure of the entire universal LED bulb is simple and smooth, and the LED bulb is provided with no cable externally, when the bulb is installed, the electric connector plug is aligned to the connector socket on the cable, then the LED bulb is mechanically fixed, and meanwhile, reliable electric connection of the universal LED lamp is achieved. Moreover, in the present invention, the connector plug and the connector socket may be connected to directly achieve a reliable waterproof function with hardly adding additional cost, thus the universal LED bulb provided with the electric connector in the present invention may be both used outdoors and indoors and may also be used in explosion proof environments, such that the application range of the LED bulb is greatly expanded.

BRIEF DESCRIPTION OF THE DRAWINGS

FIG. 54 is a schematic diagram of a structure of embodiment 4 of the present invention;

FIG. 93 is a schematic diagram of an installation interface on a lamp in an embodiment of the present invention (for a bulb with a radiator).

Figure 1:
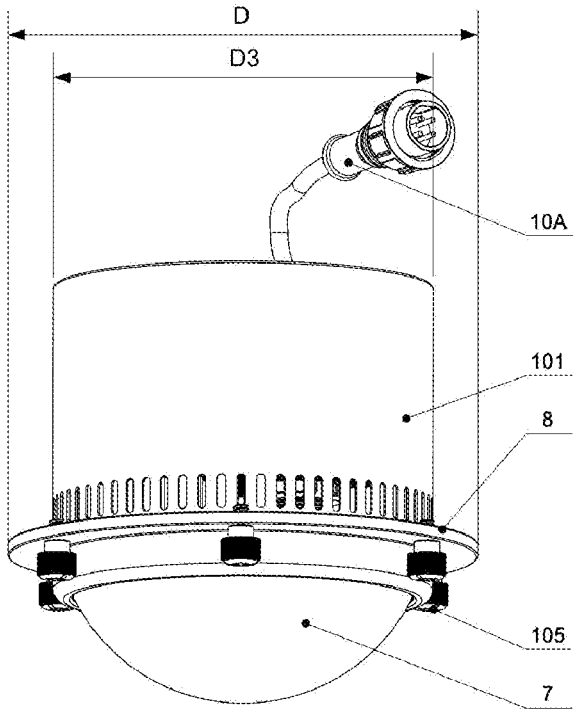
FIG. 1 is an external view of a bulb convex lens solution with a nonmetal radiator in the present invention.

Reference signs of the drawings: 1—heat conductive conversion bracket, 2—heat conductive pad, 3—heat conductive bracket, 4—optical engine module, 6—inner cover, 7—light distribution optical lens, 8—lens snap ring, 9—outer bulb cover, 10—connector socket, 10A—waterproof joint with a cable, 11—electric connector plug, 11A—cable fixing head, 12—radiator fixing screw, 14—fixing screw of the lens snap ring, 15—fixed end, 16—waterproof rubber ring, 17—contact pin, 18—slot of the waterproof rubber ring, 19—contact pin welding point, 22—connector plug fixing hole, 23—radiator fixing through hole, 24—fixed adjusting rubber pad, 25—connector socket fixing screw, 26—antiskid groove, 27—heat conductive converting plate, 28—fixing nut, 32—vacuum suction pipe, 33—upper stopper, 34—cooling fin, 35—lower stopper, 36—cable hole, 37—foam metal, 38—radiator fixing screw hole, 39—top-mounted fixing flange, 40—external power supply box, 42—screen mesh, 61—concave inner cover, 62—inner ring cover, 81—inner snap ring, 101—radiator outer cover, 102—LED bulb in the present invention, 103—radiator, 105—bulb fixing screw, and 301—bulb installation flange fixing hole.

DETAILED DESCRIPTION OF THE EMBODIMENTS

The present invention will be further illustrated below in conjunction with accompanying drawings and embodiments, which are not used as a basis of limiting the present invention.

Embodiments

A method for constructing a universal LED bulb comprises: supporting an optical engine core member of the LED bulb in the lens snap ring using a lens snap ring as a supporting main body of the bulb, using an inner snap ring provided on the inner side of a light distribution optical lens in the LED bulb optical engine core member as an auxiliary supporting structure, and using the inner snap ring as an installation base of an optical engine module and a heat conductive bracket or an installation base of an LED bulb radiator, wherein the LED bulb optical engine core member is composed of the heat conductive bracket, the optical engine module, the inner snap ring and the light distribution optical lens, wherein an inner cover is provided outside the optical engine module, and an electric connector is provided to the heat conductive bracket; an installation flange for installing the bulb is provided to the lens snap ring; the optical engine module is made up of an optical engine die plate, an LED chipset and a related circuit by bonding and packging, or is further integrated with a power supply drive chip. The diameter of the lens snap ring is a bulb outer diameter D, the bulb outer diameter D and an upper limit of power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve the interchangeability and universality of the LED bulbs; on the relationship curve $W=1.1812e^{0.0361D}$, 20 mm is used as the lower limit of the bulb outer diameter D, 130 mm is used as the upper limit, each 10 mm is set as a segment, the relationship curve is divided into 12 segments to form a limited number of bulb outer diameter specifications, and the interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then substracting a margin of 0.8-4 mm from the bulb outer diameter D; the diameter D2 of a radiator interface opening of the LED bulb on a lamp is a value obtained by subtracting two times of a diameter of a fixing screw cap and then substracting two times of the margin corresponding to the diameter D1 from the bulb outer diameter D; the installation interface of the LED bulb includes a surface in contact with the LED bulb and a hole connected to the LED bulb, on the lamp. A step is provided at the upper part of the inner snap ring, an integral structure formed by adhering the heat conductive bracket and the optical engine module is adhered in the step, the inner snap ring surrounds the outside the optical engine module, or an inner ring cover is further provided between the inner snap ring and the inner cover, the light distribution optical lens is adhered at the bottom part of the inner snap ring for enclosing the optical engine module in a sealed waterproof space among the heat conductive bracket, the inner snap ring and the light distribution optical lens, or the radiator is fixed on the inner snap ring by a radiator fixing through hole of the inner snap ring, and finally, the inner snap ring is adhered in the lens snap ring; the thicknesses of the light distribution optical lens, the inner snap ring and the heat conductive bracket are adjusted to enable the heat conductive bracket to closely lean against the radiator when the lens snap ring is installed; the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded thereon by silver paste printed circuit technology.

For a small-specification LED bulb, the heat conductive bracket, the optical engine module, the inner snap ring and the light distribution optical lens are sequentially overlapped and adhered to form an integral LED bulb optical engine core member, or the inner ring cover is further provided between the inner snap ring and the inner cover, and components packaged on the optical engine die plate in the optical engine module are packaged in the sealed waterproof space among the heat conductive bracket, the inner snap ring and the light distribution optical lens; or, the inner cover and the inner snap ring are of an integral structure (namely, an inner cover has a function of the inner snap ring), the components packaged on the optical engine die plate are packaged in the waterproof space between the optical engine die plate and the integral structure formed by the inner cover and the inner snap ring; or the inner snap ring is further used as the installation base of the LED bulb radiator; the thicknesses of the light distribution optical lens, the inner snap ring and the heat conductive bracket are adjusted to enable the heat conductive bracket to closely lean against the radiator when the lens snap ring is installed; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

A radiator is provided to the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by extrusion forming an ultrafine nonmetal heat conductive material (such as alumina, silicon carbide or the like) at a low temperature and sintering the same at a high temperature, the contact surfaces thereof are adhered into an entirety by coating a heat conductive adhesive, a rubber sheath or screw fixing glue is filled in the fixing screw hole of the nonmetal radiator for connecting a fixing screw, a radiator outer cover, which may be punch-formed by a metal material or die-cast by plastics to beautify the appearance of the bulb, is provided outside the nonmetal radiator, the heat conductive conversion bracket is overhead, the nonmetal radiator takes the shape of a screen mesh, and the nonmetal radiator is overhead by the heat conductive conversion bracket, for enabling the air to enter the screen mesh of the nonmetal radiator from the heat conductive conversion bracket; or the radiator is a metal radiator, the heat conductive pad is provided between the metal radiator and the heat conductive bracket, the metal radiator is of a hollow structure, a foam metal is filled in the hollow part, superconducting liquid is filled in the hollow structure, upper and lower stoppers are pressed by interference fit or screwed by a threaded seal gum in the hollow structure to form an enclosed space, and the sealed space is vacuumized; a radiator fixing screw is penetrated through a fixing through hole on the inner snap ring, in order to be connected to the radiator fixing screw hole of the nonmetal radiator or the metal radiator. Fluorescent powder is spray coated on the LED chip, and transparent silica gel is covered thereon; or the number of the LED chips is configured according to the proportion of blue and red lights necessary for plants, and only the transparent silica gel is covered on the welded LED chip for package; or, the LED chip is only packaged by the transparent silica gel, and then, an inner cover coated with fluorescent powder on the inner side is provided outside the packaged optical engine module; or no silica gel is covered on the LED chip, a concave inner cover filled with transparent insulating heat conductive liquid is provided outside the LED chip, the fluorescent powder is provided in the transparent insulating heat conductive liquid, and the concave inner cover is an elastic inner cover of a thin inner concave structure. A through hole is provided to the heat conductive bracket, a connector plug with a contact pin is inserted into the through hole and is fixed with the part inserted into the bulb as a fixed end, the tail end of the contact pin is welded with the optical engine die plate in the universal LED bulb, to form a simple electric interface on the outer surface of the universal LED bulb, during installation, as long as the connector plug is in butt joint with an connector socket with a cable, and the universal LED bulb is fixed, the electric connection of the universal LED bulb is achieved; the eccentric position of the hole of the connector plug on the heat conductive bracket and the size of the fixed end of the connector plug are limited, such that the optical engine die plate in the LED bulb may meet the demands of arranging the LED chip and the driving power supply chip and the alignment demand; the connector plug with the contact pin is of a four-pin structure, wherein two pins are used for power supply access, and the other two pins are used for control access; the fixed end is in a nut fixing manner or a fusion ring fixing manner; when the fixed end is in the nut fixing manner, a waterproof rubber ring is added between the connector plug and the heat conductive bracket to prevent water; in order to prevent rotation, an antiskid groove is provided to the connector plug, and a corresponding projection is provided at the through hole of the heat conductive bracket; a three-hole flange is provided to the connector socket and is fixed on a lamp radiator through a fixing screw, an adjusting rubber pad is provided between the connector socket and the radiator to adjust the thickness, in order to ensure the tightness of a waterproof surface; or external threads are provided to the connector plug to match with the internal threads of the fixing nut on the connector socket provided with the waterproof rubber ring to prevent water; a slot is provided to the connector socket, and the waterproof rubber ring is provided in the slot to prevent water.

Figure 6:
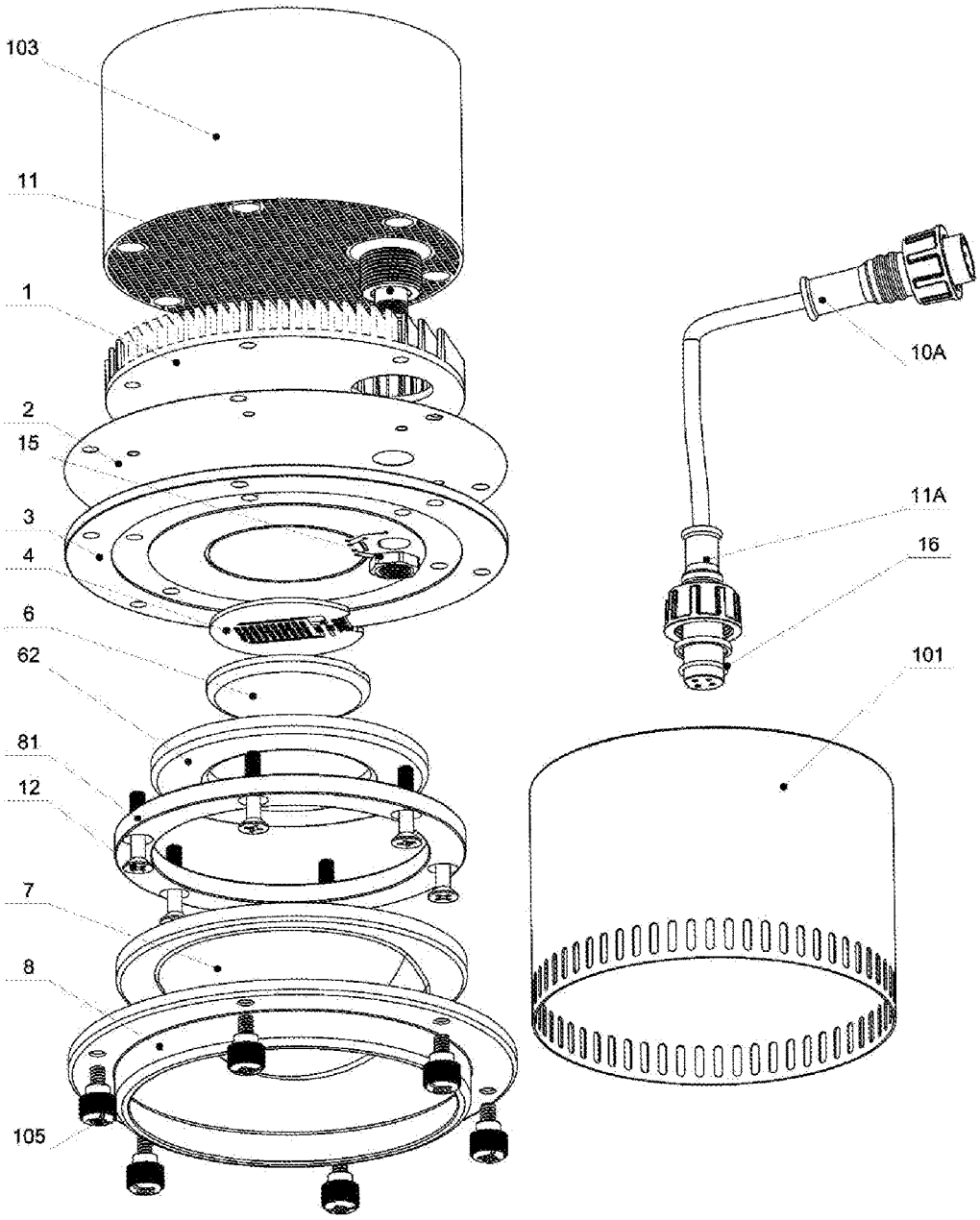
FIG. 6 is an exploded view of a structure in the present invention.
Figure 7:
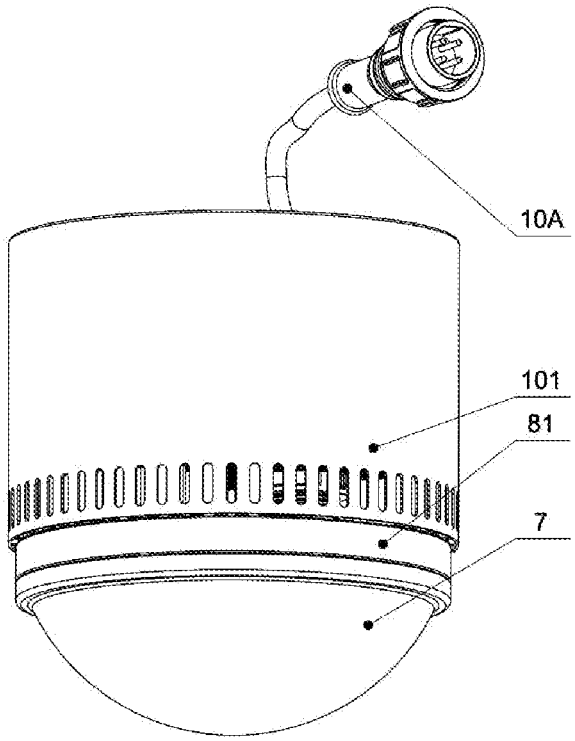
FIG. 7 is a structure diagram of an outline of an LED bulb optical engine core member in the present invention.
Figure 9:
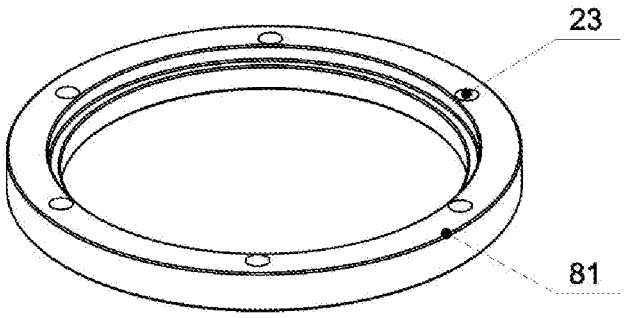
FIG. 9 is an external view of an inner snap ring in an embodiment of the present invention.
Figure 10:
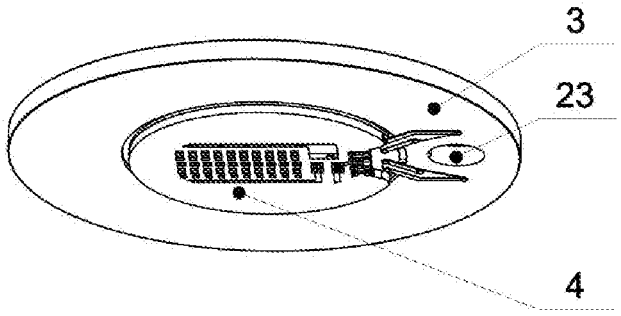
FIG. 10 is an external view of assembly of an optical engine module and a heat conductive bracket in an embodiment of the present invention.
Figure 30:
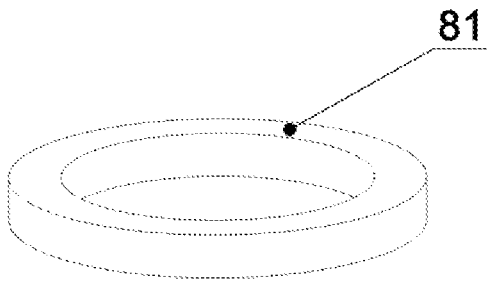
FIG. 30 is a schematic diagram of a structure of an inner snap ring provided with no radiator in the present invention.
Figure 31:
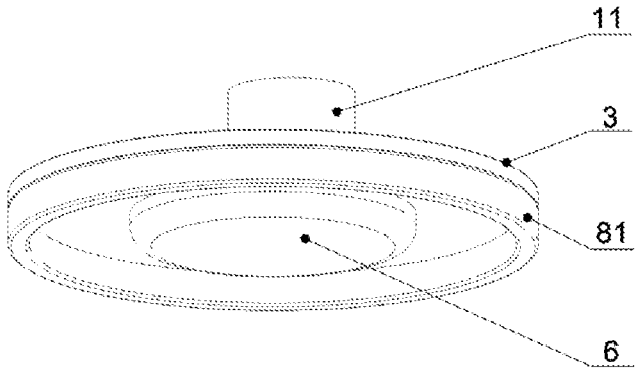
FIG. 31 is a schematic diagram of an installation structure of an inner snap ring provided with no radiator in the present invention.

A snap ring structured LED bulb constructed by the foregoing method, as shown in FIG. 6 and FIG. 7, including a lens snap ring 8 with an installation flange, wherein at least a heat conductive bracket 3, an optical engine module 4, an inner snap ring 81 (as shown in FIG. 9) and a light distribution optical lens 7 are provided in the lens snap ring 8 sequentially, a connector plug 11 is fixed to the heat conductive bracket 3, and an inner cover 6 is further provided outside the optical engine module 4; the optical engine module 4 is composed of an optical engine die plate, an LED chipset and a related circuit by bonding and packging, or is further integrated with a power supply drive chip. A step is provided at the upper part of the inner snap ring 81, the heat conductive bracket 3 is provided in the step, the optical engine module 4 (as shown in FIG. 10) is adhered to the heat conductive bracket 3, the inner snap ring 81 is adhered with the light distribution optical lens 7 and the heat conductive bracket 3 on two sides, the three components form a sealed waterproof space for enclosing the optical engine module 4, and the upper surface of the heat conductive bracket 3 and the upper edge of the lens snap ring 8 are located on the same plane. Or, the inner snap ring 81 is further used as an installation base of a radiator of the LED bulb; under the condition that no radiator is installed, the step on the inner snap ring 81 may be removed, the structure may be as shown in FIG. 30 and the installation manner is as shown in FIG. 31; or, the heat conductive bracket 3 and the optical engine die plate 4 are integrally made of the same nonmetal heat conductive material; the optical engine die plate 4 is a metal material heat conductive substrate in which a circuit is obtained by PCB printed circuit board technology; or the optical engine die plate is a nonmetal material heat conductive substrate in which a circuit is embedded thereon by silver paste printed circuit technology.

Figure 32:
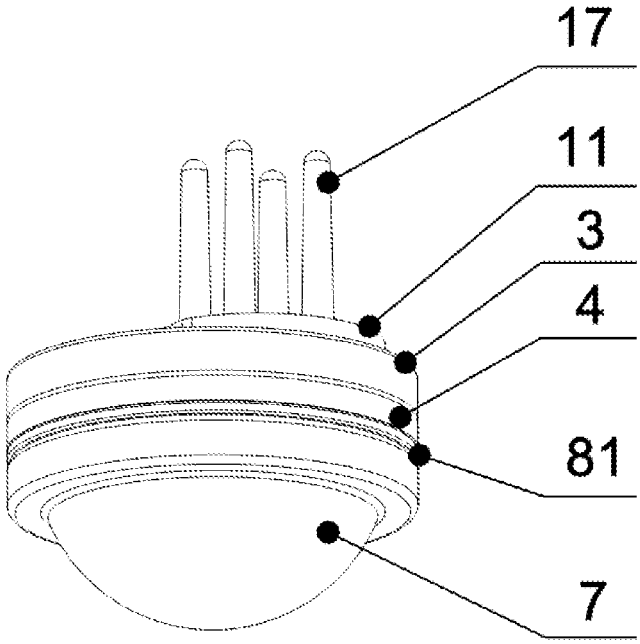
FIG. 32 is a schematic diagram of a structure of an optical engine core member under a small-specification condition in the present invention.
Figure 33:
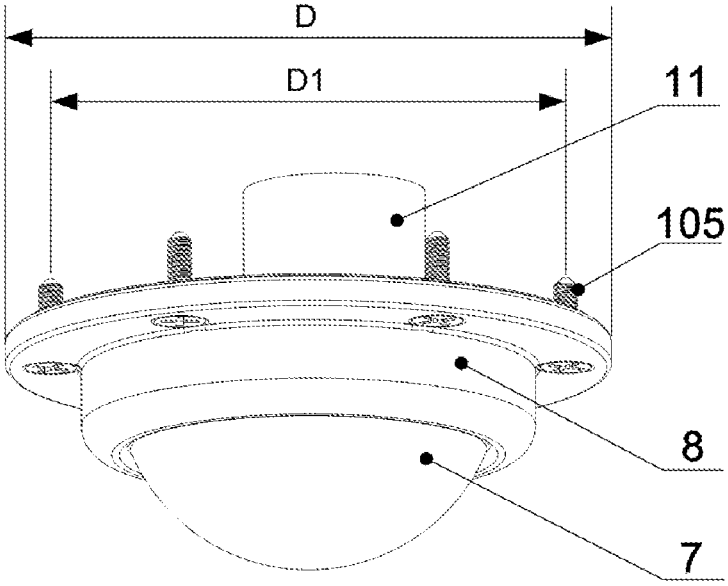
FIG. 33 is an external view of a small-specification bulb convex lens solution in the present invention.

For a small-specification LED bulb, as shown in FIG. 32, the heat conductive bracket 3, the optical engine module 4, the inner snap ring 81 and the light distribution optical lens 7 are sequentially overlapped and adhered, or the inner ring cover 62 is further provided between the inner snap ring 81 and the inner cover 6, and the optical engine die plate of the optical engine module 4, the inner snap ring 81 and the light distribution optical lens 7 form a sealed waterproof space used for packaging components packaged on the optical engine die plate; or, the inner snap ring 81 is further used as the installation base of the LED bulb radiator; or the inner snap ring 81 and the inner cover 6 are processed to an inner cover with a function of the inner snap ring and having an integral structure; when the lens snap ring 8 is installed, it could be ensured the upper surface of the heat conductive bracket 3 closely leans against the radiator 103.

Figure 8:
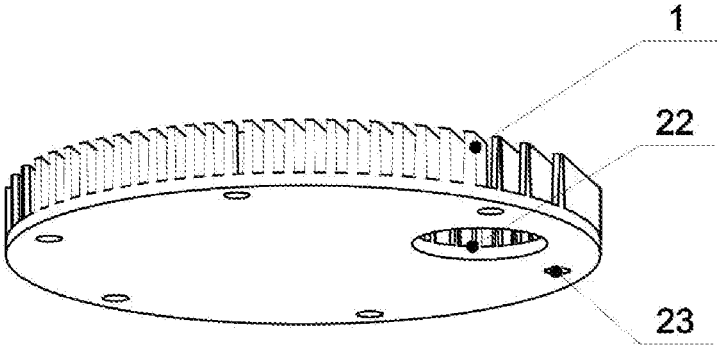
FIG. 8 is an external view of a heat conductive conversion bracket in an embodiment of the present invention.
Figure 14:
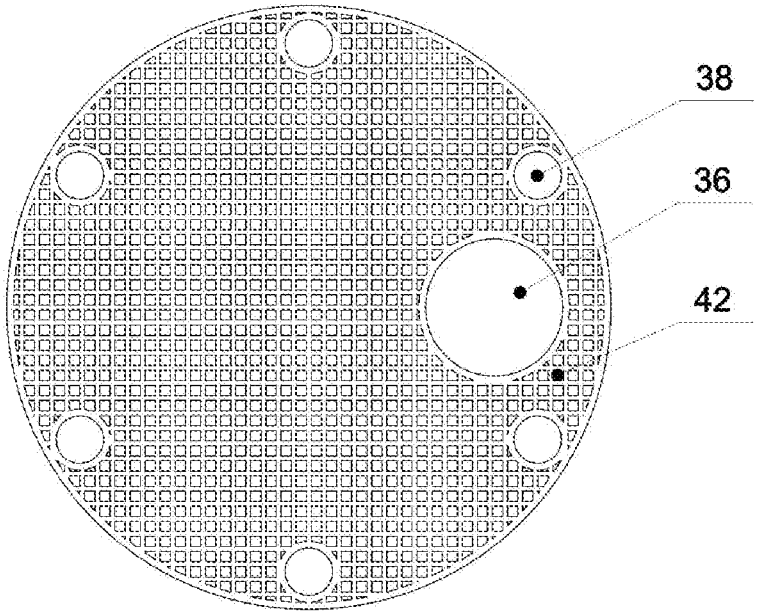
FIG. 14 is a sectional view of a nonmetal radiator in an embodiment of the present invention.
Figure 15:
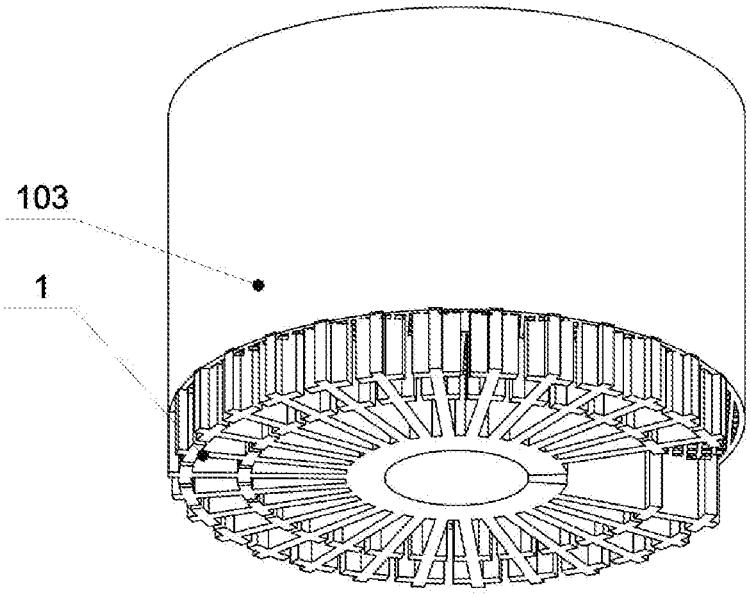
FIG. 15 is an external view of a nonmetal radiator assembly in an embodiment of the present invention.
Figure 16:
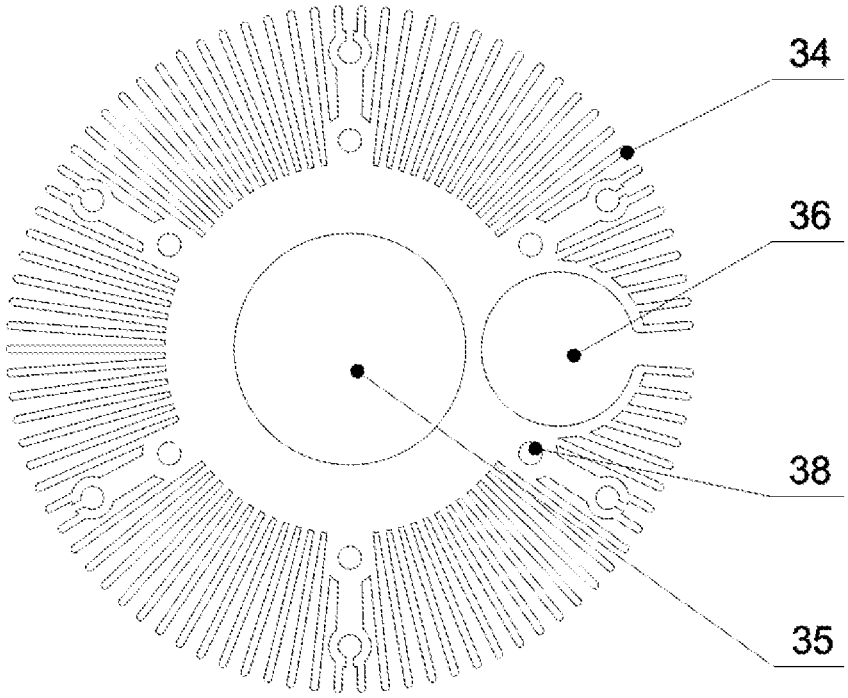
FIG. 16 is a sectional view of a metal radiator in an embodiment of the present invention.
Figure 17:
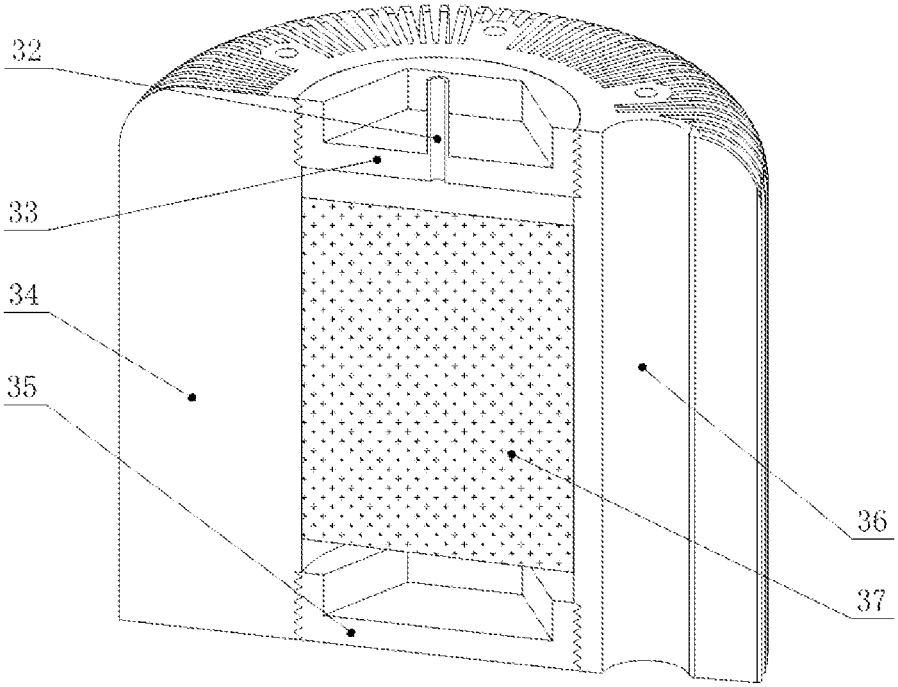
FIG. 17 is a schematic diagram of an internal structure of a metal radiator in an embodiment of the present invention.

For the LED bulb with a radiator: a radiator 103 is provided to the heat conductive bracket 3, and a heat conductive pad 2 is provided between the radiator 103 and the heat conductive bracket 3; the radiator 103 is a nonmetal radiator assembly, the nonmetal radiator assembly includes a screen mesh-shaped nonmetal radiator (as shown in FIG. 15, a screen mesh 42 may be seen from the section, and other structures capable of realizing ventilation may also be adopted, as shown in FIG. 8) and an overhead heat conductive conversion bracket 1 at the lower side thereof, a rubber sheath or screw fixing glue is filled in the radiator fixing screw hole 33 of the nonmetal radiator for connecting a fixing screw, a radiator outer cover 101 is provided outside the nonmetal radiator, and the section of the nonmetal radiator is as shown in FIG. 14. Or, the radiator 103 may also be a metal radiator, the heat conductive pad 2 is provided between the metal radiator and the heat conductive bracket 3, the metal radiator includes a cooling fin 34, as shown in FIG. 16 and FIG. 17, a superconductive fluid cavity is provided at the middle of the cooling fin 34, a foam metal 37 is filled in the superconductive fluid cavity and superconductive fluid is filled therein, an upper stopper 33 and a lower stopper 35 are provided at the two ends of the superconductive fluid cavity, and a vacuum suction pipe 32 is provided to the upper stopper 33 or the lower stopper 35; a cable hole 36 used for penetration of a cable and a radiator fixing screw hole 38 are further provided to the radiator 103.

A radiator fixing screw 12 is internally penetrated through the inner snap ring 81 and the radiator fixing through hole 22 on the radiator 103 to fix the radiator 103 on the inner snap ring 81.

Figure 11:
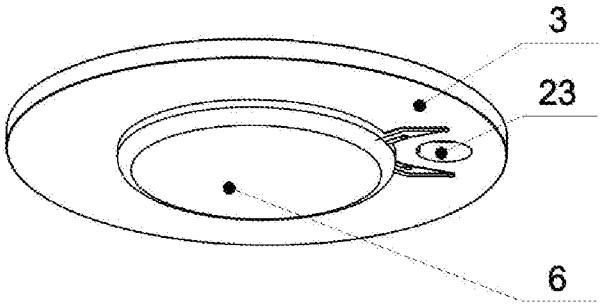
FIG. 11 is an external view of an optical engine module assembly provided with a flat inner cover in an embodiment of the present invention.
Figure 13:
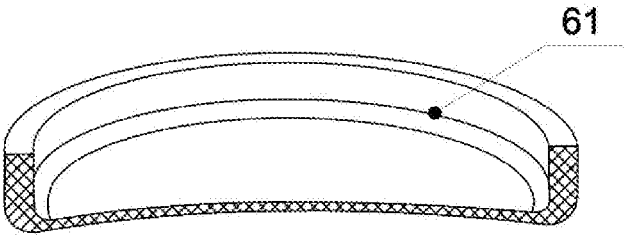
FIG. 13 is a cutaway view of a concave inner cover in an embodiment of the present invention.

Transparent silica gel for package is provided outside the LED chip on the optical engine module 4, an inner cover 6 is provided outside the optical engine module 4 with the transparent silica gel, and fluorescent powder coating is provided to the inner layer of the inner cover 6, as shown in FIG. 11; or no silica gel is packaged on the LED chip on the optical engine module 4, a concave inner cover 61 filled with transparent insulating heat conductive liquid is provided outside the optical engine module 4, the LED chip is soaked in the transparent insulating heat conductive liquid, fluorescent powder is provided in the transparent insulating heat conductive liquid, and the concave inner cover is an elastic inner cover the section of which is of a thin inner concave structure as shown in FIG. 11, as shown in FIG. 13.

Figure 12:
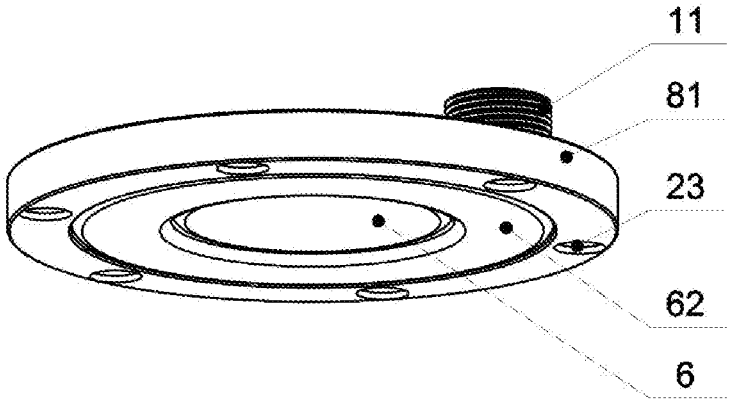
FIG. 12 is an external view of assembly of a heat conductive bracket, an electric connector, an inner snap ring and an optical engine module assembly in an embodiment of the present invention.
Figure 18:
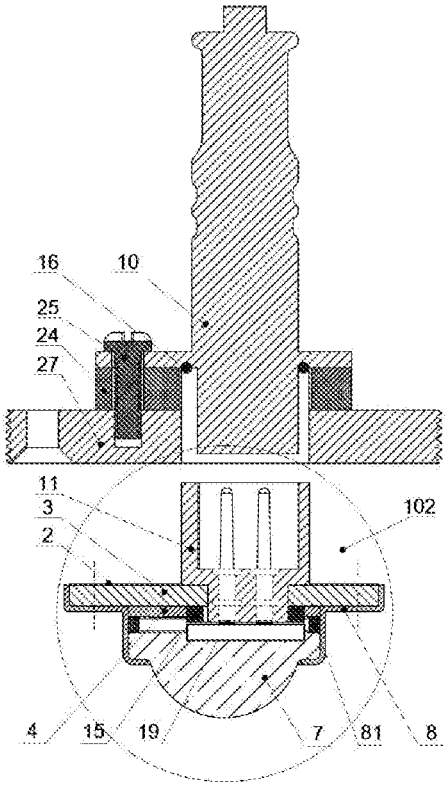
FIG. 18 is a schematic diagram of assembly of a structure of a small-bore bulb and an electric connector in an embodiment of the present invention.
Figure 19:
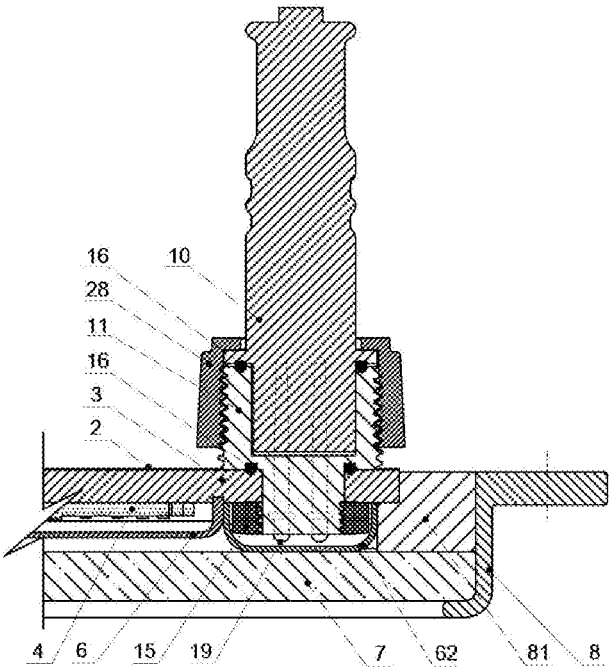
FIG. 19 is a schematic diagram of assembly of a structure of a large-bore bulb and an electric connector in an embodiment of the present invention.
Figure 20:
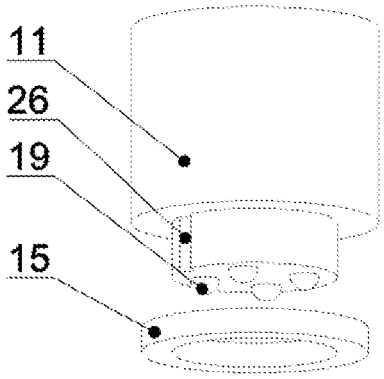
FIG. 20 is a schematic diagram of a structure of a connector plug at a fusion ring fixed end in the present invention.
Figure 21:
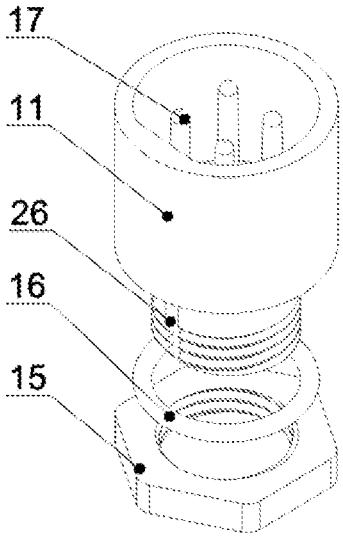
FIG. 21 is a first schematic diagram of a structure of a connector plug at a nut fixed end in the present invention.
Figure 22:
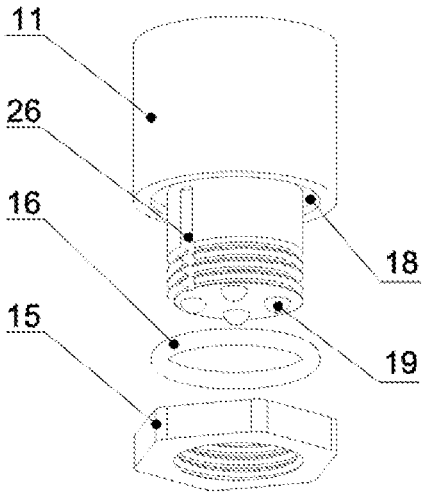
FIG. 22 is a second schematic diagram of a structure of a connector plug at a nut fixed end in the present invention.
Figure 23:
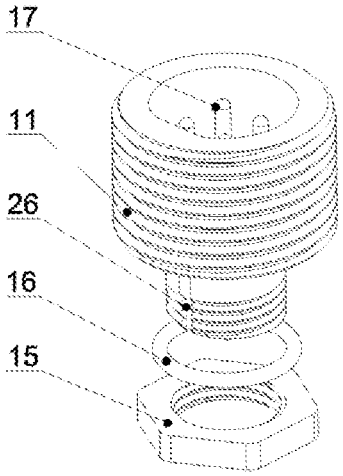
FIG. 23 is a schematic diagram of a structure of a connector plug with external threads in the present invention.
Figure 24:
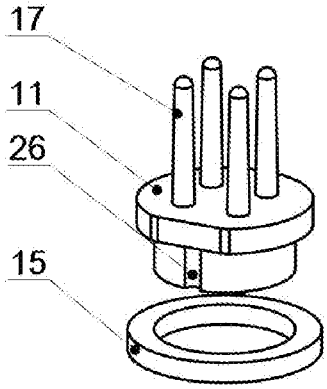
FIG. 24 is a schematic diagram of a structure of a pin type connector plug at a fusion ring fixed end in the present invention.
Figure 25:
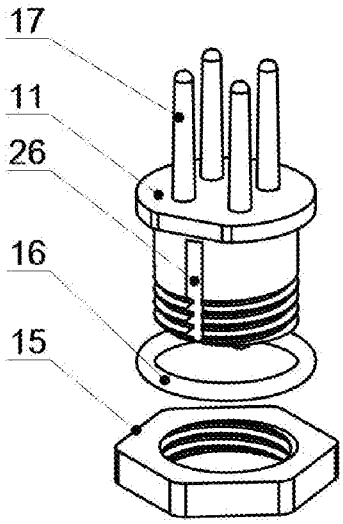
FIG. 25 is a schematic diagram of a structure of a pin type connector plug at a nut fixed end in the present invention.
Figure 26:
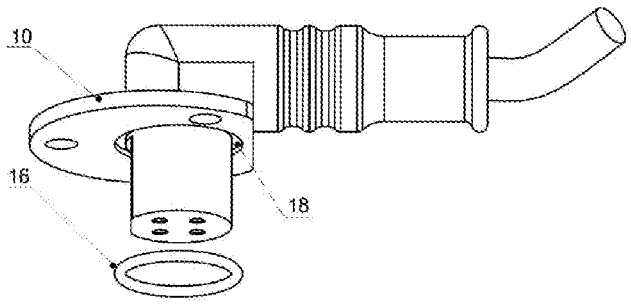
FIG. 26 is a schematic diagram of a structure of a connector socket fixedly connected in a bent shape in the present invention.
Figure 27:
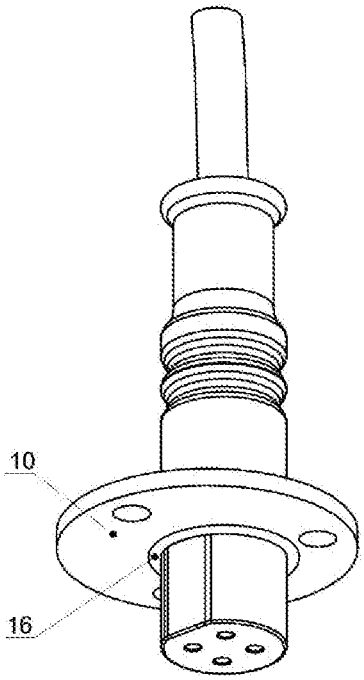
FIG. 27 is a schematic diagram of a structure of a connector socket fixedly connected in a straight shape in the present invention.
Figure 28:
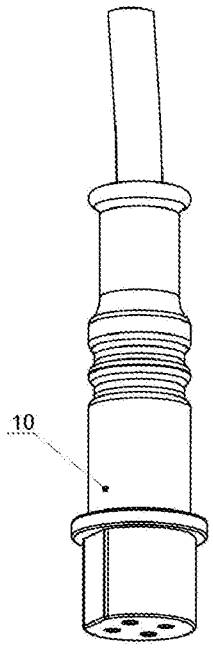
FIG. 28 is a schematic diagram of a structure of a connector socket non-fixedly connected in a straight shape in the present invention.

An electric connector is provided to the heat conductive bracket 3, the electric connector includes a connector plug 11, a contact pin 17 is provided to the connector plug 11, and a contact pin welding spot 19 at the tail segment of the contact pin 17 is welded with the optical engine module 4; after penetrating through a fixing hole 22 of the connector plug on the universal LED bulb, the connector plug 11 is provided with a fixed end 15 for fixing; the connector plug 11 is cooperatively connected to an connector socket 10 with a jack, and the connector socket 10 is connected to a cable; the connector socket 10 is provided to a cable fixing head 11A at the other end of the cable in a waterproof joint 10A with the cable. The contact pin of the electric connector is of a four-pin structure, wherein two pins are used for power supply access, and the other two pins are used for control access. The fixed end 15 is a fusion ring, as shown in FIG. 20 and FIG. 24, wherein the connector plug 11 in FIG. 24 is provided with no protecting jacket; or the fixed end 15 is a fixing nut, a waterproof rubber ring slot 18 is further provided to the connector plug 11, and a waterproof rubber ring 16 is provided in the waterproof rubber ring slot 18, as shown in FIG. 21, FIG. 22, FIG. 23 and FIG. 25, wherein the connector plug 11 in FIG. 25 is provided with no protecting jacket; in order to prevent rotation, an antiskid groove 26 is provided to the connector plug 11, and a corresponding projection is provided at the through hole of the heat conductive bracket 3; a three-hole flange (as shown in FIG. 26 and FIG. 27) is provided to the connector socket 10, and the connector socket is fixed with the radiator 103 or a heat conductive converting plate 27 on the lamp through the three-hole flange and a fixing screw 25 of the connector socket, and a fixed adjusting rubber pad 24 is further provided between the flange and the radiator 103 or the heat conductive converting plate 27 on the lamp to ensure the tightness of a waterproof surface, as shown in FIG. 18; or the connector plug 11 is provided with external threads to match with the internal threads of the fixing nut 28 on the connector socket 10 provided with the waterproof rubber ring 16, in order to be fixed on the connector plug 11, as shown in FIG. 19; an slot is provided to the connector socket 10, and the waterproof rubber ring 16 is provided in the slot, wherein the connector socket may also be a non-fixed connector socket as shown in FIG. 28. Meanwhile, in order to shield the electric connector fixed end, the power supply element and the like, and to keep beautiful appearance of the bulb, a ring cover 62 is provided between the inner cover 6 and the inner snap ring 81, as shown in FIG. 12. A small-bore bulb (D≤70 mm) may be not provided with the ring cover 62 or the inner cover 6 generally (may also include the ring cover 62), and the schematic diagram of assembly of the structure thereof and the electric connector is as shown in FIG. 18; the schematic diagram of assembly of the structure of a large-bore bulb (D>70 mm) and the electric connector is as shown in FIG. 19.

The bulb outer diameter D and the upper limit of the power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve the interchangeability and universality of the LED bulbs. On the relationship curve $W=1.1812e^{0.0361D}$, 20 mm is used as the lower limit of D, 130 mm is used as the upper limit, each 10 mm is set as a segment, the relationship curve is divided into 12 segments to form limited bulb outer diameter specifications, and the interchangeability and universality of the LED bulbs are further improved by the small amount of bulb outer diameter specifications. A screw hole distribution hole D1 for fixing the bulb and the diameter D2 of a radiator interface opening (an opening used for penetration of the radiator on the installation interface) of the lamp are influenced by the size of the used screw, and the diameter D1 is a value obtained by subtracting a diameter of a fixing screw cap and then substracting a margon of 0.8-4 mm from the outer diameter D of the LED bulb; the diameter D2 of the radiator interface opening is a value obtained by subtracting two times of a diameter of a fixing screw cap and then substracting two times of the margin corresponding to the diameter D1 from the bulb outer diameter D; the value of the wire outlet hole distance L (namely, the eccentric position of the connector plug on the heat conductive bracket) of the bulb is set according to the following table. In FIG. 1, FIG. 2, FIG. 3, FIG. 4, FIG. 5 and FIG. 33, the outer diameter D of the outline size of the bulb, the diameter D1 of the flange screw distribution circle and the outer diameter D3 of the radiator are manufactured according to specified sizes, and the related sizes are set forth in FIG. 29 and the following table.

| Outer diameter D (mm) of bulb | Diameter D1 (mm) of screw hole distribution circle | Diameter D2 (mm) of radiator interface opening | Wire outgoing hole distance L (mm) | Specification of Fixing screw ¢ (mm) | Suitable power (W) |
|---|---|---|---|---|---|
| 20 | 16 | 12 | 2 | M1.6 | <2.5 |
| 30 | 25 | 20 | 2 | M1.6 | <3.5 |
| 40 | 35 | 30 | 2 | M1.6 | <5 |
| 50 | 42 | 34 | 2 | M2.5 | <7 |
| 60 | 52 | 44 | 2 | M2.5 | <10 |
| 70 | 62 | 54 | 2 | M2.5 | <14.5 |
| 80 | 70 | 60 | 18 | M3.5 | <21 |
| 90 | 80 | 70 | 18 | M3.5 | <30 |
| 100 | 90 | 80 | 27 | M3.5 | <44 |
| 110 | 100 | 90 | 27 | M3.5 | <64 |
| 120 | 110 | 100 | 33 | M3.5 | <90 |
| 130 | 120 | 110 | 33 | M3.5 | <130 |

Note 1:
the outer diameter D3 of the bulb radiator or the outer cover is not larger than D2-1;
Note 2:
the diameter Φ of the wire outgoing hole of the bulb is determined according to the size of the bulb connector (interface).

Embodiment 1-1

An LED tunnel lamp using a double-faced radiator structure, includes an extrusion type double-faced radiator 103 extrusion formed by a metal, wherein an LED bulb 102 is provided to the extrusion type double-faced radiator 103, the extrusion type double-faced radiator 103 is installed on an installation support 104, and one or more installation interface used for installing the LED bulb 102 is provided to the extrusion type double-faced radiator 103. The extrusion type double-faced radiator 103 includes a substrate, and fins are provided at the two sides of the substrate; the installation interface used for installing the LED bulb 102 is provided at one side of the substrate, and circular or elliptic conical spaces are formed by cutting on the fins around the installation interface of the substrate according to the illumination angle of the light emitted by the bulb to the extent of not to shield the light emitted by the LED bulb 102; the installation interface includes a surface in contact with the LED bulb 102 and a hole connected to the LED bulb, on the extrusion type double-faced radiator 103; the LED tunnel lamp using the double-faced radiator structure further includes a wire harness connector 106, and the wire harness connector 106 is used for connecting a plurality of LED bulbs 102 to a power supply and a control circuit. The extrusion type double-faced radiator 103 is installed on the installation support 104 through a reversing connecting plate 110, the reversing connecting plate 110 is fixed on a diversion bracket 108, and the diversion bracket 108 is fixed on the installation support 104, such that the angle of the extrusion type double-faced radiator 103 may be simultaneously adjusted in the horizontal direction and the vertical direction; the wire harness connector 106 is provided to the installation support 104. Or, the extrusion type double-faced radiator 103 is connected to a radiator bracket 117; the radiator bracket 117 is used for installing the extrusion type double-faced radiator 103 on the installation support 104 through the turning connecting plate 110, the radiator bracket 117 is connected to the turning connecting plate 110, the turning connecting plate 110 is fixed on the diversion bracket 108, and the diversion bracket 108 is fixed on the installation support 104, such that the angle of the extrusion type double-faced radiator 103 may be simultaneously adjusted in a horizontal direction and a vertical direction; the wire harness connector 106 is provided to the installation support 117. 6 flange fixing holes on the installation interface of the extrusion type double-faced radiator 103 are uniformly distributed at a diameter D1, and the diameter D1 is a value obtained by subtracting a diameter of a fixing screw cap and then substracting a margin of 0.8-4 mm from the outer diameter D of the LED bulb 102.

Embodiment 1-2

Figure 34:
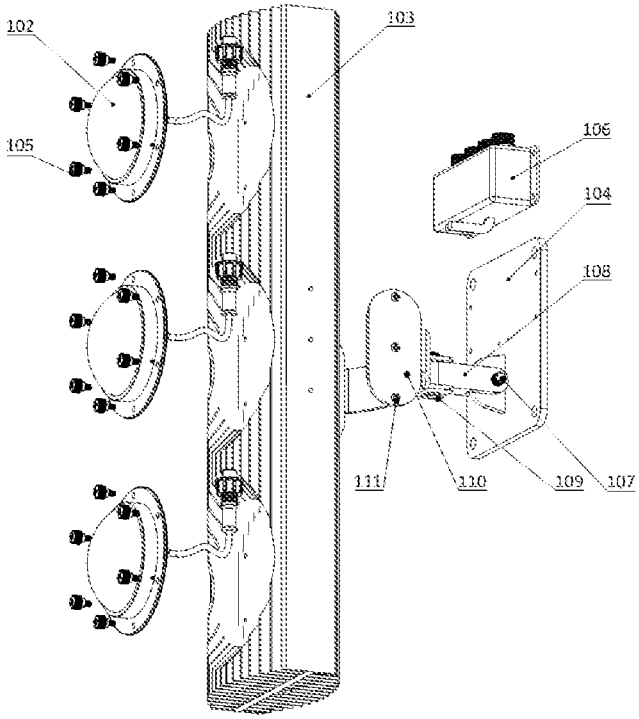
FIG. 34 is a schematic diagram of structures of embodiment 1-2 in the present invention.
Figure 35:
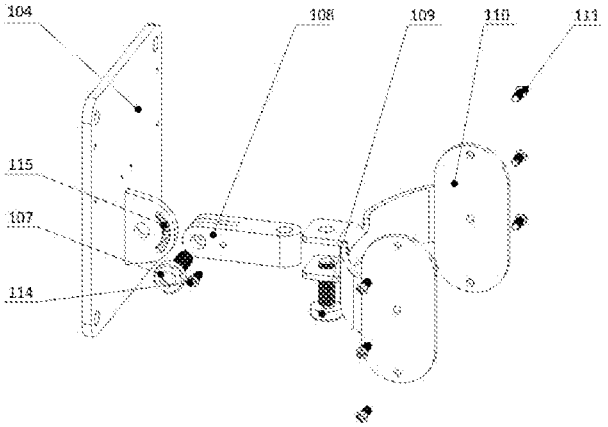
FIG. 35 is a schematic diagram of a structure of an installation support in embodiment 1-2 of the present invention.
Figure 36:
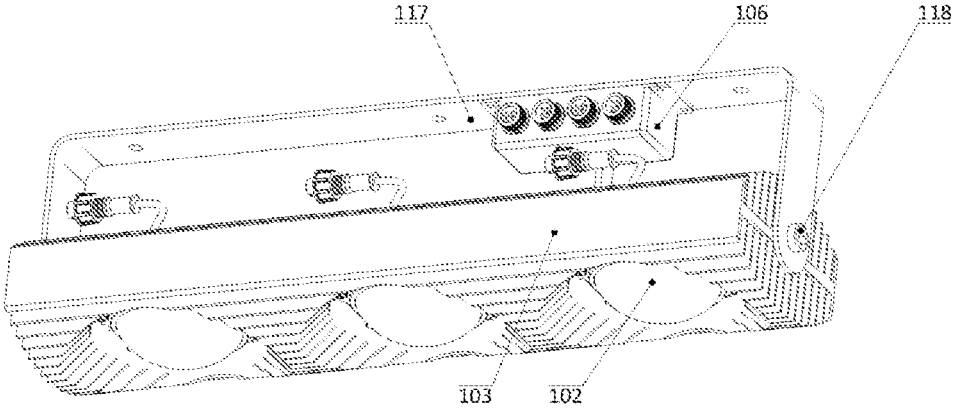
FIG. 36 is a schematic diagram of a direct fixing structure using a radiator bracket in embodiment 1-2 of the present invention.
Figure 37:
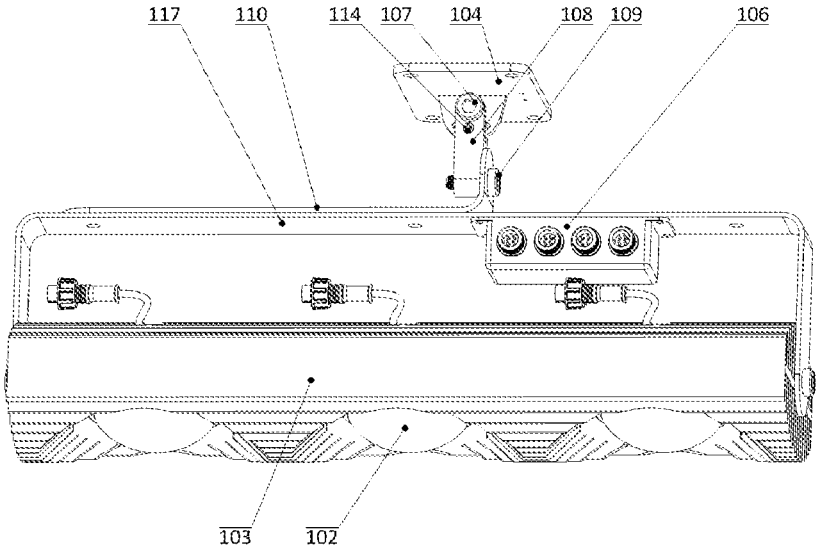
FIG. 37 is a schematic diagram of ceiling application in embodiment 1-2 of the present invention.
Figure 38:
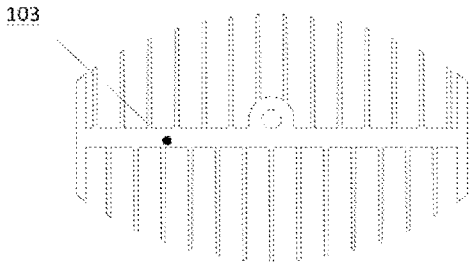
FIG. 38 is a cross-section diagram of an extrusion type radiator in embodiment 1 of the present invention.
Figure 39:
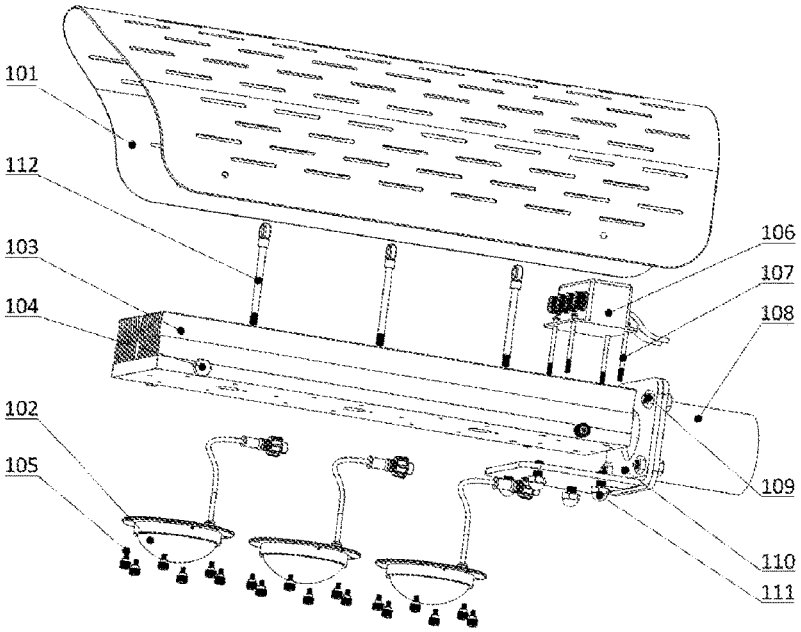
FIG. 39 is a schematic diagram of a structure of embodiment 2 in the present invention.
Figure 40:
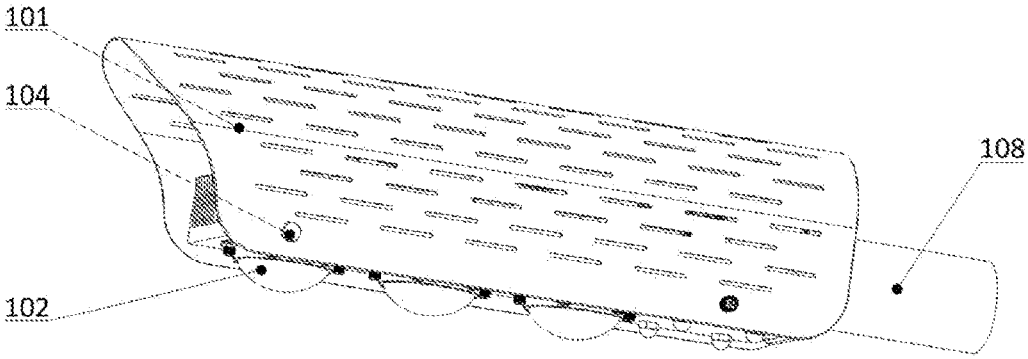
FIG. 40 is an external view of embodiment 2 of the present invention.
Figure 41:
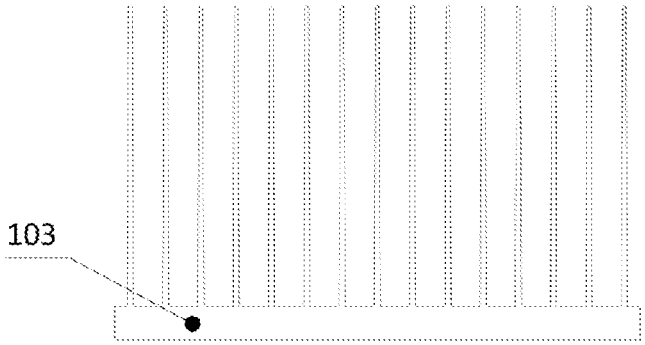
FIG. 41 is a cross-section diagram of an extrusion type radiator in the present invention.
Figure 42:
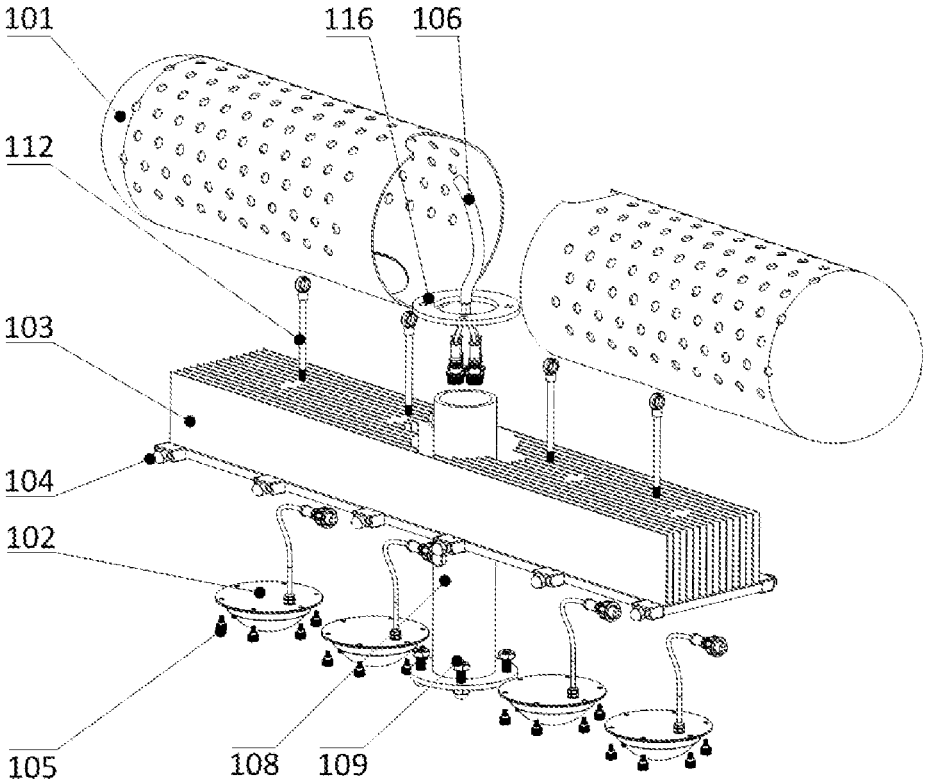
FIG. 42 is a structure diagram when a lamp post fixing ring is used in embodiment 2 of the present invention.
Figure 43:
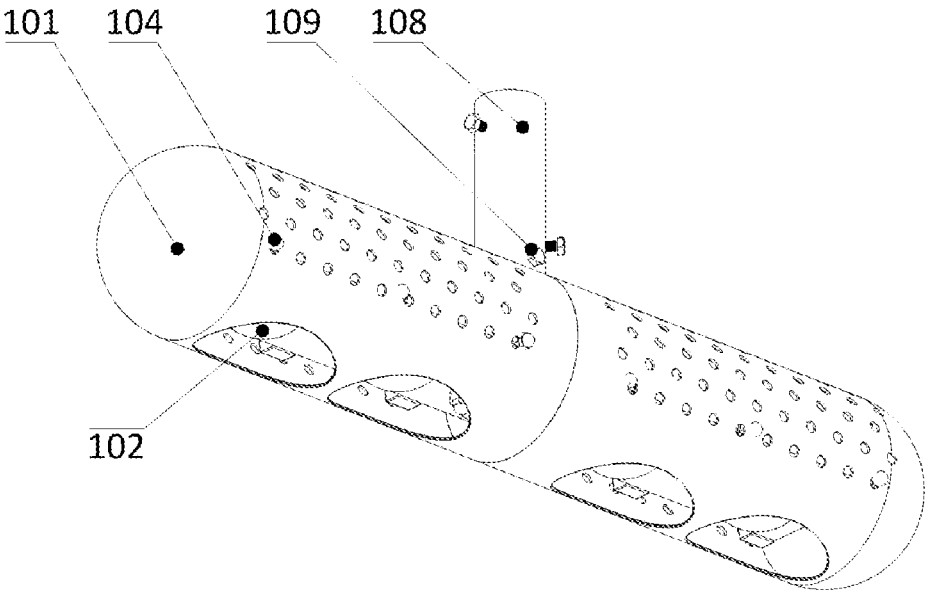
FIG. 43 is an external view when a lamp post fixing ring is used in embodiment 2 of the present invention.
Figure 44:
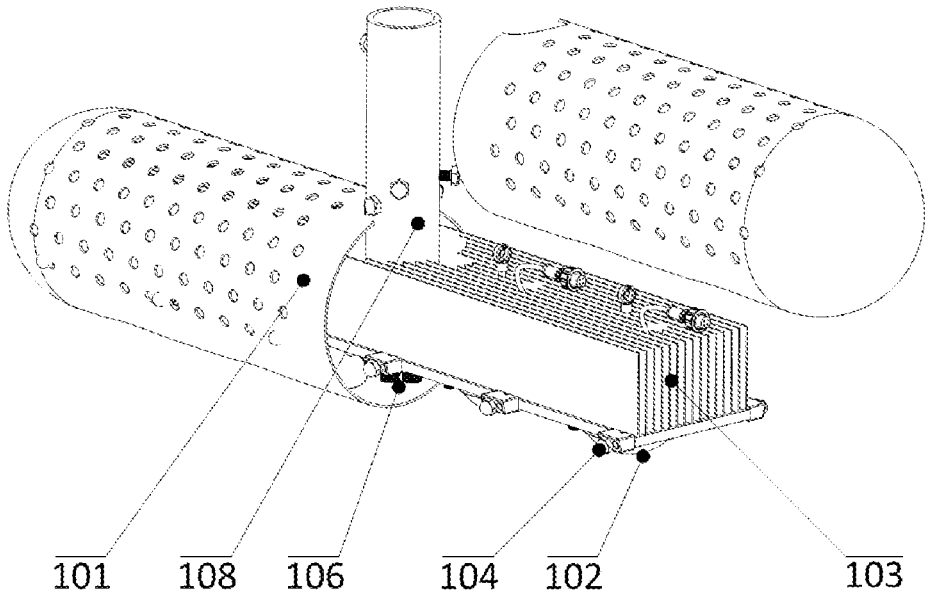
FIG. 44 is a maintenance state diagram when a lamp post fixing ring is used in embodiment 2 of the present invention.
Figure 45:
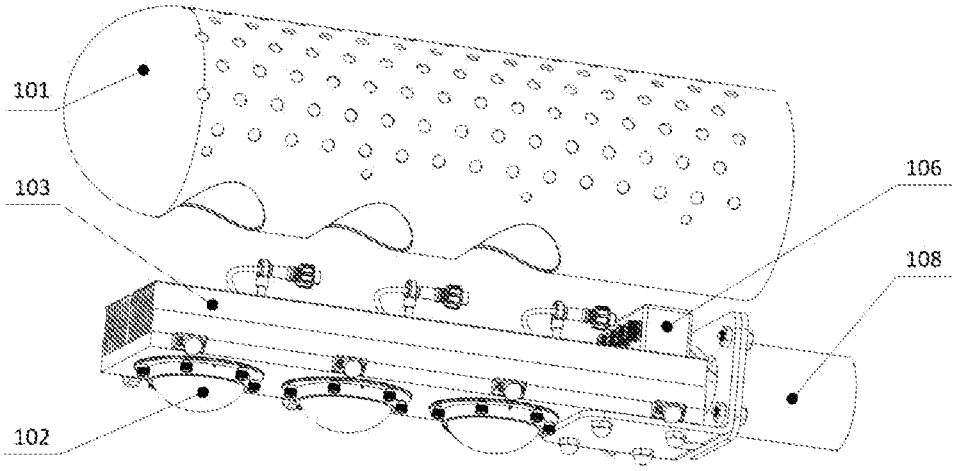
FIG. 45 is a maintenance state diagram when a barrel-shaped lamp housing is adopted in embodiment 2 of the present invention.

An LED tunnel lamp using a double-faced radiator structure, as shown in FIG. 34 and FIG. 35, includes an extrusion type double-faced radiator 103 extrusion formed by a metal, wherein an LED bulb 102 is provided to the extrusion type double-faced radiator 103, the extrusion type double-faced radiator 103 is installed on an installation support 104, and one or more installation interface used for installing the LED bulb 102 is provided to the extrusion type double-faced radiator 103. The extrusion type double-faced radiator 103 includes a substrate, and fins are provided at the two sides of the substrate; the installation interface used for installing the LED bulb 102 is provided at one side of the substrate, and circular or elliptic conical spaces are formed by cutting on the fins around the installation interface of the substrate according to the illumination angle of the light emitted by the bulb to the extent of not to shield the light emitted by the LED bulb 102, as shown in FIG. 28; the installation interface includes a surface in contact with the LED bulb 102 and a hole connected to the LED bulb, on the extrusion type double-faced radiator 103; the LED tunnel lamp using the double-faced radiator structure further includes a wire harness connector 106, and the wire harness connector 106 is used for connecting a plurality of LED bulbs 102 to a power supply and a control circuit. The extrusion type double-faced radiator 103 is installed on the installation support 104 through a reversing connecting plate 110, the reversing connecting plate 110 is fixed on a diversion bracket 108, and the diversion bracket 108 is fixed on the installation support 104, such that the angle of the extrusion type double-faced radiator 103 may be simultaneously adjusted in the horizontal direction and the vertical direction; the wire harness connector 106 is provided to the installation support 104. 6 flange fixing holes on the installation interface of the extrusion type double-faced radiator 103 are uniformly distributed at a diameter D1, and the diameter D1 is a value obtained by subtracting a diameter of a fixing screw cap and then substracting a margin of 0.8-4 mm from the outer diameter D of the LED bulb 102. The LED bulb 102 is installed on the installation interface through a bulb fixing screw 105. The turning connecting plate 110 is connected to the double-faced radiator 103 into an entirety through a radiator fixing screw 111, the turning connecting plate 110 is fixed on the diversion bracket 108 through a diversion bracket fixing screw 109, and the diversion bracket 108 is fixed on the installation support 104 through an installation support rotation fixing screw 107, as shown in FIG. 35.

In the embodiment, or the extrusion type double-faced radiator 103 may be connected to a radiator bracket 117, and the radiator bracket 117 is used for fixedly installing the double-faced radiator 103; the extrusion type double-faced radiator 103 may also be connected to the radiator bracket 117, the radiator bracket 117 is connected to the turning connecting plate 110, the turning connecting plate 110 is fixed on the diversion bracket 108, and the diversion bracket 108 is fixed on the installation support 104, and the double-faced radiator 103 is fixedly installed through the installation support 104.

When in use, the present invention may be used vertically or in an upward ceiling manner.

In the case of an accident of the tunnel lamp, the bulb may be conveniently maintained and changed just by directly detaching the bulb 102 from the extrusion type double-faced radiator 103.

Figure 2:
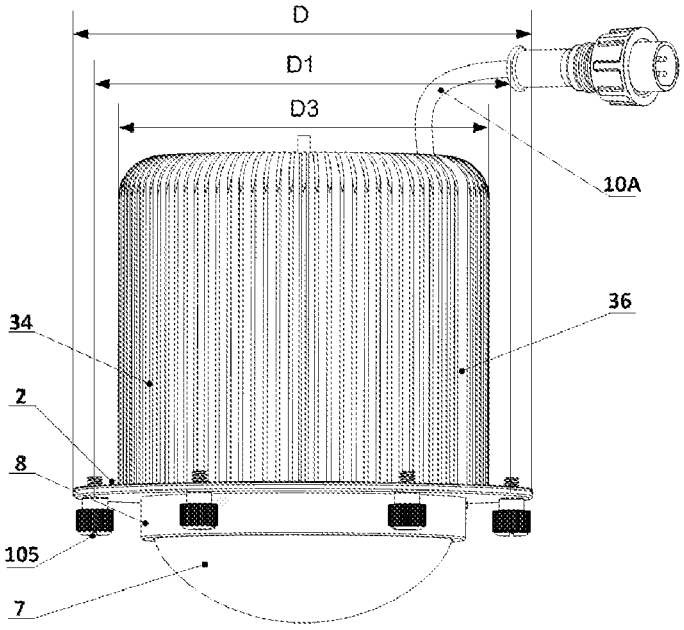
FIG. 2 is an external view of a bulb convex lens solution with a metal radiator in the present invention.

In the tunnel lamp in the present invention, an installation support turning locking groove 115 is engraved on the installation support 104, after the illumination angle of the lamp is adjusted, an installation support rotation fixing screw 107 (the screw is used for locking the lamp along the gravity direction to prevent loosening) and a diversion bracket fixing screw 109 may be screwed, meanwhile, an installation support turning locking screw 114 is screwed into the installation support turning locking groove 115 to prevent the illumination direction from changing, as shown in FIG. 2. Different from the condition that the weight of the traditional tunnel lamp itself is too large to be flexible, one property of the tunnel lamp in the present invention is that the illumination angle may be simultaneously adjusted in the horizontal and vertical directions by adjusting the diversion bracket fixing screw 109 and the installation support rotation fixing screw 107; the illumination direction may be adjusted just like a flashlight to be along the driving direction, to enable a driver to see no light source so as to effectively reduce the tunnel lighting glare problem to ensure better vehicle driving safety.

The meanings of the reference signs in the embodiment are as follows: 102—LED bulb, 103—extrusion type double-faced radiator, 104—installation support, 105—bulb fixing screw, 106—wire harness connector, 107—installation support rotation fixing screw, 108—diversion bracket, 109—diversion bracket fixing screw, 110—reversing connecting plate, 111—radiator fixing screw, 114—installation support reserving locking screw, 115—installation support turning locking groove, 117—radiator bracket, and 118—reserving fixing screw.

Embodiment 2

Figure 3:
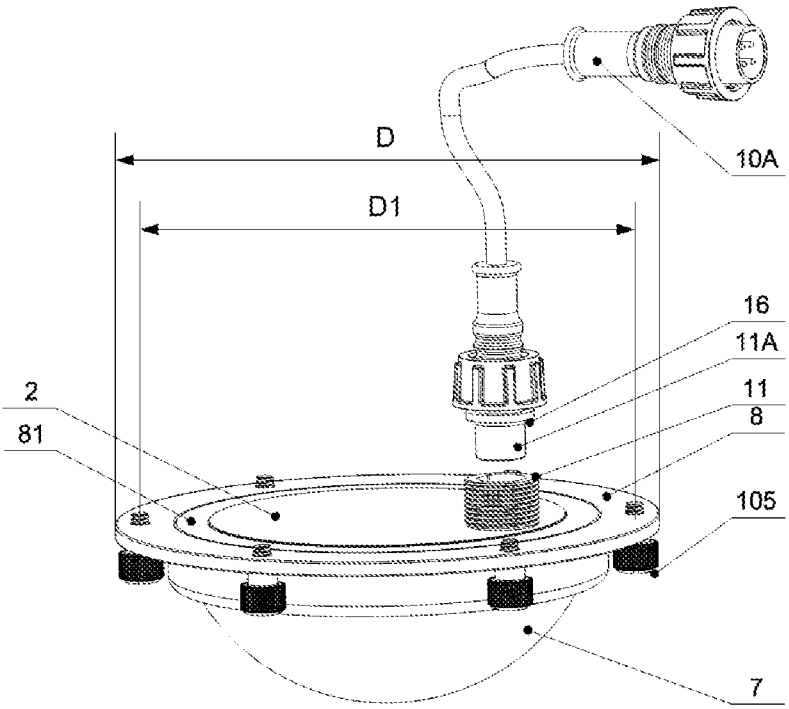
FIG. 3 is an external view of a bulb convex lens solution in the present invention.
Figure 4:
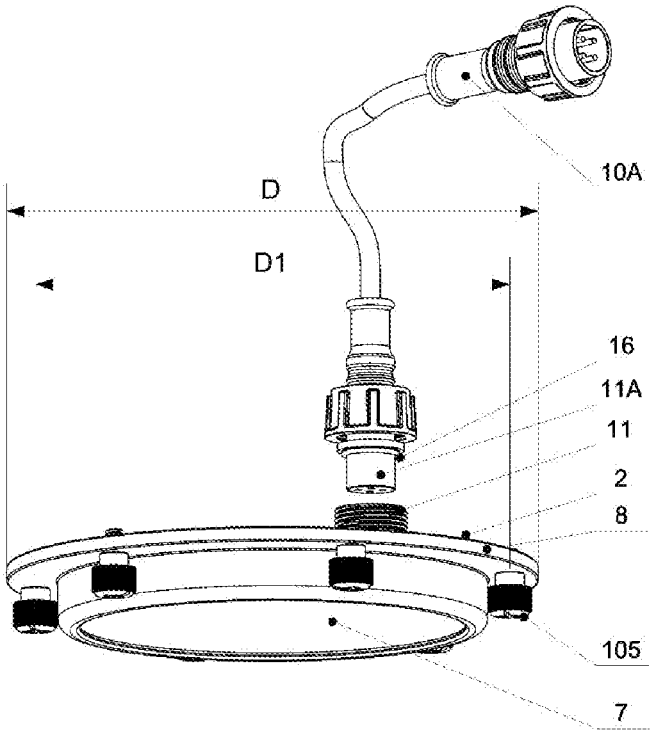
FIG. 4 is an external view of a bulb plate lens solution in the present invention.
Figure 5:
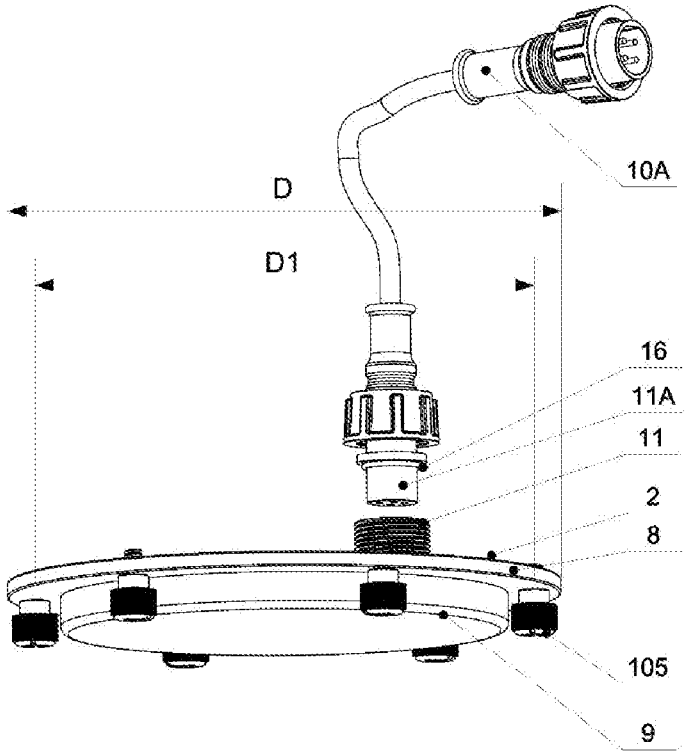
FIG. 5 is an external view of a bulb flat outer cover solution in the present invention.

An LED street lamp using an extrusion type radiator structure, as shown in FIG. 1, FIG. 2 and FIG. 3, includes an extrusion type radiator 103 extrusion formed by a metal, wherein an installation interface is provided to the extrusion type radiator 103, and an LED bulb 102 is provided to the installation interface; the extrusion type radiator 103 is installed on a lamp post 108; a lamp housing 101 punch-formed by a metal or die-cast by plastics is provided outside the extrusion type radiator 103; the LED street lamp using the extrusion type radiator structure further includes a wire harness connector 106, and the wire harness connector 106 is used for connecting a plurality of LED bulbs 102 to a power supply and a control circuit. The extrusion type radiator 103 includes a substrate, fins are provided at one side of the substrate, as shown in FIG. 4, and a cable hole is provided to the substrate; the installation interface used for installing the LED bulb 102 is provided at the other side of the substrate; a conducting wire bracket 112 is provided at the side with the fins of the substrate, and the conducting wire bracket 112 is used for connecting a conducting wire led out from the LED bulb 102 to the wire harness connector 106; the installation interface includes a surface in contact with the LED bulb 102 and a hole connected to the LED bulb, on the extrusion type radiator 103. One side of the substrate of the extrusion type radiator 103 is connected to a L-shaped connecting plate 110, and the L-shaped connecting plate 110 is connected to the lamp post 108; the wire harness connector 106 is provided to the extrusion type radiator 103. 6 flange fixing holes provided to the installation interface are uniformly distributed at a diameter D1, and the diameter D1 is a value obtained by subtracting a diameter of a fixing screw cap and then substracting a margin of 0.8-4 mm from the outer diameter D of the LED bulb 102. The LED bulb 102 is installed on the extrusion type radiator 103 through a bulb fixing screw 105, the lamp housing 101 is provided to the extrusion type radiator 103 through a lamp housing fixing screw group 104, and the wire harness connector 106 is provided to the extrusion type radiator 103 through a wire harness connector bracket and screw 107. The extrusion type radiator 103 is installed on the lamp post 108 through the L-shaped connecting plate 110, a street lamp installation fixing bolt 109 and a radiator fixing screw 111.

In the embodiment, a bracket installation hole is provided to the substrate or the center of the extrusion type radiator 103, and the extrusion type radiator 103 is installed on the lamp post 108 by means of the bracket installation hole and a lamp post fixing ring 116, the extrusion type radiator 103 is fixed on the lamp post 108 through the street lamp installation fixing bolt 109, and the wire harness connector 106 is provided in the lamp post 108. At this time, the wire harness connector and screw 107 do not need to be used.

Figure 29:
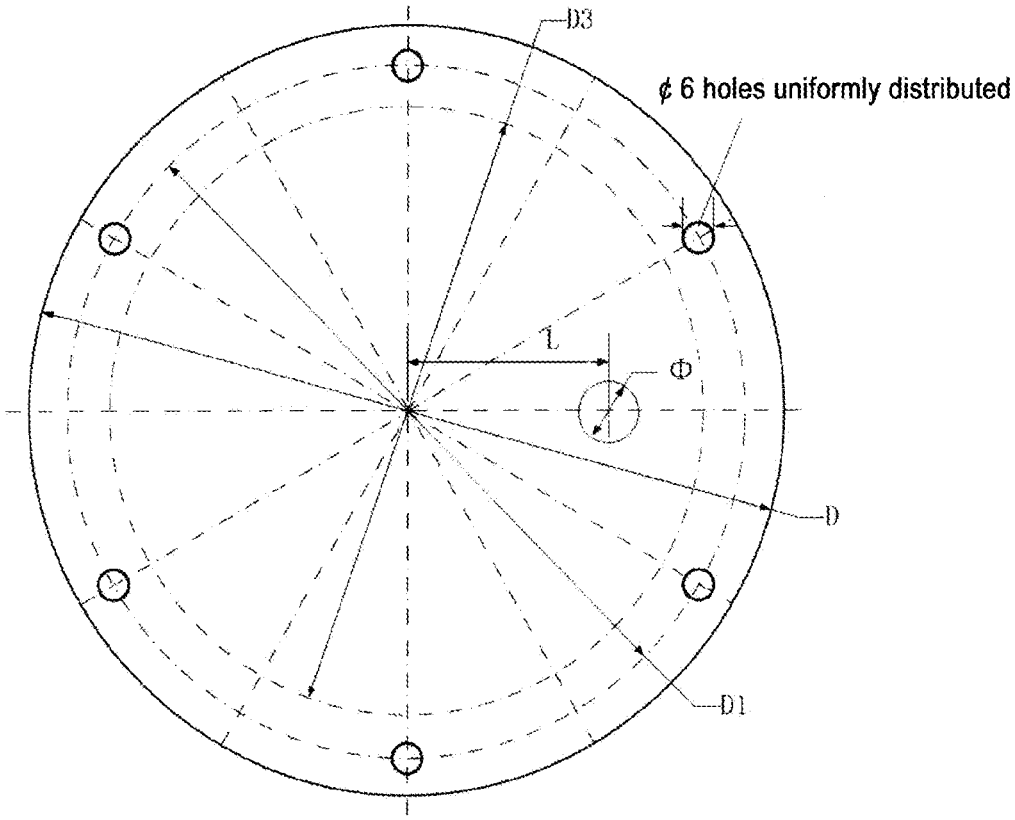
FIG. 29 is a diagram of a size and an opening of a bulb end installation interface in an embodiment of the present invention.

In the present invention, a barrel-shaped lamp housing 101 may also be adopted, as shown in FIG. 28, FIG. 29 and FIG. 30.

In the present invention, during maintenance, as shown in FIG. 1, FIG. 24 and FIG. 28, the bulb may be conveniently detached and installed just by detaching the lamp housing 101, so that the bulb is very convenient to maintain and change.

The meanings of the reference signs in the embodiment are as follows: 101—lamp housing, 102—LED bulb, 103—extrusion type radiator, 104—lamp housing fixing screw group, 105—bulb fixing screw, 106—wire harness connector, 107—wire harness connector bracket and screw, 108—lamp post, 109—street lamp installation fixing bolt, 110—L-shaped connecting plate, 111—radiator fixing screw, 112—conducting wire bracket, 116—lamp post fixing ring, 301—bulb installation flange fixing hole, 302—bracket lining rivet hole, 501—bracket lining rivet projection, and 502—power supply or control end welding spot hole.

Embodiment 3

Figure 46:
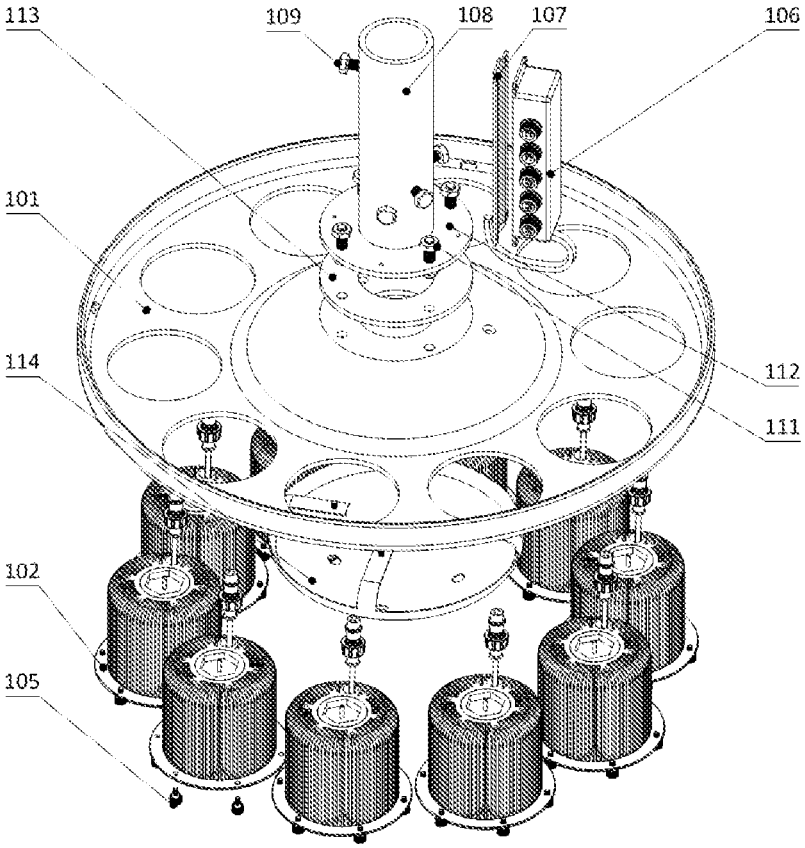
FIG. 46 is a schematic diagram of a structure of embodiment 3 of the present invention.
Figure 47:
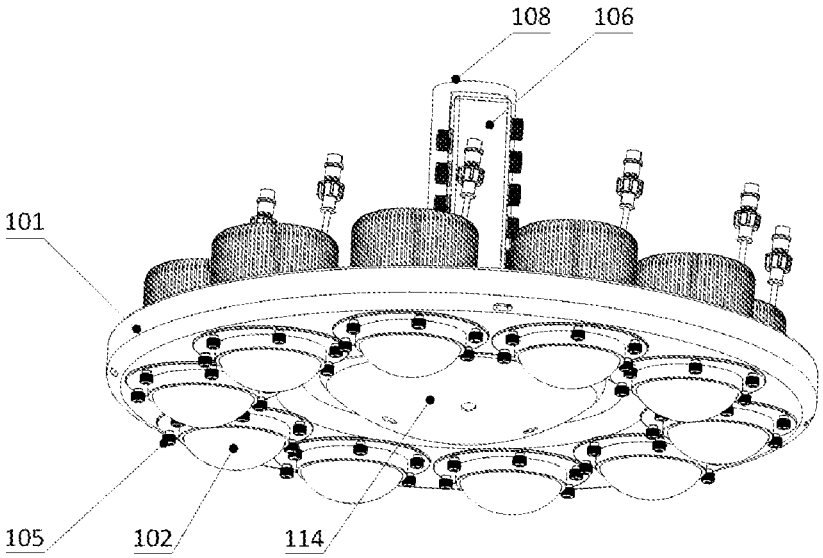
FIG. 47 is a vertical external view of embodiment 3 in the present invention.
Figure 48:
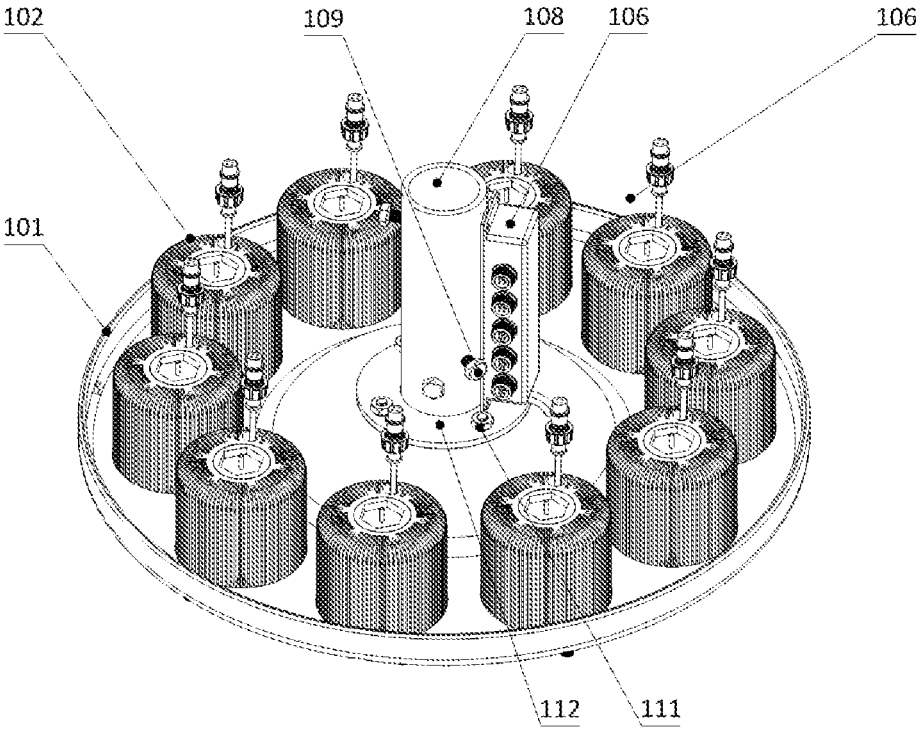
FIG. 48 is an overlooking external view of embodiment 3 in the present invention.

An LED projection lamp using a lamp housing as an installation interface bracket structure, as shown in FIG. 46, FIG. 47 and FIG. 48, includes the lamp housing 101 punch-formed by sheet metal by a stamping process, wherein an installation interface is provided to the lamp housing 101, an LED bulb 102 provided with a radiator is provided to the installation interface, the middle part of the lamp housing 101 is connected to a lamp post fixing sleeve 108 through a lamp post fixing member, and a decorative cover 114 is provided to the lamp housing 101. The lamp housing 101 is circular, a group of circular ring-shaped installation interfaces is provided at the surrounding of the lamp post fixing sleeve 108 at the top of the center of the lamp housing 101, and an edgefold for reinforcing the structural strength is provided at the edge of the lamp housing 101; the decorative cover 114 is provided at the center of the bottom of the lamp housing 101; the installation interface includes a surface in contact with the LED bulb 102 and a hole connected to the LED bulb on the lamp housing 101; a wire harness connector 106 is provided to the lamp post fixing sleeve 108, and the wire harness connector 106 is used for connecting a plurality of LED bulbs 102 to a power supply and a control circuit. The lamp post fixing member includes a fixing sleeve flange 112, a lamp post fixing sleeve bolt 111 and a reinforcing plate 113; the lamp post fixing sleeve 108 is fixedly connected to the lamp housing 101 through the fixing sleeve flange 112, lamp post fixing sleeve bolt 111 and the reinforcing plate 113. 6 flange fixing holes and a radiator interface opening are provided to the installation interface, the flange fixing holes are used for fixing the LED bulb 102, and the radiator interface opening is used for enabling the radiator of the LED bulb 102 to penetrate through the bulb installation interface; the flange fixing holes are uniformly distributed at a diameter D1, and the diameter D1 is a value obtained by subtracting a diameter of a fixing screw cap and then substracting a margin of 0.8-4 mm from the outer diameter D of the LED bulb 102; the diameter D2 of the radiator interface opening on the installation interface is a value obtained by subtracting two times of a diameter of a fixing screw cap and then subtracting two times of the margin corresponding to the diameter D1 from the outer diameter D of the bulb. The wire harness connector 106 is fixed on the lamp post fixing sleeve 108 through a wire harness connector bracket and screw 107, the lamp post fixing sleeve 108 is fixed on the lamp housing 101 through the fixing sleeve flange 112, the reinforcing plate 110 and a fixing sleeve flange bolt 111, an external lamp post is connected to the lamp post fixing sleeve 108 through a lamp post fixing screw 109, and the LED bulb 102 is installed on an installation interface hole through a bulb fixing screw 105.

The meanings of the accompanying drawing reference signs in the embodiment are as follows: 101—lamp housing, 102—LED bulb, 103—radiator, 105—bulb fixing screw, 106—wire harness connector, 107—wire harness connector bracket and screw, 108—lamp post fixing sleeve, 109—lamp post fixing screw, 111—lamp post fixing sleeve bolt, 112—fixing sleeve flange, 113—reinforcing plate, and 114—decorative cover.

Embodiment 4

Figure 49:
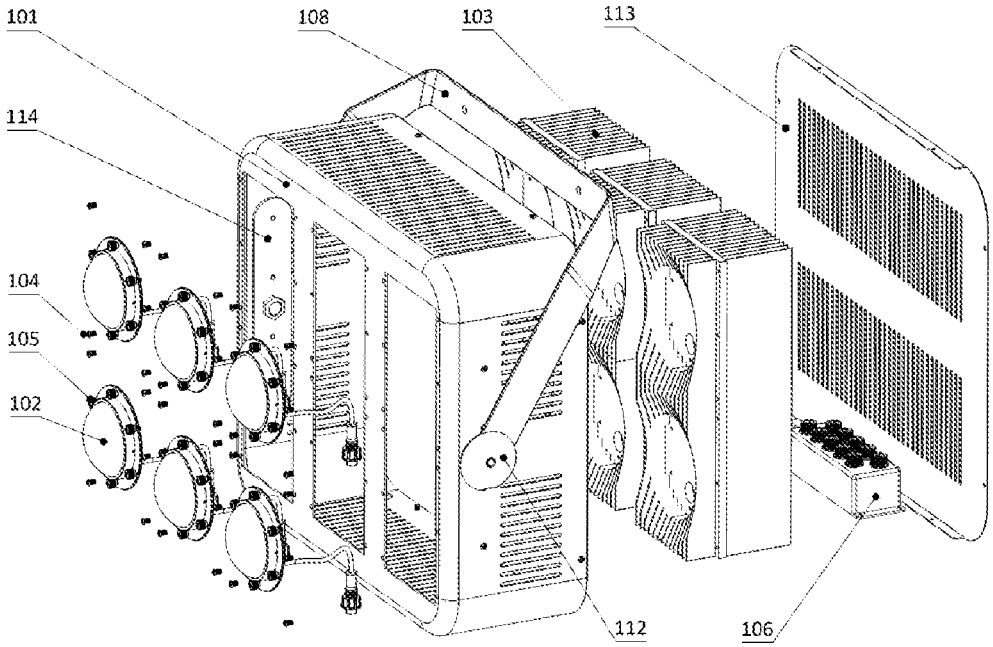
FIG. 49 is a schematic diagram of a structure of embodiment 4 of the present invention.
Figure 50:
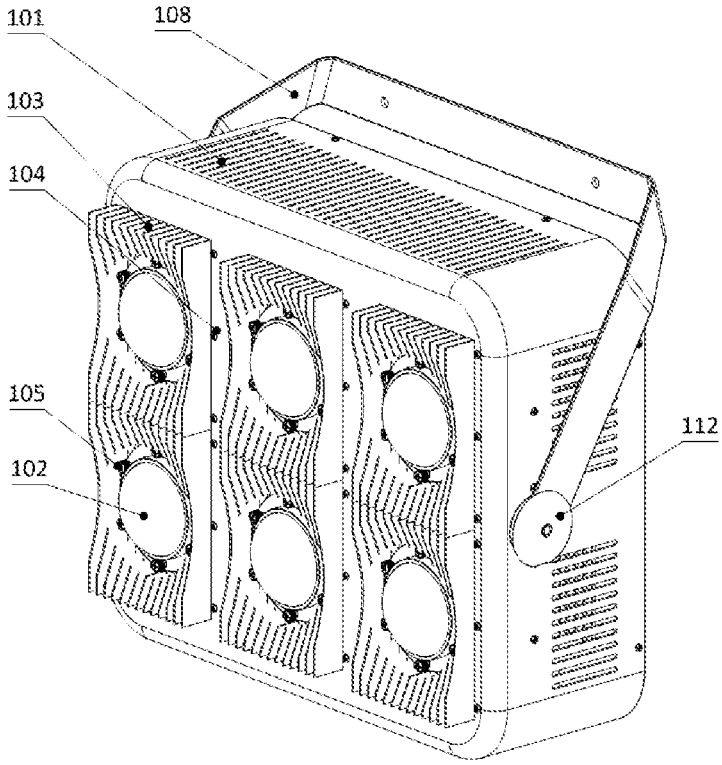
FIG. 50 is a use state diagram of embodiment 4 in the present invention.
Figure 51:
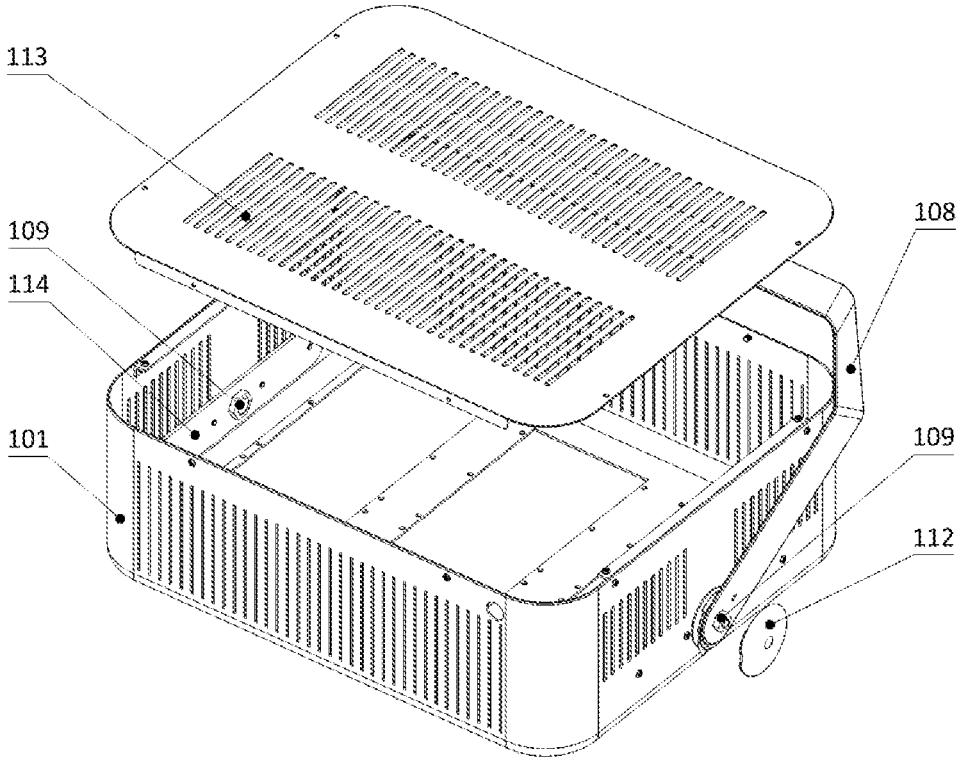
FIG. 51 is an assembly diagram of a lamp housing bracket in embodiment 4 of the present invention.
Figure 52:
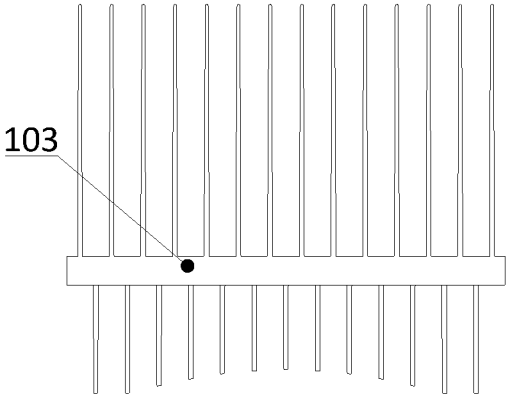
FIG. 52 is a cross-section diagram of an extrusion type double-faced radiator in embodiment 4 of the present invention.

An LED projection lamp using a lamp housing as an installation interface bracket structure, as shown in FIG. 49, FIG. 50 and FIG. 51, includes a lamp housing bracket 101 and an LED bulb 102, wherein the lamp housing bracket 101 is a rectangular box with an open surface, an extrusion type double-faced radiator 103 is provided in the lamp housing bracket 101, an opening used for installing the extrusion type double-faced radiator 103 is provided to the surface opposite to the opening of the lamp housing bracket 101, vent holes are provided to surfaces other than the open surface and the surface provided with the opening of the lamp housing bracket 101, and the lamp housing bracket 101 is installed and fixed through fixing assemblies provided at the two sides; an installation interface used for installing the LED bulb 102 is provided to the extrusion type double-faced radiator 103. Each fixing assembly includes a lamp fixing bracket 108 and a reinforcing plate 114, the reinforcing plate 114 is fixedly provided in the lamp housing bracket 101, and the lamp fixing bracket 108 is connected to the reinforcing plate 114 outside the lamp housing bracket 101 for fixing the entire lamp housing bracket 101; the LED projection lamp using the extrusion type radiator further includes a wire harness connector 106, and the wire harness connector 106 is used for connecting a plurality of LED bulbs 102 to a power supply and a control circuit. The LED projection lamp using the extrusion type double-faced radiator further includes an angle adjusting assembly 112 and a lamp housing rear cover 113, the angle adjusting assembly 112 is provided at the joint of the lamp fixing bracket 108 and the reinforcing plate 114, the lamp housing rear cover 113 is provided at the opening of the lamp housing bracket 101, and a vent hole is provided to the lamp housing rear cover 113. The extrusion type double-faced radiator 103 includes a substrate, and fins are provided at the two sides of the substrate, as shown in FIG. 52; the installation interface used for installing the LED bulb 102 is provided at one side of the substrate, and circular or elliptic conical spaces are formed by cutting on the fins around the installation interface of the substrate according to the illumination angle of the light emitted by the bulb to the extent of not to shield the light emitted by the LED bulb 102; the installation interface includes a surface in contact with the LED bulb 102 and a hole connected to the LED bulb, on the extrusion type double-faced radiator 103. 6 flange fixing holes on the installation interface of the extrusion type double-faced radiator 103 are uniformly distributed at a diameter D1, and the diameter D1 is a value obtained by subtracting a diameter of a fixing screw cap and then substracting a margin of 0.8-4 mm from the outer diameter D of the LED bulb 102. The extrusion type double-faced radiator 103 is installed in the lamp housing bracket 101 through a radiator fixing screw 104. The LED bulb 102 is fixed on the installation interface of the extrusion type double-faced radiator 103 through a bulb fixing screw 105, and the lamp fixing bracket 108 is fixed on the lamp housing bracket 101 through the reinforcing plate 114 and a fixing bolt 109.

Figure 53:
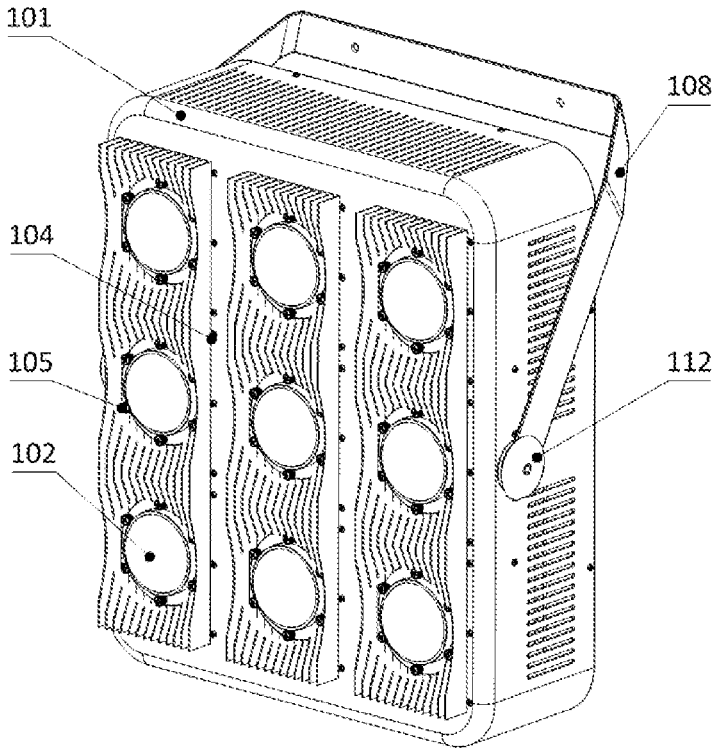
FIG. 53 is a use state diagram when densely provided LED bulbs are adopted in embodiment 4 of the present invention.
Figure 54:
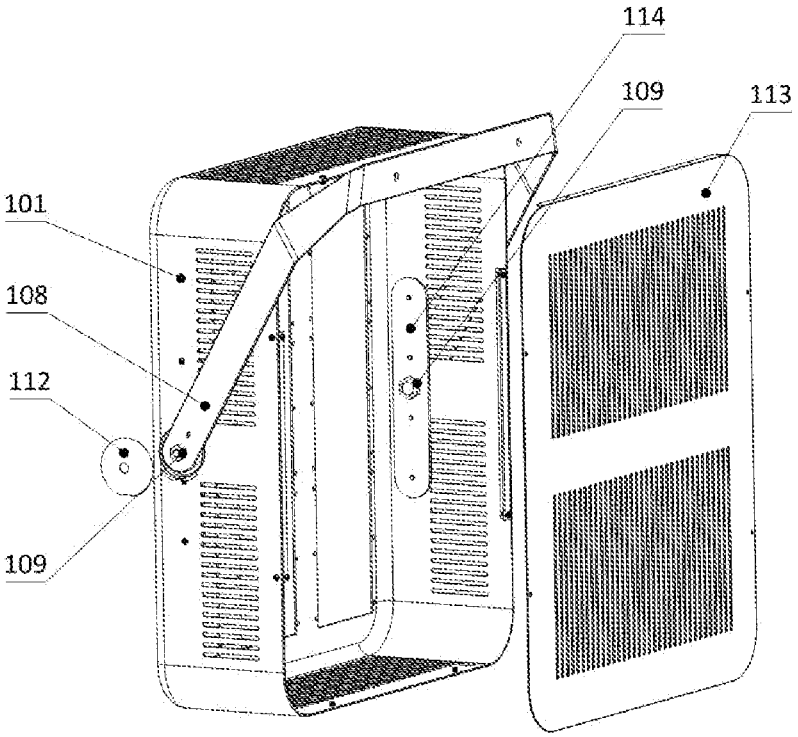
FIG. 54 is an assembly diagram of a lamp housing bracket when densely provided LED bulbs are adopted in embodiment 4 of the present invention.
Figure 55:
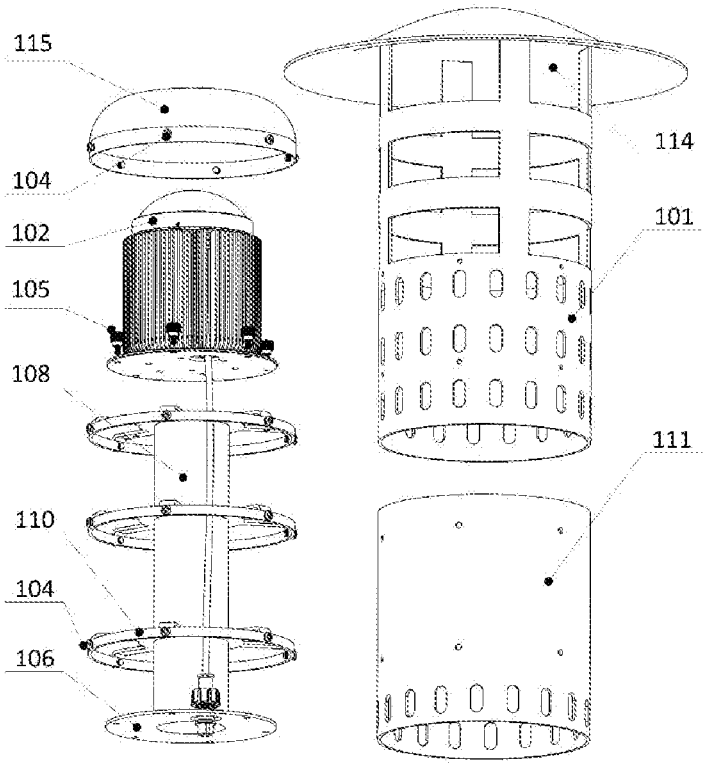
Figure 56:
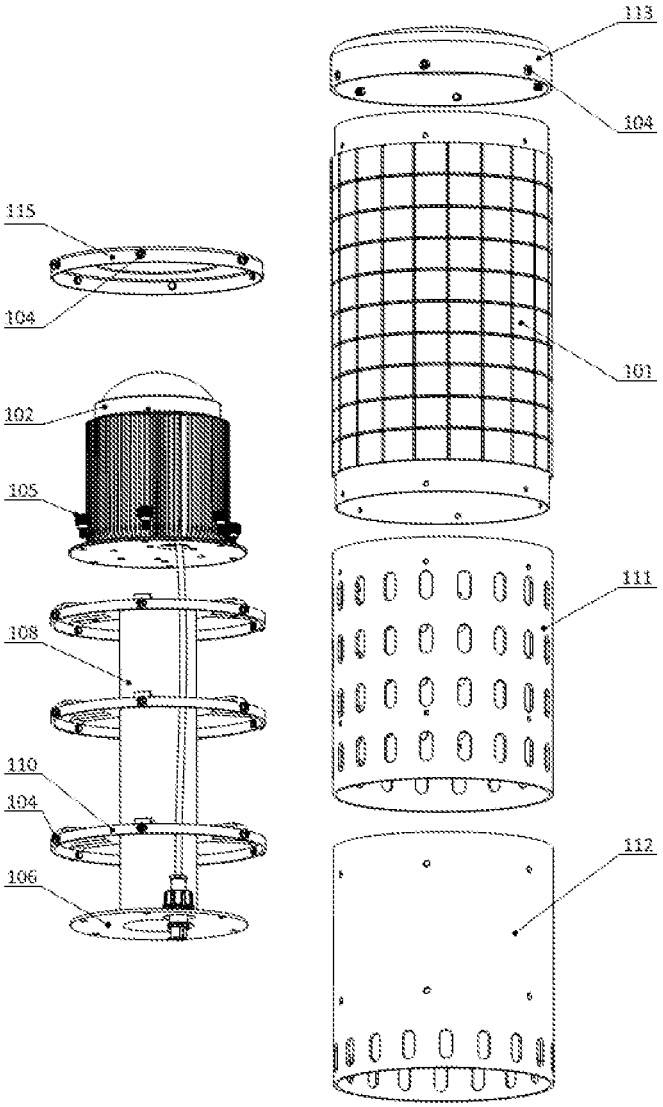
FIG. 56 is a schematic diagram of a structure when a lampshade, a ventilating cover, an elongation cover, a light emitting cover gland and a shielding cover are adopted in embodiment 5 of the present invention.
Figure 57:
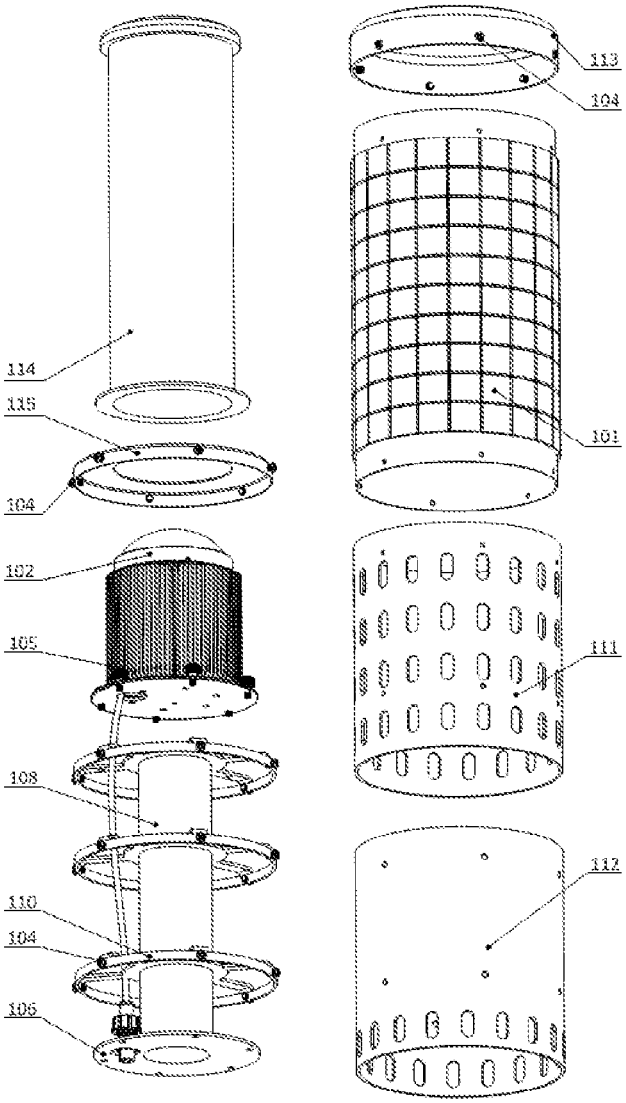
FIG. 57 is a schematic diagram of a structure when a lampshade, a ventilating cover, an elongation cover, a light emitting cover gland, a light emitting cover and a shielding cover are adopted in embodiment 5 of the present invention.
Figure 58:
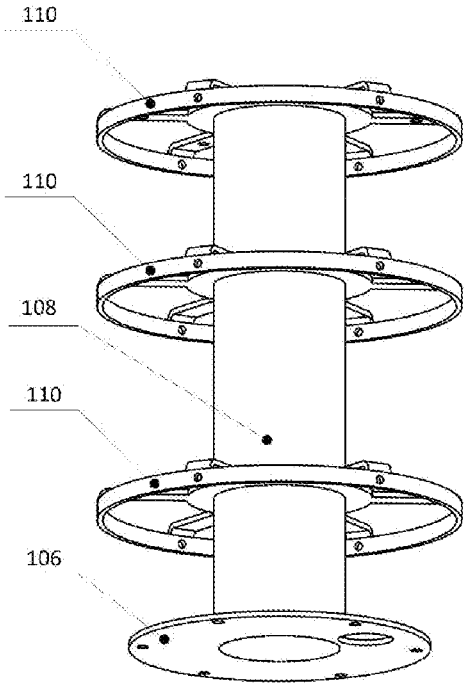
FIG. 58 is an external view of embodiment 5 of the present invention.
Figure 59:
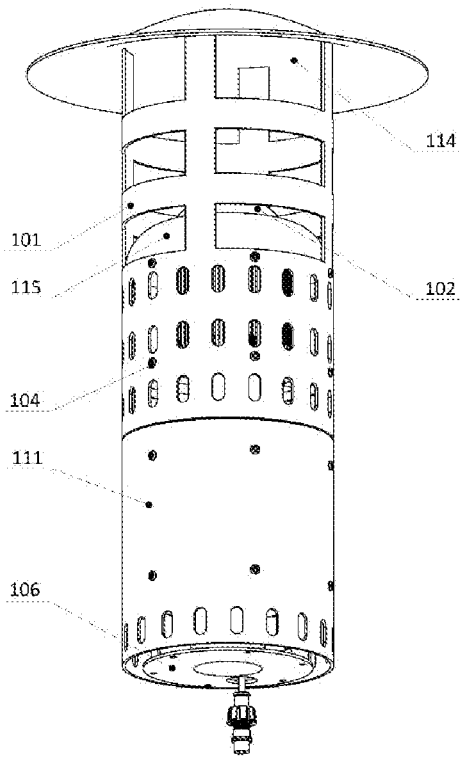
FIG. 59 is an external view when a lampshade, a ventilating cover, an elongation cover, a light emitting cover gland and a shielding cover are adopted in embodiment 5 of the present invention.
Figure 60:
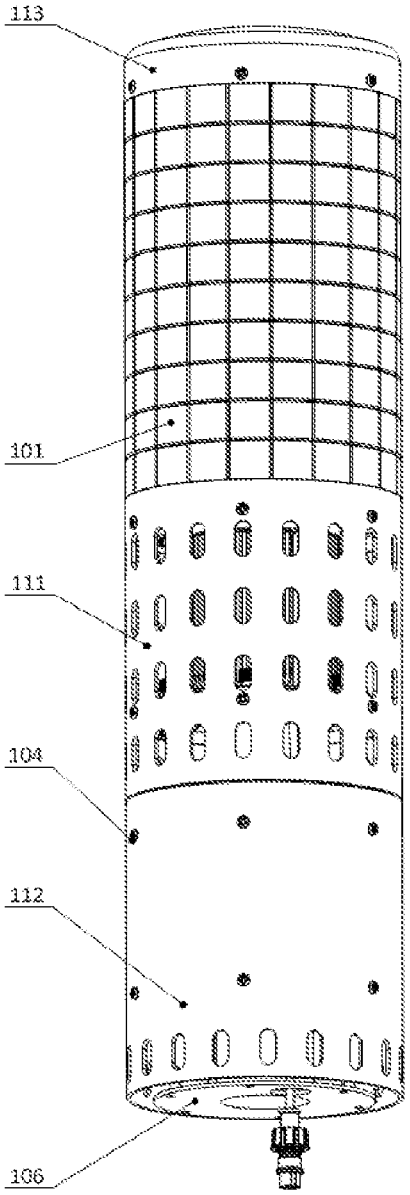
FIG. 60 is an installation view of a shielding cover when a lampshade, a ventilating cover, an elongation cover, a light emitting cover gland and the shielding cover are adopted in embodiment 5 of the present invention.
Figure 61:
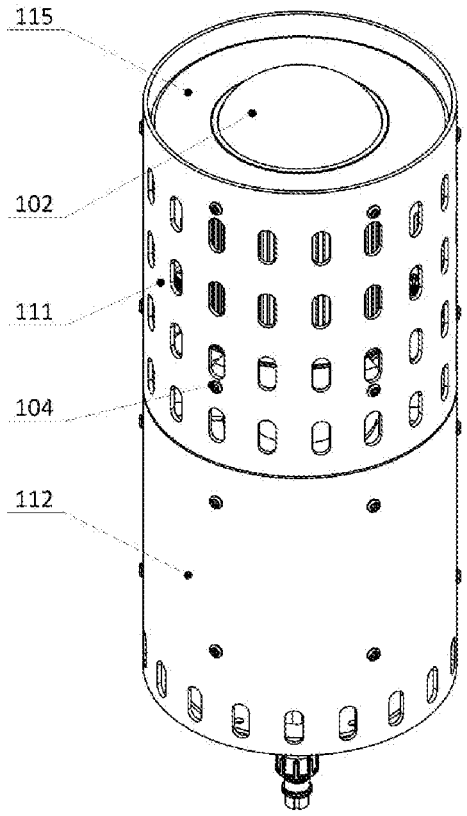
FIG. 61 is an external view when a lampshade, a ventilating cover, an elongation cover, a light emitting cover gland, a light emitting cover and a shielding cover are adopted in embodiment 5 of the present invention.
Figure 62:
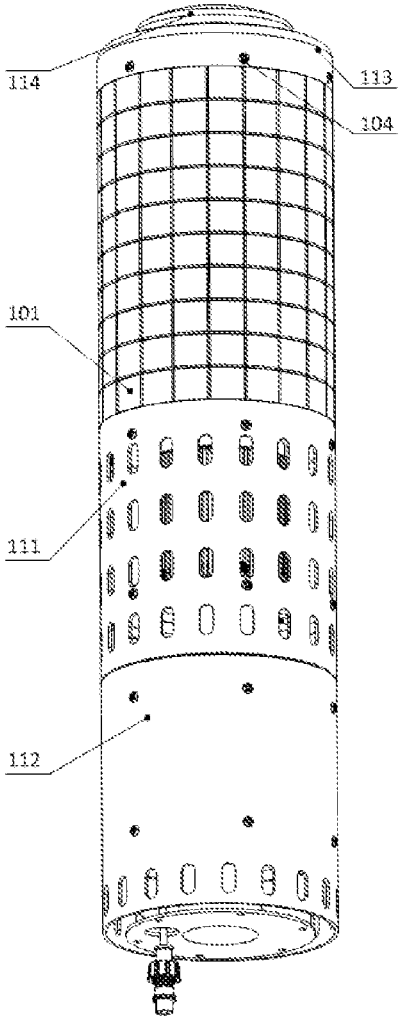
FIG. 62 is an assembly structure diagram with a hidden lampshade when the lampshade, a ventilating cover, an elongation cover, a light emitting cover gland, a light emitting cover and a shielding cover are adopted in embodiment 5 of the present invention.
Figure 63:
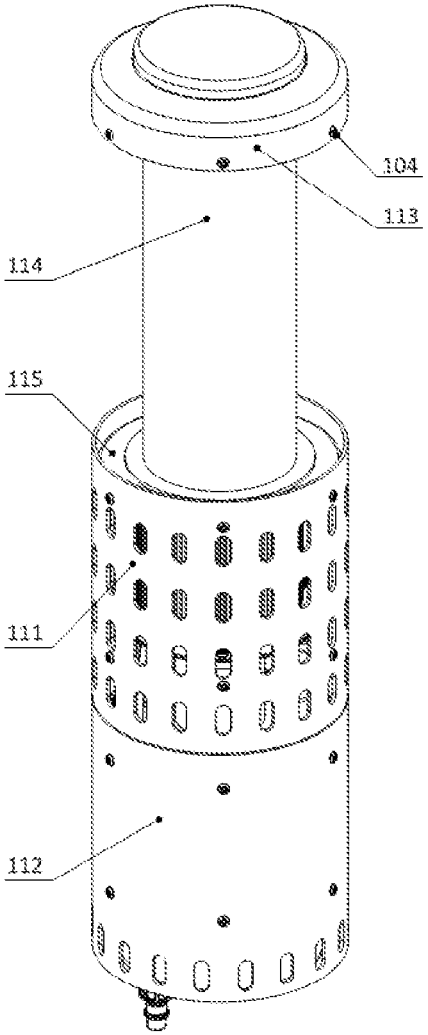

In the embodiment, densely provided LED bulbs may also be adopted, as shown in FIG. 53 and FIG. 54.

In the present invention, in the case of an accident, as shown in FIG. 49, the bulb may be conveniently maintained and changed just by detaching the LED bulb 102 from the extrusion type double-faced radiator 103.

The meanings of the reference signs in the embodiment are as follows: 101—lamp housing bracket, 102—LED bulb, 103—extrusion type double-faced radiator, 104—radiator fixing screw, 105—bulb fixing screw, 106—wire harness connector, 108—lamp fixing bracket, 109—fixing screw, 112—angle adjusting assembly, 113—lamp housing rear cover, and 114—reinforcing plate.

Embodiment 5

An LED lawn lamp using an installation interface bracket combined member, as shown in FIG. 1. FIG. 25 and FIG. 26, includes the installation interface bracket combined member, wherein an LED bulb 102 with waterproof and dust-proof functions and provided with a radiator is provided to the installation interface bracket combined member; a lampshade assembly punch-formed by a metal or die-cast by plastics is provided outside the installation interface bracket combined member; the installation interface bracket combined member includes a pipe bracket 108 which is formed by segmenting a standard pipe, a lamp fixing flange 106 and a lampshade and bulb fixing bracket 110, the pipe bracket 108, the lamp fixing flange 106 and the lampshade and bulb fixing bracket 110 are connected, an installation interface used for installing the LED bulb 102 is provided to the lampshade and bulb fixing bracket 110, and the pipe bracket 108 is connected to the lamp fixing flange 106 and the lampshade and bulb fixing bracket 110; the lampshade assembly is connected to the installation interface bracket combined member through the lampshade and bulb fixing bracket 110. The installation interface includes a surface in contact with the LED bulb 102 and a hole connected to the LED bulb, on the lampshade and bulb fixing bracket 110; the LED bulb 102 is installed on the lampshade and bulb fixing bracket 110 through a bulb fixing screw 105; the lampshade and bulb fixing bracket 110 is punch-formed by a metal, a central portion of the lampshade and bulb fixing bracket 110 is connected to the pipe bracket 108, the lampshade and bulb fixing bracket 110 is hollowed around its portion connected to the pipe bracket 108, so that passage of a cable and formation of a chimney effect in the lampshade are facilitated to ensure the ventilating and radiating effects; a screw hole used for installing the lampshade assembly is provided at the edge of the lampshade and bulb fixing bracket 110, and the lampshade assembly is provided to the lampshade and bulb fixing bracket 110 through a lampshade fixing screw 104. The lampshade assembly includes a lampshade 101, a ventilating cover 111, a light emitting cover 114 and a shielding cover 115, which are cooperatively used, the lampshade 101 is covered outside the lampshade or bulb fixing bracket 110, the ventilating cover 111 is covered outside the pipe bracket 108, the shielding cover 115 is installed at the upper part of the LED bulb 102 and between the lampshade 101 and the ventilating cover 111, in order to prevent light from emitting into the ventilating cover 111 and decrease mosquitoes entering the ventilating cover 111, and the light emitting cover 114 is provided at the top of the lampshade 101.

In the embodiment, the lampshade assembly may further include a lampshade 101, a ventilating cover 111, an elongation cover 112, a light emitting cover gland 113 and a shielding cover 115, which are cooperatively used, the lampshade 101 is covered outside the lampshade or bulb fixing bracket 110, the ventilating cover 111 is covered outside the pipe bracket 108, the shielding cover 115 is installed at the upper part of the LED bulb 102 and between the lampshade 101 and the ventilating cover 111, in order to prevent light from emitting into the ventilating cover 111 and prevent mosquitoes from entering the airtight lampshade 101, the elongation cover 112 is provided at the bottom of the ventilating cover 111, and the light emitting cover gland 113 is provided at the top of the lampshade 101, as shown in FIG. 2, FIG. 27 and FIG. 28.

Or, the lampshade assembly may further include a lampshade 101, a ventilating cover 111, an elongation cover 112, a light emitting cover gland 113, a light emitting cover 114 and a shielding cover 115, which are cooperatively used, the lampshade 101 is covered outside the lampshade or bulb fixing bracket 110, the ventilating cover 111 is covered outside the pipe bracket 108, the elongation cover 112 is provided at the bottom of the ventilating cover 111, the shielding cover 115 is installed at the upper part of the LED bulb 102 and between the lampshade 101 and the ventilating cover 111, in order to prevent light from emitting into the ventilating cover 111 and prevent mosquitoes from entering the airtight lampshade 101, the light emitting cover 114 is provided in the lampshade 101 and at the top of the shielding cover 115, for locking the LED bulb 102, and the top of the light emitting cover is fixed by the light emitting cover gland 113 provided at the top of the lampshade 101, as shown in FIG. 24, FIG. 29 and FIG. 30.

When in use, different lampshade assemblies are selected according to different demands.

When the present invention is in use, according to different demands, different lamp fixing flanges 3 are selected to adapt to different installation occasions. When being installed on the pipe truss structure, it is as shown in FIG. 27. In order to better prevent dust, when the present invention is in use, a bulb installation flange fixing hole 301 on the heat conductive bracket 3 may be omitted, and the outer diameter thereof is reduced to be equal to the outer diameter of the lens snap ring 8, as shown in FIG. 23.

The meanings of the reference signs in the embodiment are as follows: 101—lampshade, 102—LED bulb, 103—radiator, 104—radiator fixing screw, 105—bulb fixing screw, 106—lamp fixing flange, 108—pipe bracket, 110—lampshade or bulb fixing bracket, 111—ventialting cover, 112—elongation cover, 113—light emitting cover gland, 114—light emitting cover, 115—shielding cover, 301—bulb installation flange fixing hole, 302—bracket lining rivet hole, 501—bracket lining rivet projection, and 502—power supply or control end welding spot hole.

Embodiment 6

Figure 64:
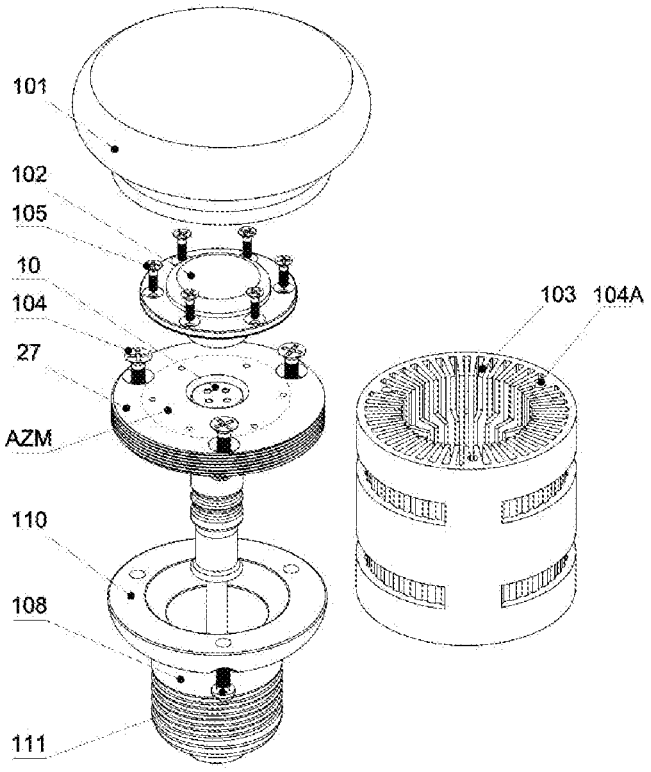
FIG. 64 is a schematic diagram of a structure of an LED screw lamp using a columnar radiator in embodiment 6 of the present invention.
Figure 65:
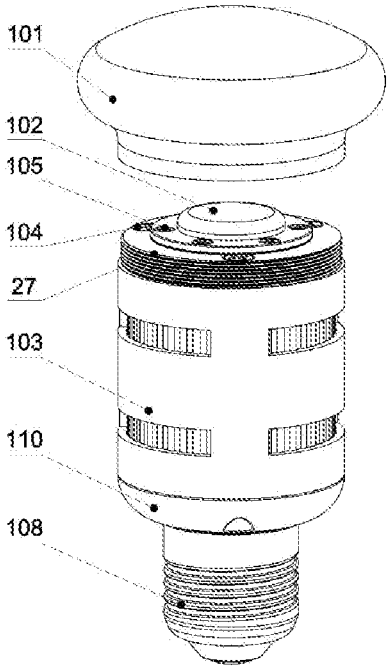
FIG. 65 is a schematic diagram of an outline structure of an LED screw lamp using a columnar radiator in embodiment 6 of the present invention.
Figure 66:
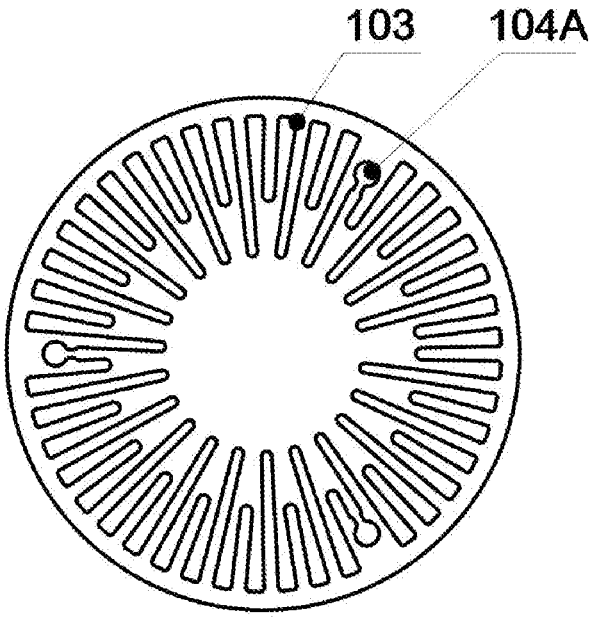
FIG. 66 is a schematic diagram of a sectional structure of a columnar radiator in embodiment 6 of the present invention.
Figure 67:
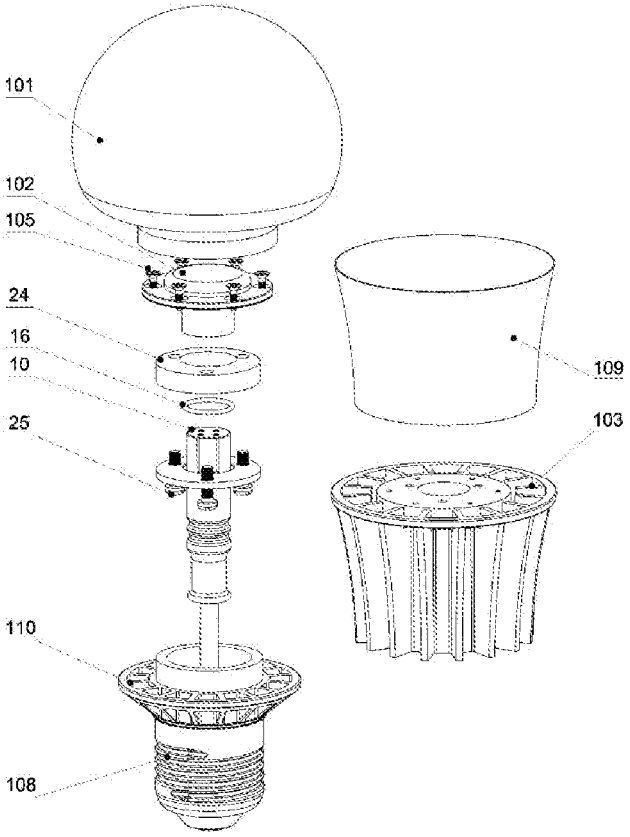
FIG. 67 is a schematic diagram of a structure of an LED screw lamp using a convection radiator in embodiment 6 of the present invention.
Figure 68:
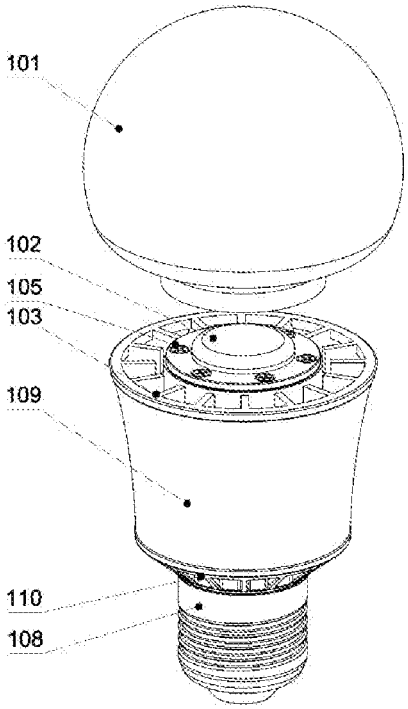
FIG. 68 is a schematic diagram of an outline of an LED screw lamp using the convection radiator in embodiment 6 of the present invention.
Figure 69:
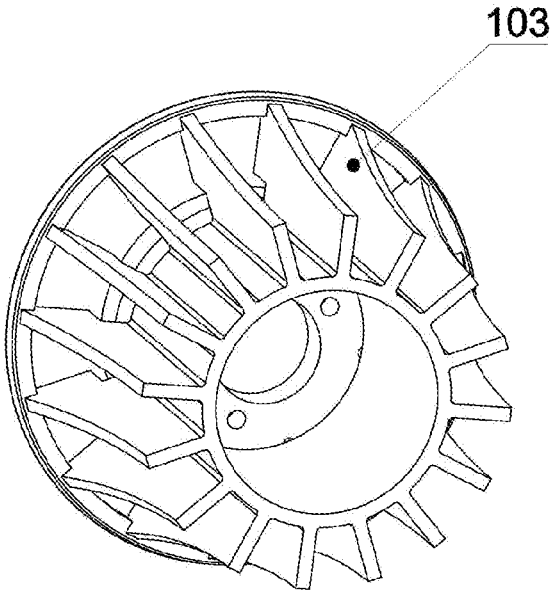
FIG. 69 is a schematic diagram of a structure of the convection radiator in embodiment 6 of the present invention.
Figure 70:
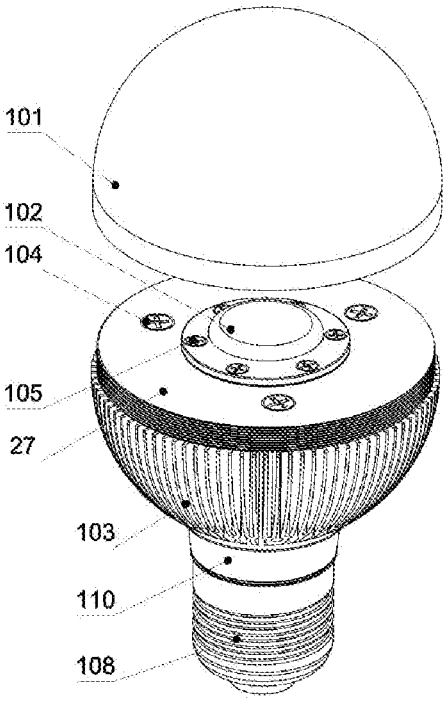
FIG. 70 is a first schematic diagram of an outline of an LED screw lamp using other radiators in embodiment 6 of the present invention.
Figure 71:
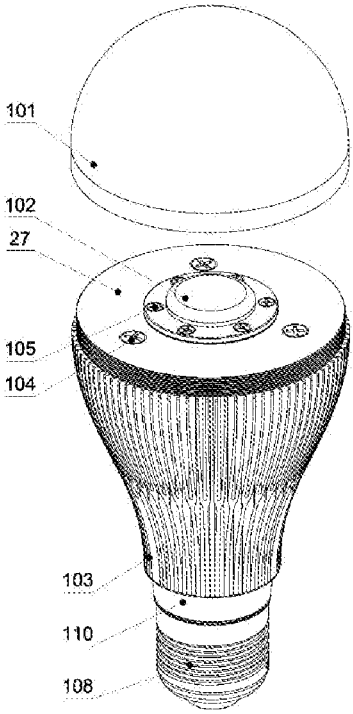
FIG. 71 is a second schematic diagram of an outline of an LED screw lamp using other radiator in embodiment 6 of the present invention.
Figure 72:
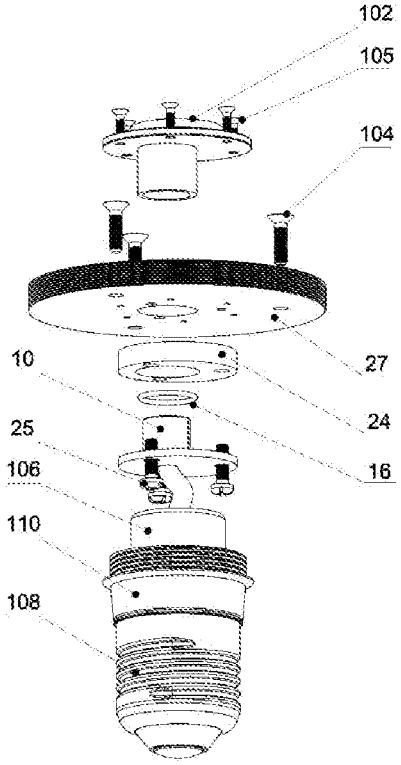
FIG. 72 is a schematic diagram of a structure of an LED screw lamp driven by a conventional power supply in embodiment 6 of the present invention.
Figure 73:
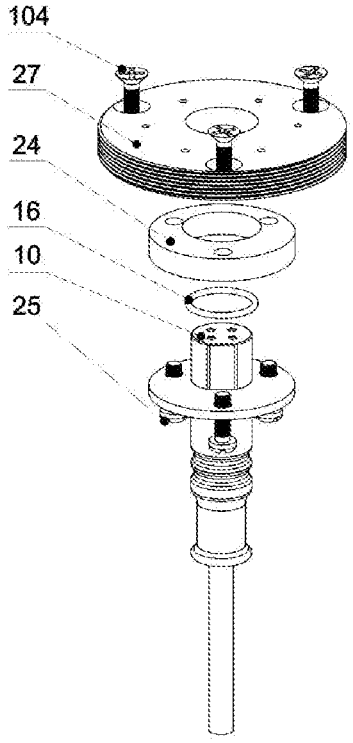
FIG. 73 is a schematic diagram of an installation structure of a connector socket in embodiment 6 of the present invention.

An LED screw lamp, as shown in FIG. 64, includes a screw lamp cap 108, a radiator 103, an LED bulb 102 and a lampshade 101; an intermediate connecting element 110 on the screw lamp cap 108 is connected to the radiator 103 through threads thereon, or through a lamp cap fixing screw 111 or in a direct adhesion manner; the LED bulb 102 is fixedly installed via a bulb fixing screw 105 with the radiator 103 or a heat conductive converting plate 27 (the heat conductive converting plate 27 is fixed in a fixing screw hole 104A on the radiator 103 through a fixing screw 104 for cooperative installation) as an installation interface AZM, and the lampshade 101 is connected to the radiator 103 or the heat conductive converting plate 27 in an adhesion, or threaded connection or clamping manner. The installation interface includes a surface in contact with the LED bulb 102 and a hole connected to the LED bulb on the radiator 103 or the heat conductive converting plate 27. The radiator 103 is a columnar radiator, as shown in FIG. 65 and FIG. 66, the radiator is provided with a radiator substrate thickness inwards at the maximal outer diameter of the cylinder and is provided with fins towards the center of the cylinder in a radial line, 2-3 layers of interrupted grooves are provided to the columnar radiator along a sealed circular arc with the substrate as thickness, after the radiator is heated, external air naturally flows into the center of the radiator through the interrupted grooves to form convection so as to achieve a cooling effect. The radiator 103 may also be a convection radiator, as shown in FIG. 67, FIG. 68 and FIG. 69, the radiator is provided with a radiator substrate thickness outwards from the cylindrical surface (using the outer diameter of a straightly fixed connector socket flange as the diameter) at the center and is provided with fins outwards from the substrate in a radial line radiation manner, and an arc is formed on the surface of each fin upwards to gradually increase the open area; the surface of the each fin is covered with a radiator outer cover, and a plurality of through air flow channels are formed between the outer cover and the fins; after the radiator is heated, the air enters from the flow channel opening at the lower end and flows out from the flow channel opening at the higher end, of the radiator to form a chimney effect, in order to achieve air convection to dissipate heat. The screw lamp radiator may also adopt any shape, as long as the fixed connector socket and the installation interface are provided. For example, a sunflower radiator is manufactured into different shapes to obtain different screw lamp outlines, as shown in FIG. 70 and FIG. 71. For the LED solution in which a conventional power supply is adopted for driving, the driving power supply 106 may be provided at the central position between the screw lamp radiator 103 and the lamp cap 108, as shown in FIG. 72. The outer bulb cover 101 may adopt different shapes to obtain different appearance effects, for example, a mushroom head, a candle head, a round head and a flat head. A connector socket 10 is provided to the radiator 103 or the heat conductive converting plate 27, the connector socket 10 is cooperatively connected to the connector plug 11 on the LED bulb, a three-hole flange is provided to the connector socket 10, the connector socket is fixed with the radiator 103 or the heat conductive converting plate 27 through the three-hole flange and a fixing screw 25 of the connector socket, and a fixed adjusting rubber pad 24 is further provided between the flange and the radiator 103 or the heat conductive converting plate 27 to ensure the tightness of a waterproof surface; a conducting wire led out from the connector socket is welded on the lamp cap 108. The LED bulb 102 is constructed in the following manner: an optical engine module is adhered at the center of a heat conductive bracket provided with an installation flange; or a nonmetal heat conductive bracket provided with a flange is integrally manufactured with the optical engine module in the same material; the structure between the optical engine module and the heat conductive bracket is simple and smooth, being favorable for the heat dissipation of LED, and the LED bulb is installed on the installation interface through the flange.

The meanings of the reference signs in the embodiment are as follows: 101—screw lamp housing, 102—LED bulb in the present invention, 103—radiator, 104—fixing screw, 104A—fixing screw hole, 105—bulb fixing screw, 106—driving power supply, 108—screw lamp cap, 109—radiator outer cover, 110—intermediate connecting element, 301—flange fixing hole, and AZM—installation interface.

Embodiment 7

Figure 74:
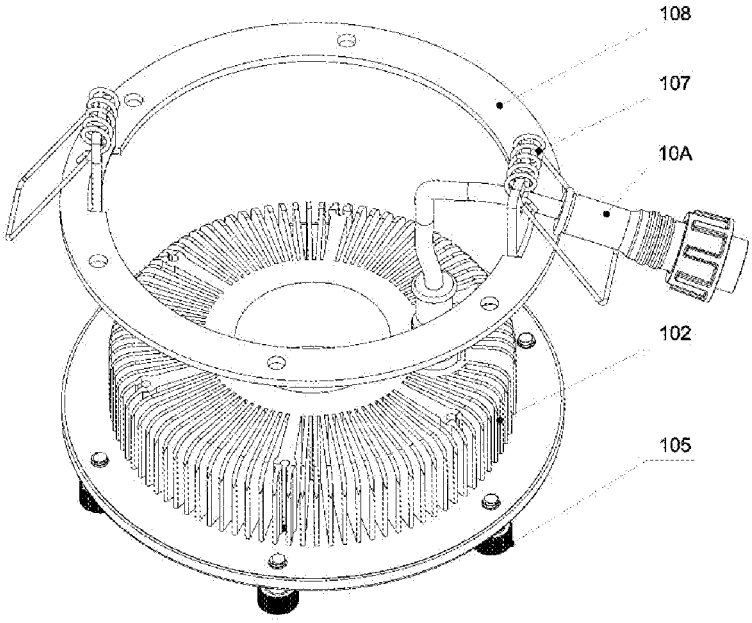
FIG. 74 is a schematic diagram of a structure of embodiment 7 in the present invention.
Figure 75:
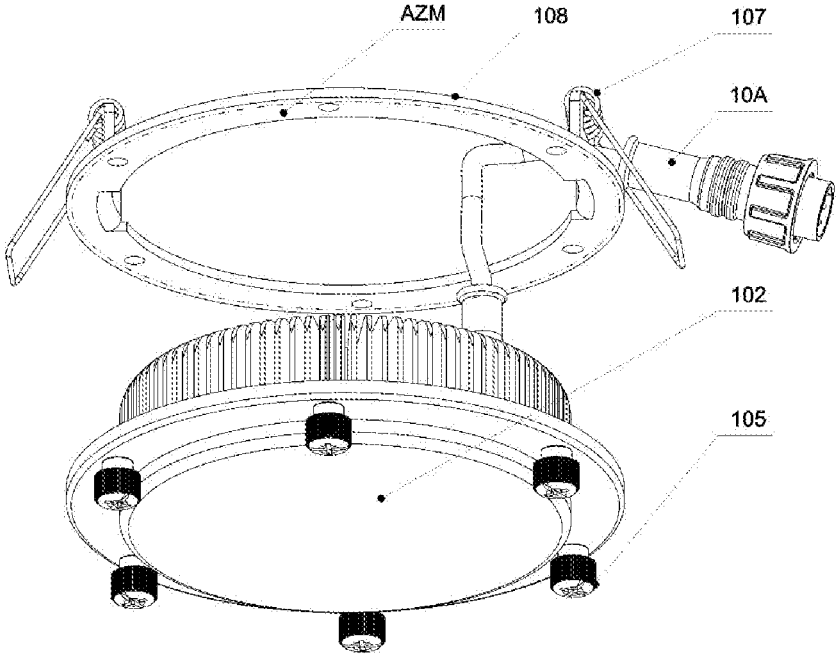
FIG. 75 is a vertical structure diagram in embodiment 7 of the present invention.
Figure 76:
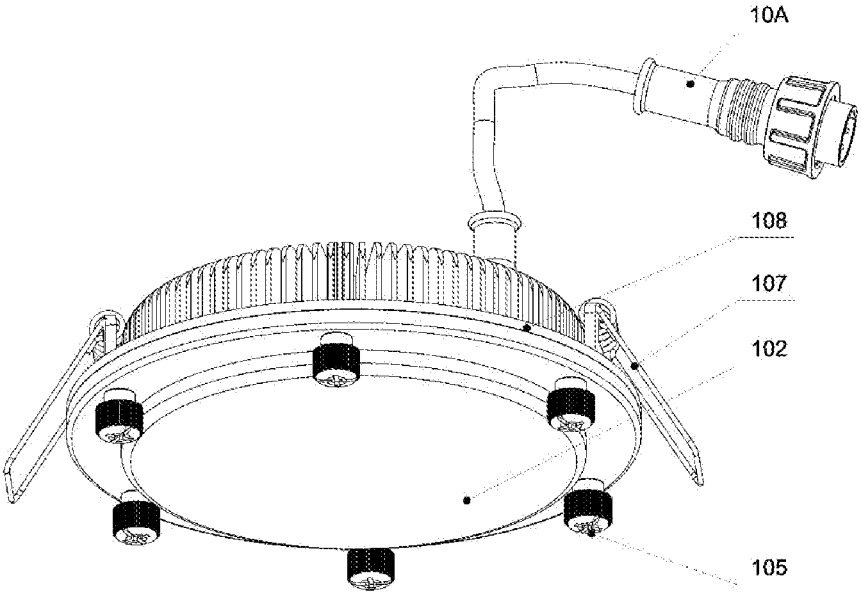
FIG. 76 is an external view in embodiment 7 of the present invention.

An LED cylindrical lamp using a base bracket as an installation interface, as shown in FIG. 74, FIG. 75 and FIG. 76, includes a cylindrical lamp lamp, wherein the cylindrical lamp lamp includes the base bracket 108 and spring fixing clips 107, the base bracket 108 is ring-shaped, and the spring fixing clips 107 are provided at the two sides of the base bracket 108; the cylindrical lamp lamp is provided with the installation interface AZM on the base bracket 108 for fixedly installing an LED bulb 102. The installation interface AZM includes a surface in contact with the LED bulb 102 and a hole connected to the LED bulb, on the base bracket 108. The installation interface AZM on the base bracket 108 includes a radiator interface opening and 6 flange fixing holes, the flange fixing holes are used for fixing the LED bulb 102, and the radiator interface opening is used for enabling the LED bulb 102 to penetrate through the installation interface; the flange fixing holes are uniformly distributed at a diameter D1, and the diameter D1 is a value obtained by subtracting the diameter of a fixing screw cap and then substracting a margin of 0.8-4 mm from the outer diameter D of the LED bulb 102; the diameter D2 of the radiator interface opening on the installation interface is a value obtained by subtracting two times of a diameter of a fixing screw cap and then subtracting two times of the margin corresponding to the diameter D1 from the outer diameter D of the bulb. The LED bulb 102 is installed on the installation interface AZM through a bulb fixing screw 105.

Figure 77:
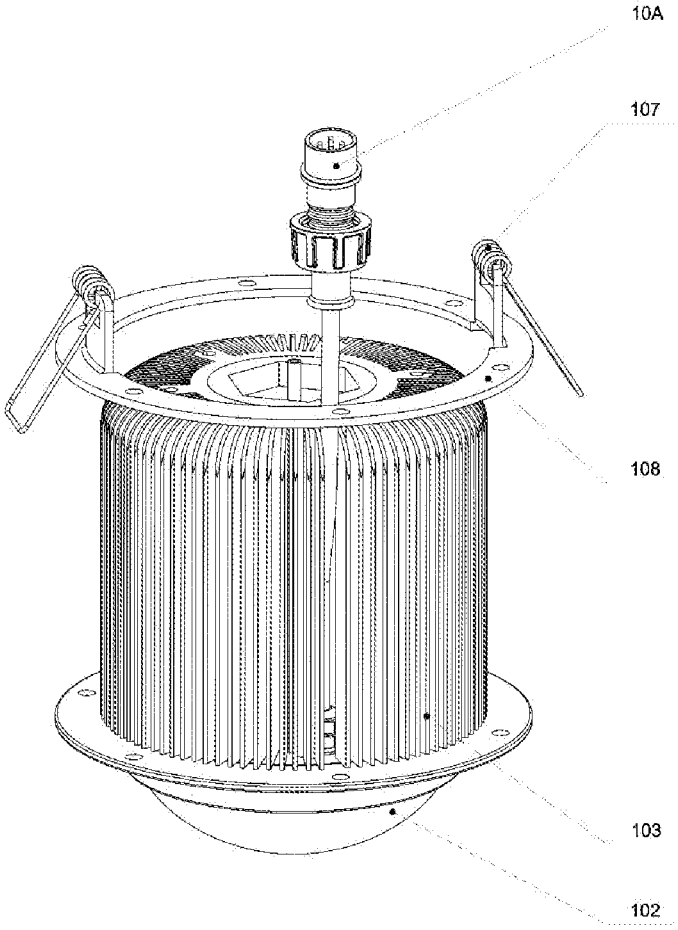
FIG. 77 is a structure diagram of a large-volume LED bulb with waterproof and dustproof functions and provided with a radiator in embodiment 7 of the present invention.
Figure 78:
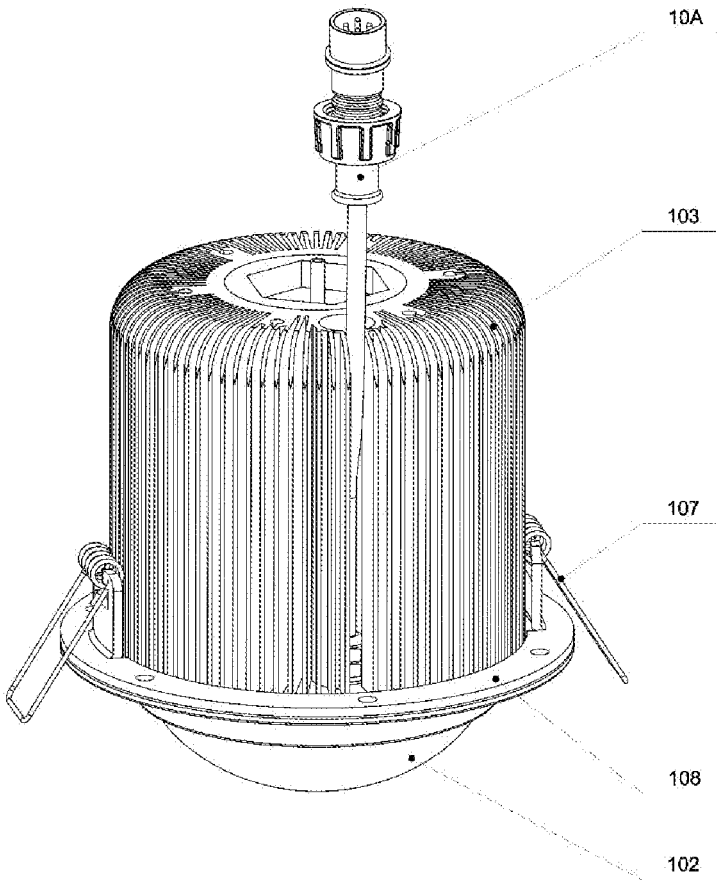
FIG. 78 is an external view of a large-volume LED bulb with waterproof and dustproof functions and provided with a radiator in embodiment 7 of the present invention.

In the embodiment, the radiator of the LED bulb with waterproof and dustproof functions and provided with the radiator may also be a radiator with a larger volume, as shown in FIG. 77 and FIG. 78.

Figure 79:
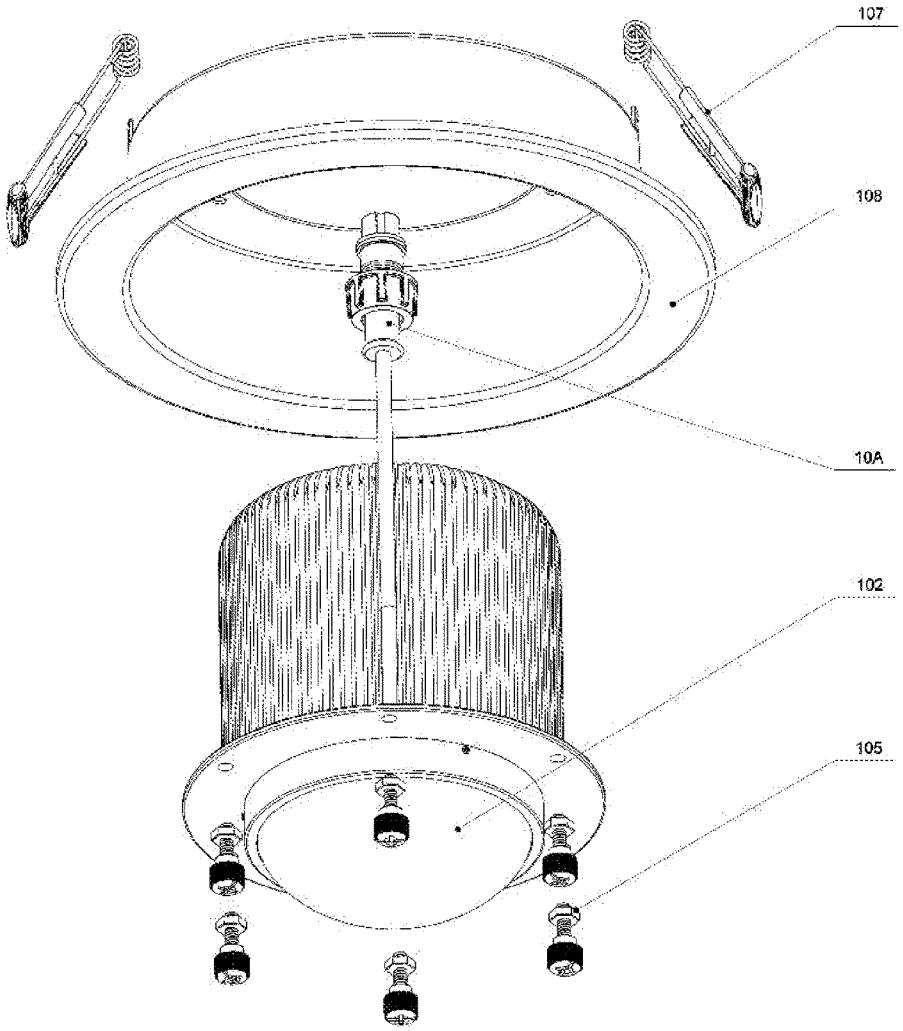
FIG. 79 is a structure diagram of a cover-shaped cylindrical lamp base in embodiment 7 of the present invention.

In the embodiment, the cylindrical lamp base 108 may also be cover-shaped, as shown in FIG. 79.

Figure 80:
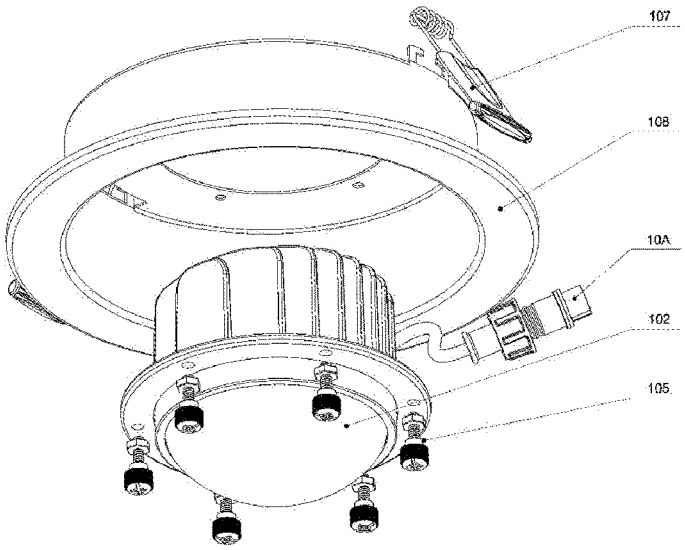
FIG. 80 is a structure diagram when an LED bulb with waterproof and dustproof functions is adopted in embodiment 7 of the present invention.
Figure 81:
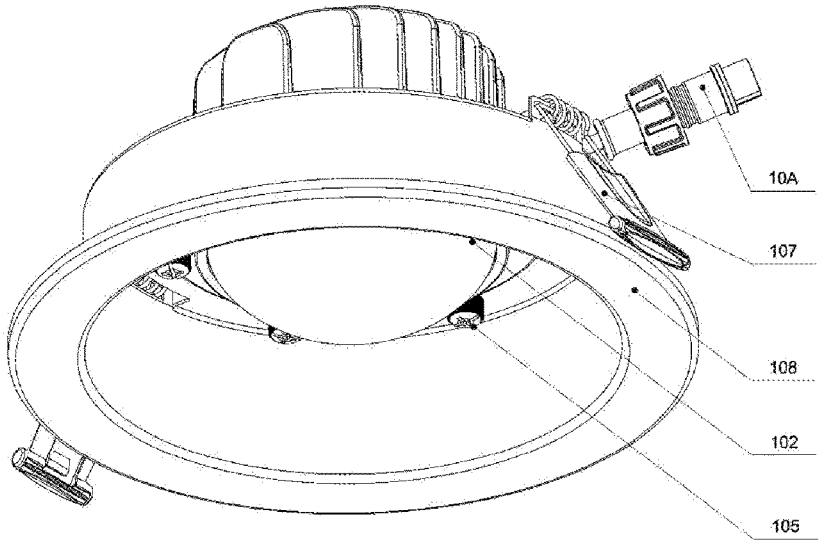
FIG. 81 is a vertical external view when an LED bulb with waterproof and dustproof functions is adopted in embodiment 7 of the present invention.
Figure 82:
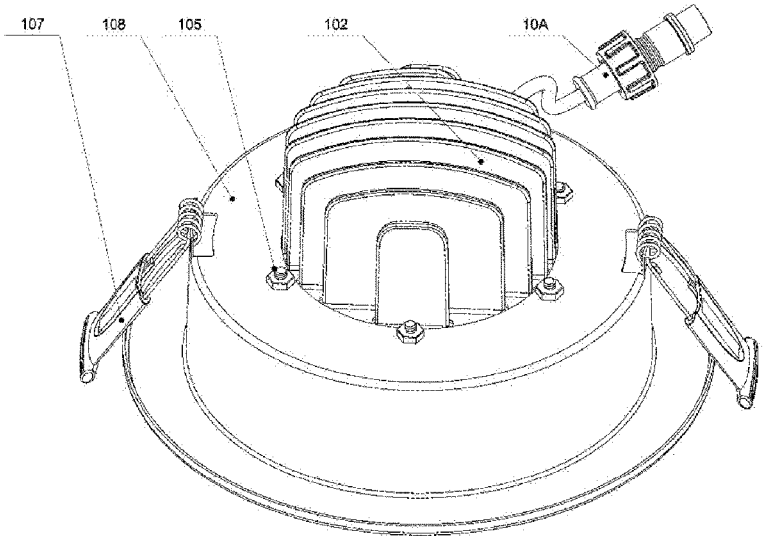
FIG. 82 is an overlooking external view when an LED bulb with waterproof and dustproof functions is adopted in embodiment 7 of the present invention.
Figure 83:
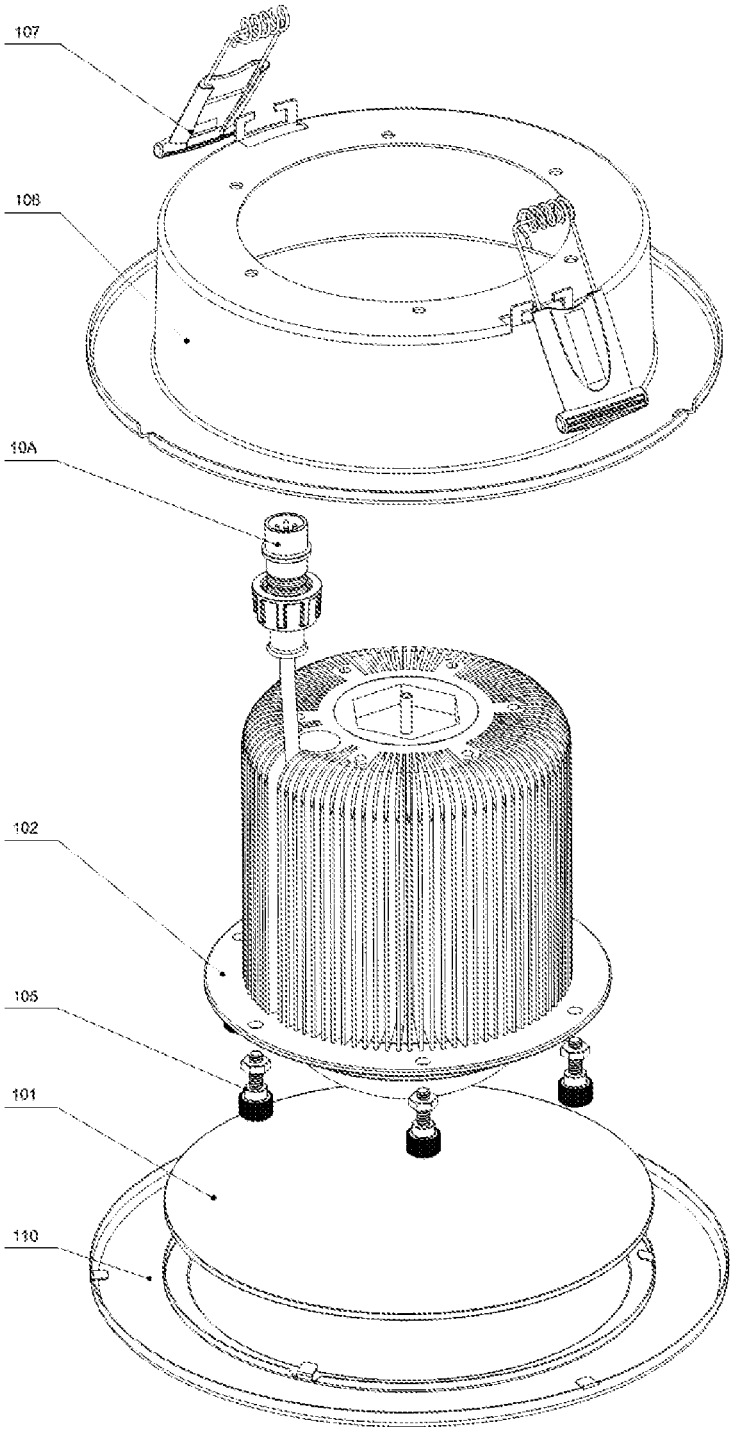
FIG. 83 is a structure diagram when a lampshade piece, a lampshade piece supporting cover and an LED bulb with waterproof and dustproof functions and provided with a radiator are adopted in embodiment 7 of the present invention.
Figure 84:
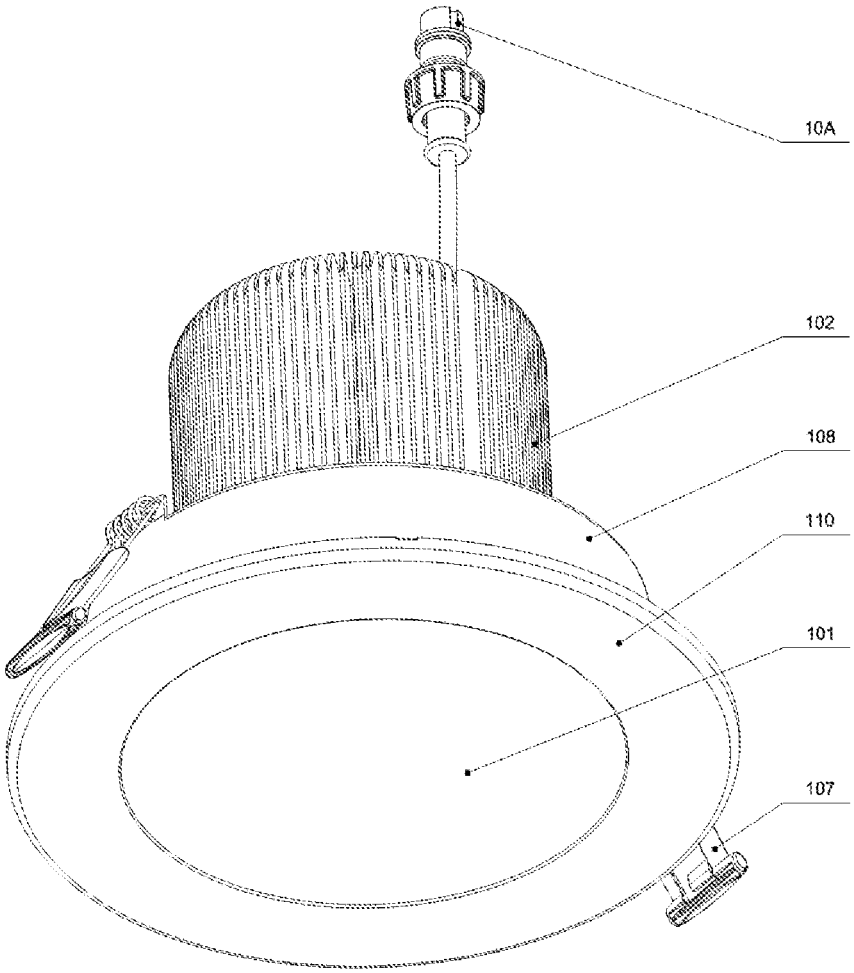
FIG. 84 is an external view when a lampshade piece, a lampshade piece supporting cover and an LED bulb with waterproof and dustproof functions and provided with a radiator are adopted in embodiment 7 of the present invention.
Figure 85:
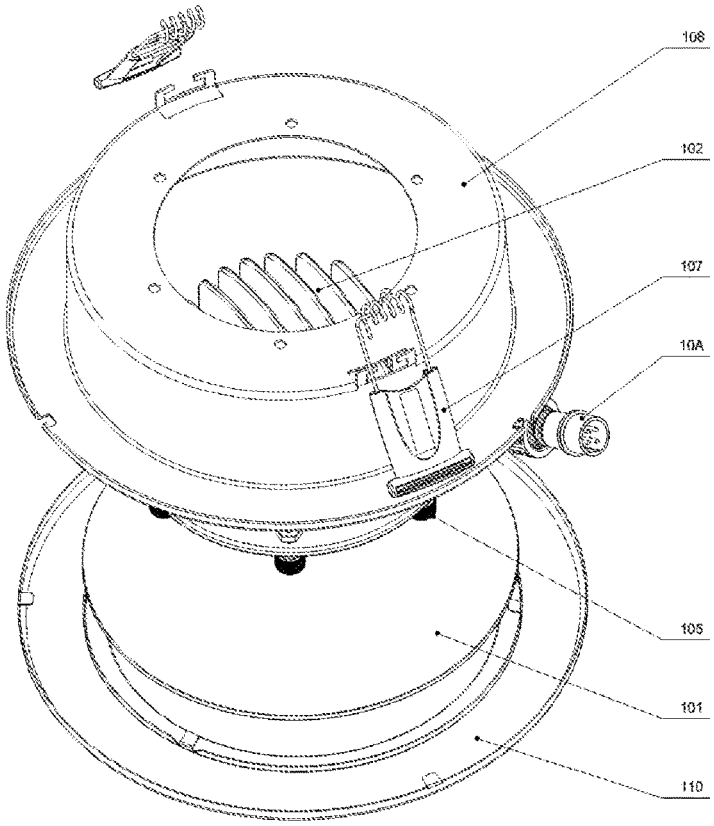
FIG. 85 is a structure diagram when a lampshade piece, a lampshade piece supporting cover and an LED bulb with waterproof and dustproof functions are adopted in embodiment 7 of the present invention.
Figure 86:
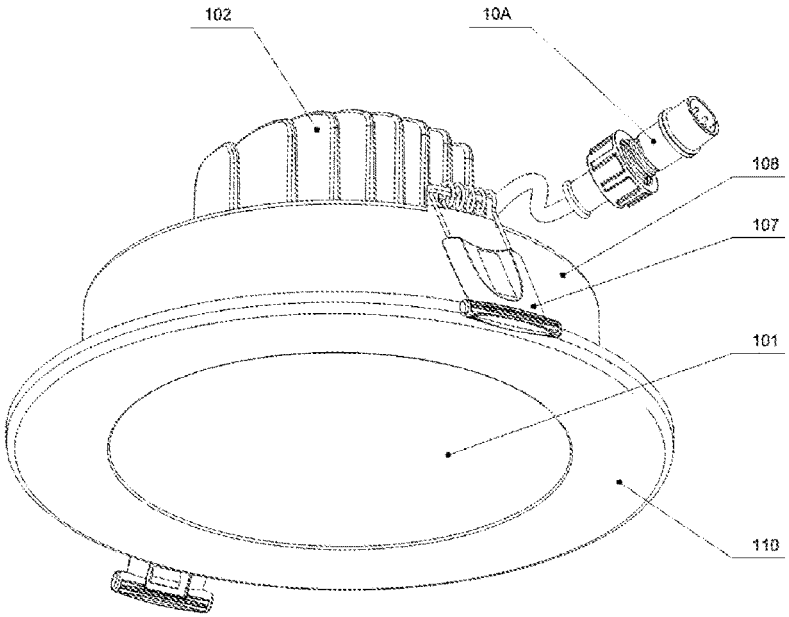
FIG. 86 is an external view when a lampshade piece, a lampshade piece supporting cover and an LED bulb with waterproof and dustproof functions are adopted in embodiment 7 of the present invention.

In the embodiment, when the LED bulb 102 is an LED bulb with waterproof and dustproof functions, it is as shown in FIG. 80, FIG. 81 and FIG. 82.

Figure 87:
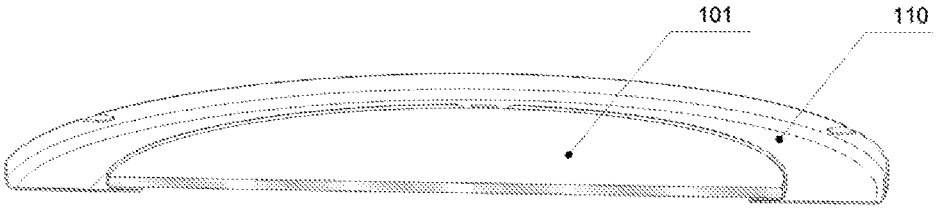
FIG. 87 is a schematic diagram of combination of a lampshade piece and a lampshade piece supporting cover in the present invention.

In the embodiment, a lampshade piece 101 may also be provided beneath the cylindrical lamp base 108, a lampshade piece supporting cover 110 is provided beneath the lampshade piece 101, and the lampshade piece 101 is fixed on the lampshade piece supporting cover 110, as shown in FIG. 87; the lampshade piece supporting cover 110 is clamped on a notch of the cylindrical lamp base 108 through an edge projection, as shown in FIG. 93, FIG. 84, FIG. 85 and FIG. 86.

The meanings of the reference signs in the embodiment are as follows: 101—lampshade piece, 102—LED bulb, 103—radiator, 105—bulb fixing screw, 107—spring fixing clip, 108—base and bulb installation interface bracket, 110—lampshade piece supporting cover, 301—bulb installation flange fixing hole, 302—bracket lining rivet hole, 501—bracket lining rivet projection, and 502—power supply or control end welding spot hole.

Embodiment 8

Figure 88:
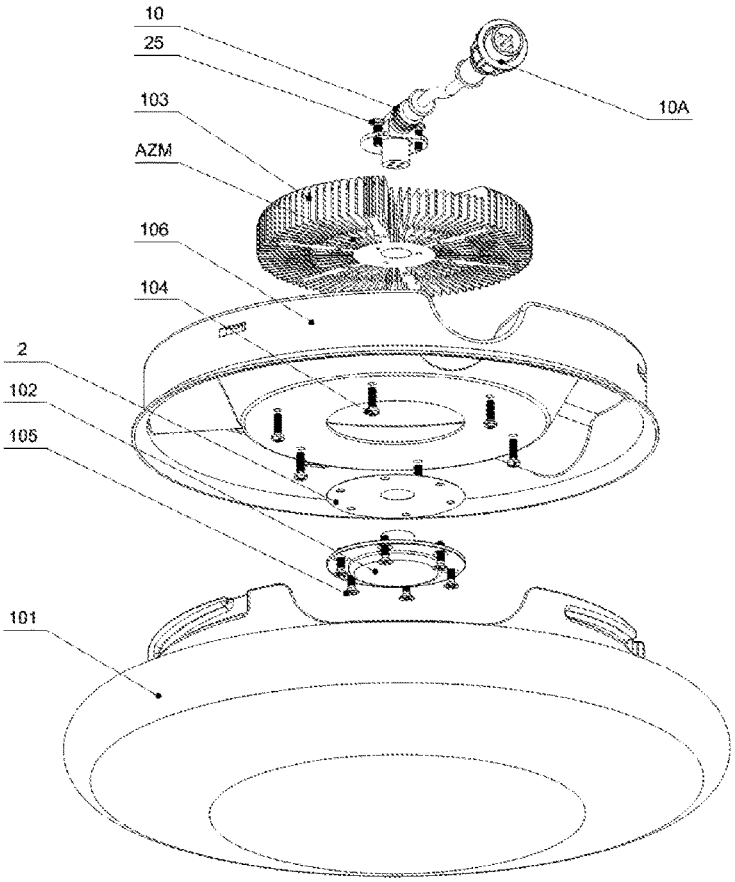
FIG. 88 is a schematic diagram of a structure of embodiment 8 of the present invention.
Figure 89:
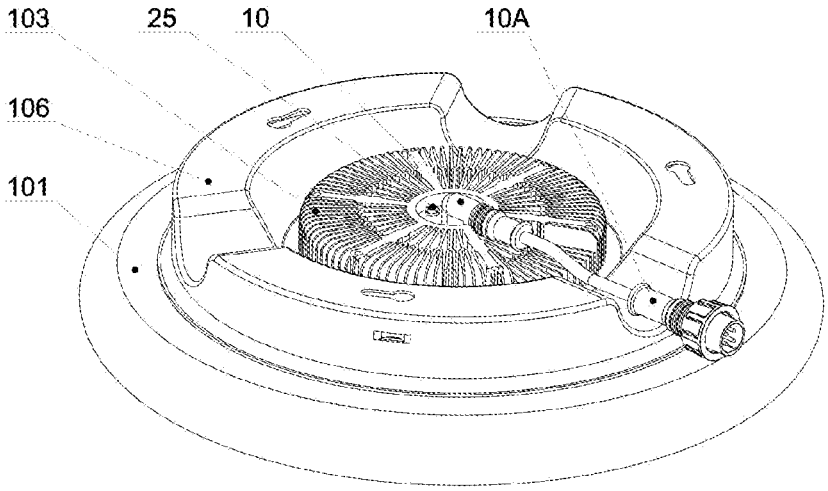
FIG. 89 is a vertical view of a structure of embodiment 8 of the present invention.
Figure 92:
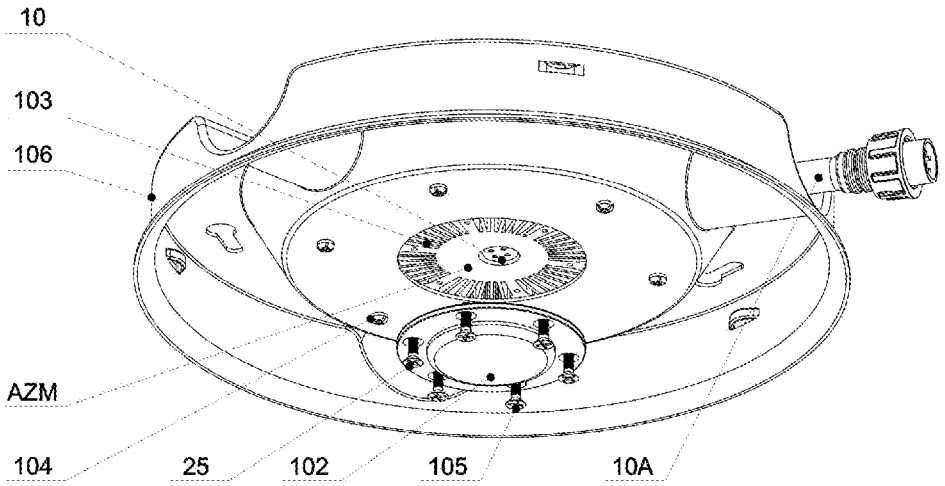
FIG. 92 is a structure diagram of a ceiling lamp base in embodiment 8 of the present invention.
Figure 93:
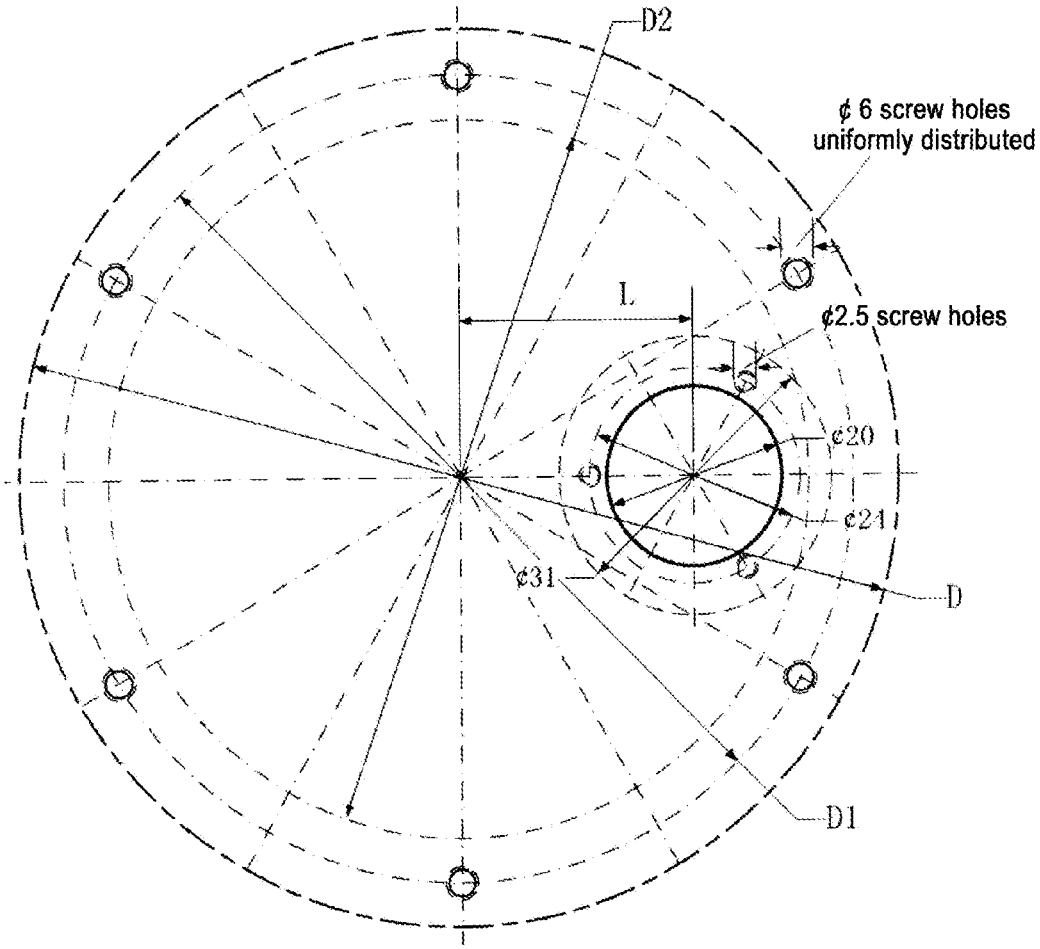
FIG. 93 is a schematic diagram of an installation interface on a lamp in an embodiment of the present invention (for bulbs with an outer diameter of 80 mm or larger)
Figure 94:
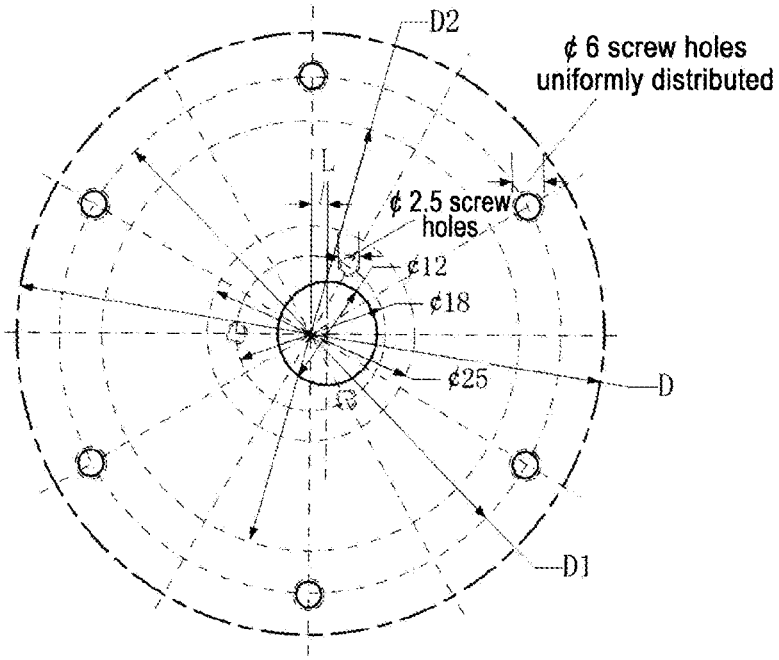
FIG. 94 is a schematic diagram of an installation interface on a lamp in an embodiment of the present invention (for bulbs with an outer diameter of 70 mm or larger)
Figure 95:
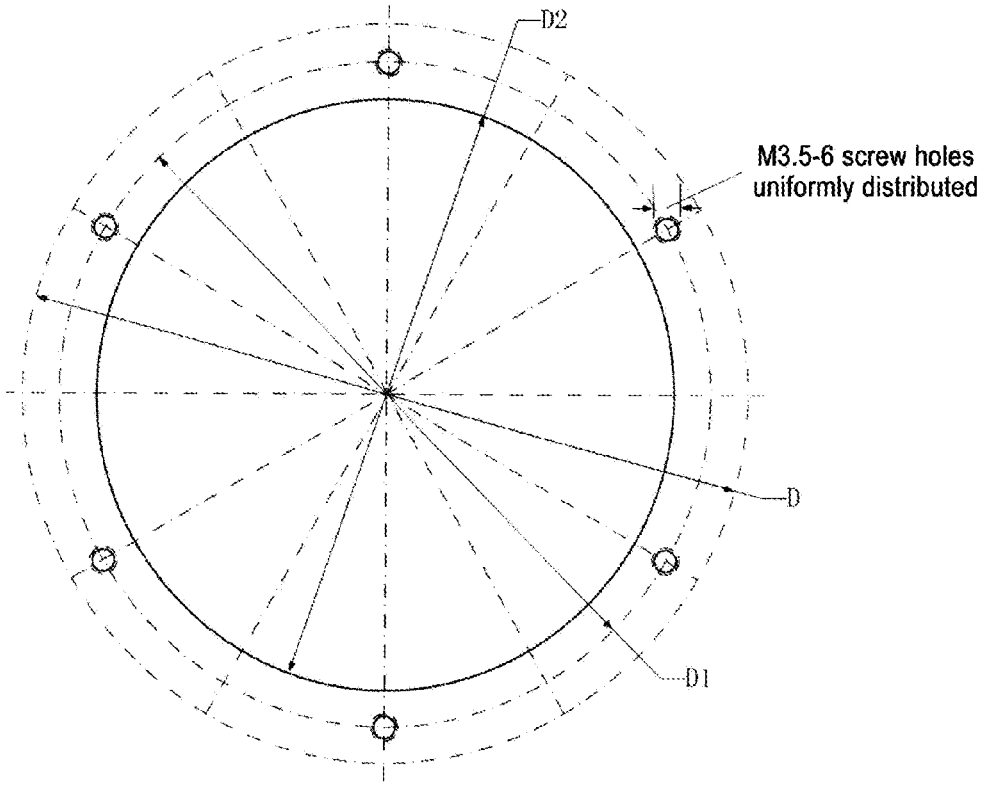

An LED ceiling lamp, as shown in FIG. 88, FIG. 89 and FIG. 92, includes a ceiling lamp lamp, wherein the ceiling lamp lamp includes a ceiling lamp base 106 and a radiator 103, a bulb installation interface is provided to the ceiling lamp base 106, and the radiator 103 is provided to the bulb installation interface; an installation interface AZM is provided at the center of the lower part of the radiator 103 for fixedly installing an LED bulb 102. A plurality of ventilation gaps are provided at the edge of the upper part of the ceiling lamp base 106, the radiator 103 is fixed on the base 106 through a fixing screw 104, after the radiator 103 is heated during operation of the LED ceiling lamp, external air naturally flows into the center of the radiator along the ventilation gaps of the base 106 to form convection so as to achieve a cooling effect; the installation interface AZM includes a surface in contact with the LED bulb 102 and a hole connected to the LED bulb, on the radiator 103. The ceiling lamp lamp further includes a ceiling lampshade 101, and the ceiling lampshade 101 is connected to the ceiling lamp base 106 in a clamping or screw connecting manner. A vent hole A is provided at the edge of the bulb installation interface of the ceiling lamp base 106, and in order to prevent mosquitoes from entering, the vent hole A is coated with a gauze 29; a vent hole B is provided to the ceiling lampshade 101, and in order to prevent mosquitoes from entering, the vent hole B is coated with a gauze 29; external air may enter from the vent hole B and flow out from the vent hole A to achieve a convection radiating effect. The ceiling lamp lamp further includes an electric connector assembly, the electric connector assembly includes a connector socket 10, a fixing screw 25 of the connector socket and a fixed adjusting rubber pad 24; the connector socket 10 is cooperatively connected to a connector plug 11 on the LED bulb 102, a three-hole flange is provided to the connector socket 10, and the connector socket is fixed with the radiator 103 through the three-hole flange and the fixing screw 25 of the connector socket, and the fixed adjusting rubber pad 24 is provided between the flange and the radiator 103 to ensure the tightness of a waterproof surface. 6 flange fixing holes on the installation interface of the radiator 103 are uniformly distributed at a diameter D1, and the diameter D1 is a value obtained by subtracting the diameter of a fixing screw cap and then substracting a margin of 0.8-4 mm from the outer diameter D of the LED bulb 102. The radiator 103 is a sunflower radiator, as shown in FIG. 11. The radiator 103 is installed on a bulb installation interface hole through a fixing screw 104, and the LED bulb 102 is installed on the installation interface AZM through a bulb fixing screw 105.

Figure 90:
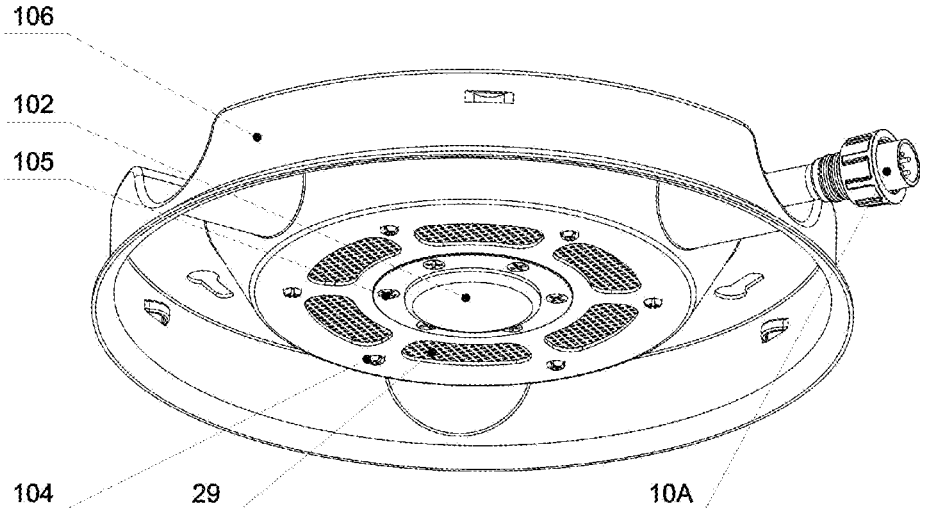
FIG. 90 is a schematic diagram of a structure when a ceiling lamp base with a vent hole is adopted in embodiment 8 of the present invention.
Figure 91:
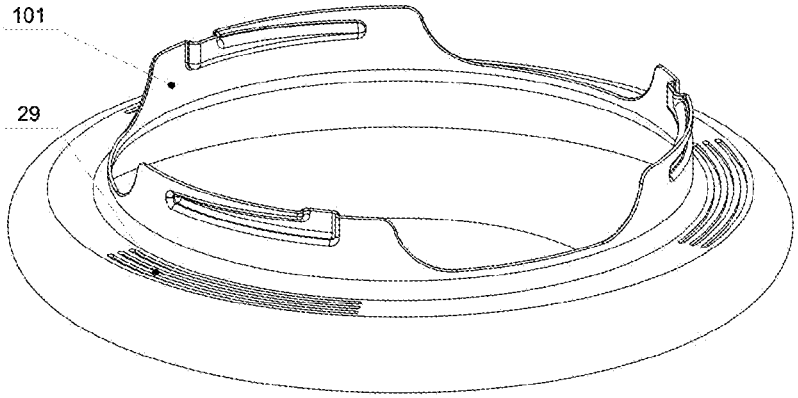
FIG. 91 is a schematic diagram of a structure of a ceiling lamp cover with a vent hole in embodiment 8 of the present invention.

In the embodiment, the vent hole A is provided at the edge of the bulb installation interface hole of the ceiling lamp base 106, external air may form convection with the longitudinal direction of the radiator 103 through the vent hole to reinforce the radiating effect, the vent hole A is coated with the gauze 29 to prevent mosquitoes from entering, as shown in FIG. 90; the vent hole B is provided to the ceiling lampshade 101, and external air may enter from the vent hole A and flow out from the vent hole B to reinforce the radiating effect; the vent hole B is coated with the gauze 29 to prevent mosquitoes from entering, as shown in FIG. 91.

A waterproof connector plug 10A with a nut is used for connecting the LED bulb 102 to a power supply and a control circuit.

When the present invention is maintained, only the ceiling lampshade 101 is opened, and the fixing screw 105 is detached to change the LED bulb 102, thus prolonging the service life of the ceiling lamp and reducing the expected investment cost of user lighting.

The meanings of the reference signs in the embodiment are as follows: AZM—bulb installation interface, 101—ceiling lampshade, 102—LED bulb, 103—radiator, 104— fixing screw, 105—bulb fixing screw, 106—ceiling lamp base, and 301—bulb installation flange fixing hole.

The invention claimed is:

1. A method for constructing a universal LED bulb, comprising:

supporting an optical engine core member of the LED bulb in a lens snap ring using the lens snap ring as a supporting main body of the LED bulb, using an inner snap ring provided on an inner side of a light distribution optical lens in the optical engine core member of the LED bulb as an auxiliary supporting structure of the LED bulb, and using the inner snap ring as an installation base of an optical engine module and a heat conductive bracket or an installation base of a radiator of the LED bulb, wherein the LED bulb optical engine core member comprises the heat conductive bracket, the optical engine module, the inner snap ring and the light distribution optical lens, an inner cover is provided outside the optical engine module, an electric connector is provided to the heat conductive bracket, and an installation flange is provided to the lens snap ring for installing the LED bulb, and wherein the optical engine module comprises an optical engine die plate, an LED chip set and a relevant circuit wiring by bonding and packaging, or is further integrated with a power supply drive chip.

2. The method for constructing the universal LED bulb of claim 1, wherein a diameter of the lens snap ring is a bulb outer diameter D, the LED bulb outer diameter D and an upper limit of power W of the constructed LED bulb satisfy a relationship $W=1.1812e^{0.0361D}$, discrete values are selected on the relationship curve $W=1.1812e^{0.0361D}$ to construct a plurality of LED bulbs having fixed bulb outer diameters D in order to improve interchangeability and universality of the LED bulbs; on the relationship curve $W=1.1812e^{0.0361D}$, with 20 mm used as a lower limit and 130 mm used as an upper limit of the LED bulb outer diameter D, the relationship curve is divided into 12 segments each of which is set to 10 mm to form a limited number of bulb outer diameter specifications, and interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the LED bulb outer diameter D; a diameter D2 of a radiator interface opening of the LED bulb on a lamp is a value obtained by subtracting two times of a diameter of a fixing screw cap and then subtracting two times of the margin corresponding to the diameter D1 from the LED bulb outer diameter D; an installation interface of the LED bulb includes a surface in contact with the LED bulb and a hole connected to the LED bulb, on the lamp.

3. The method for constructing the universal LED bulb of claim 1, wherein a radiator is provided to the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by low temperature extrusion moulding and high temperature sintering of an ultrafine nonmetal heat conductive material, contact surfaces of the nonmetal radiator and the heat conductive conversion bracket are adhered into an integral piece by being coated with a heat conductive adhesive; a rubber sheath or screw fixing glue is filled in a fixing screw hole of the nonmetal radiator for connecting a fixing screw, and a radiator outer cover is provided outside the nonmetal radiator; the heat conductive conversion bracket is overhead, the nonmetal radiator has a screen mesh-shaped structure, and the nonmetal radiator is kept overhead by the heat conductive conversion bracket so that air can enter screen meshes of the nonmetal radiator from the heat conductive conversion bracket; or the radiator is a metal radiator, the metal radiator has a hollow structure, a foam metal is filled in its hollow part, superconducting liquid is filled in the hollow structure, upper and lower stoppers are pressed by interference fit or screwed by a threaded seal gum into the hollow structure to form a sealed space, and the sealed space is vacuumized; a fixing screw of the radiator penetrates through a fixing through hole on the inner snap ring to be connected to the fixing screw hole of the nonmetal radiator or the metal radiator.

4. The method for constructing the universal LED bulb of claim 1, wherein a connector plug fixing hole is provided to the heat conductive bracket, a connector plug with a contact pin is inserted into the connector plug fixing hole and is fixed with the part inserted into the LED bulb as a fixed end, a tail end of the contact pin is welded to the optical engine die plate in the universal LED bulb to form a simple electric interface on an outer surface of the universal LED bulb, and during installation, the electric connection of the universal LED bulb is achieved as long as the connector plug is butt jointed with an connector socket with a cable and the universal LED bulb is fixed; an eccentric position of the connector plug fixing hole on the heat conductive bracket and a size of the fixed end of the connector plug are limited, such that the optical engine die plate in the LED bulb may meet demands of arranging the LED chip and the power supply chip and registering them; the connector plug with the contact pin is of a four-pin structure in which two pins are used for power supply access and the other two pins are used for control access; the fixed end is in a nut fixing manner or a fusion ring fixing manner; when the fixed end is formed in the nut fixing manner, a waterproof rubber ring is added between the connector plug and the heat conductive bracket to prevent water; in order to prevent rotation, an antiskid groove is provided in the connector plug, and a corresponding projection is provided at a through hole of the heat conductive bracket; a three-hole flange is provided to the connector socket and is fixed to the radiator of the lamp through a fixing screw, and an adjusting rubber pad is provided between the connector socket and the radiator to adjust its thickness in order to ensure tightness of a waterproof surface; or external threads are provided to the connector plug to match with internal threads of a fixing nut on the connector socket provided with a waterproof rubber ring to prevent water; a slot is provided to the connector socket, and the waterproof rubber ring is provided in the slot to prevent water.

5. A snap ring structured LED bulb, comprising a lens snap ring (8) with an installation flange, at least a heat conductive bracket (3), an optical engine module (4), an inner snap ring (81) and a light distribution optical lens (7) being provided in the lens snap ring (8) sequentially, wherein an optical engine core member of the LED bulb in the lens snap ring (8) is supported using the lens snap ring (8) as a supporting main body of the LED bulb, the inner snap ring (81) provided on an inner side of the light distribution optical lens (7) in the optical engine core member of the LED bulb is used as an auxiliary supporting structure of the LED bulb, and the inner snap ring (81) is used as an installation base of the optical engine module (4) and the heat conductive bracket (3) or an installation base of a radiator of the LED bulb; wherein a connector plug (11) is fixed on the heat conductive bracket (3), an inner cover (6) is further provided outside the optical engine module (4), and the optical engine module (4) is made up of an optical engine die plate, an LED chip set and a relevant wiring by bonding and packaging, or is further integrated with a power supply drive chip.

6. The snap ring structured LED bulb of claim 5, wherein a step is provided at an upper part of the inner snap ring (81), the heat conductive bracket (3) is provided in the step, the optical engine module (4) is adhered to the heat conductive bracket (3), the inner snap ring (81) surrounds outside the optical engine module (4), or an inner ring cover (62) is further provided between the inner snap ring (81) and the inner cover (6); an upper end of the inner snap ring (81) is adhered with the heat conductive bracket (3), a lower end of the inner snap ring is adhered with the light distribution optical lens (7), so that a sealed waterproof space for enclosing the optical engine module (4) is formed by the inner snap ring (81), the heat conductive bracket (3) and the light distribution optical lens (7); or, the inner snap ring (81) is further used as an installation base of a radiator of the LED bulb; when the lens snap ring (81) is installed, it can ensure that an upper surface of the heat conductive bracket (3) closely leans against a radiator (103); or, the heat conductive bracket (3) and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

7. The snap ring structured LED bulb of claim 5, wherein the heat conductive bracket (3), the optical engine module (4), the inner snap ring (81) and the light distribution optical lens (7) are sequentially overlapped and adhered, or an inner ring cover (62) is further provided between the inner snap ring (81) and the inner cover (6), and the optical engine die plate of the optical engine module (4), the inner snap ring (81) and the light distribution optical lens (7) form a sealed waterproof space used for enclosing components packaged on the optical engine die plate; or, the inner snap ring (81) is further used as a installation base of a radiator of the LED bulb; or the inner snap ring (81) and the inner cover (6) are formed into an inner cover (68) having a function of the inner snap ring and having an integral structure; when the lens snap ring (81) is installed, it can ensure that the upper surface of the heat conductive bracket (3) closely leans against the radiator (103); or, the heat conductive bracket (3) and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

8. The snap ring structured LED bulb of claim 5, wherein the radiator (103) is provided to the heat conductive bracket (3), and a heat conductive pad (2) is provided between the radiator (103) and the heat conductive bracket (3); the radiator (103) is a nonmetal radiator assembly, the nonmetal radiator assembly includes a screen mesh-shaped nonmetal radiator and an overhead heat conductive conversion bracket (1) below the nonmetal radiator, a rubber sheath or screw fixing glue is filled in a radiator fixing screw hole (33) of the nonmetal radiator for connecting a fixing screw, a radiator outer cover (101) is provided outside the nonmetal radiator; or the radiator (103) is a metal radiator, the metal radiator comprises a cooling fin (34), a superconductive fluid cavity is provided in the cooling fin (34), a foam metal (37) and superconductive fluid are filled in the superconductive fluid cavity, an upper stopper (33) and a lower stopper (35) are provided on two ends of the superconductive fluid cavity, and a vacuum suction pipe (32) is provided to the upper stopper (33) or the lower stopper (35); a cable hole (36) used for penetration of a cable and a radiator fixing screw hole (38) are further provided to the radiator (103); a radiator fixing screw (12) of the radiator penetrates through a fixing through hole (23) on the inner snap ring (81) to be connected to the radiator fixing screw hole (38) of the nonmetal radiator or the metal radiator.

9. The snap ring structured LED bulb of claim 5, wherein only transparent silica gel for package is provided outside the LED chip on the optical engine module (4), the inner cover (6) is provided outside the optical engine module (4) with the transparent silica gel, and fluorescent powder coating is coated on an inner layer of the inner cover (6); or, no silica gel is packaged on the LED chip on the optical engine module (4), a concave inner cover (61) filled with transparent insulating heat conductive liquid is provided outside the optical engine module (4), the LED chip on the optical engine module (4) is soaked in the transparent insulating heat conductive liquid, fluorescent powder is provided in the transparent insulating heat conductive liquid, and the concave inner cover is an elastic inner cover of a thin concave structure.

10. The snap ring structured LED bulb of claim 5, wherein an electric connector is provided to the heat conductive bracket (3), the electric connector comprises a connector plug (11), a contact pin (17) is provided on the electric connector plug (11), and a contact pin welding spot (19) on a tail end of the contact pin (17) is welded to the optical engine module (4); after penetrating through a fixing hole (22) of the connector plug on the universal LED bulb, the connector plug (11) is fixed on a fixed end (15) thereof; the connector plug (11) is cooperatively connected to a connector socket (10) with a jack, and the connector socket (10) is connected to a cable; the contact pin of the electric connector has a four-pin structure in which two pins are used for power supply access and the other two pins are used for control access;

wherein the fixed end (15) is a fusion ring or the fixed end (15) is a fixing nut, a waterproof rubber ring slot (18) is further provided to the connector plug (11), and a waterproof rubber ring (16) is provided in the waterproof rubber ring slot (18); in order to prevent rotation, an antiskid groove (26) is provided in the connector plug (11), and a corresponding projection is provided at the through hole of the heat conductive bracket (3); a three-hole flange is provided to the connector socket (10), and the connector socket is fixed to the radiator (103) or a heat conductive converting plate (27) on the lamp through the three-hole flange and a fixing screw (25) of the connector socket, and a fixed adjusting rubber pad (24) is further provided between the flange and the radiator (103) or the heat conductive converting plate (27) on the lamp to ensure tightness of a waterproof surface; or the connector plug (11) is provided with external threads to match with internal threads of a fixing nut (28) on the connector socket (10) provided with the waterproof rubber ring (16) so as to be fixed to the connector plug (11); a slot is provided to the connector socket (10), and the waterproof rubber ring (16) is provided in the slot.

11. A lamp using the LED bulb of claim 5, comprising an installation interface, wherein the LED bulb is provided on the installation interface.

12. The lamp of claim 11, wherein the lamp is an LED tunnel lamp, an extrusion type double-faced radiator structure is used as the installation interface, the LED tunnel lamp comprises a metal extrusion type double-faced radiator (103) formed by an extrusion process, an LED bulb (102) is provided to the extrusion type double-faced radiator (103), the extrusion type double-faced radiator (103) is installed on an installation support (104), and one or more installation interfaces used for installing the LED bulb (102) are provided on the extrusion type double-faced radiator (103).

13. The lamp of claim 12, wherein the extrusion type double-faced radiator (103) comprises a substrate, and fins are provided on two sides of the substrate; the installation interface used for installing the LED bulb (102) is provided on one side of the substrate, and circular or elliptic conical spaces are formed by cutting on the fins around the installation interface of the substrate according to an illumination angle of the light emitted by the LED bulb to the extent of not shielding the light emitted by the LED bulb (102); the installation interface comprises a surface in contact with the LED bulb (102) and a hole connected to the LED bulb, on the extrusion type double-faced radiator (103); the LED tunnel lamp using the double-faced radiator structure further includes a wire harness connector (106) for connecting a plurality of LED bulbs (102) to a power supply and a control circuit;

wherein the extrusion type double-faced radiator (103) is installed on the installation support (104) through a turning connecting plate (110); the turning connecting plate (110) is fixed to a diversion bracket (108), and the diversion bracket (108) is fixed to the installation support (104), such that an angle of the extrusion type double-faced radiator (103) may be simultaneously adjusted in a horizontal direction and a vertical direction; the wire harness connector (106) is provided on the installation support (104);

or the extrusion type double-faced radiator (103) is connected to a radiator bracket (117); the radiator bracket (117) is used for installing the extrusion type double-faced radiator (103) on the installation support (104) through the turning connecting plate (110), the radiator bracket (117) is connected to the turning connecting plate (110), the turning connecting plate (110) is fixed to the diversion bracket (108), and the diversion bracket (108) is fixed to the installation support (104), such that an angle of the extrusion type double-faced radiator (103) may be simultaneously adjusted in a horizontal direction and a vertical direction; the wire harness connector (106) is provided to the radiator bracket (117).

14. The lamp of claim 11, wherein the lamp is an LED street lamp, the LED street lamp comprises an extrusion type radiator (103) extrusion formed by a metal, an installation interface is provided to the extrusion type radiator (103), and an LED bulb (102) is provided to the installation interface; the extrusion type radiator (103) is installed on a lamp post (108); a lamp housing (101) punch-formed by a metal or die-cast by plastics is provided outside the extrusion type radiator (103); the LED street lamp using the extrusion type radiator structure further includes a wire harness connector (106) for connecting a plurality of LED bulbs (102) to a power supply and a control circuit.

15. The lamp of claim 14, wherein the extrusion type radiator (103) comprises a substrate, fins are provided on one side of the substrate, and a cable hole is provided on the substrate; the installation interface used for installing the LED bulb (102) is provided on the other side of the substrate; a conducting wire bracket (112) is provided on one side of the substrate on which the fins are provided, and the conducting wire bracket (112) is used for connecting a conducting wire led out from the LED bulb (102) to the wire harness connector (106); the installation interface includes a surface in contact with the LED bulb (102) and a hole connected to the LED bulb on the extrusion type radiator (103);

wherein one side of the substrate of the extrusion type radiator (103) is connected to an L-shaped connecting plate (110), and the L-shaped connecting plate (110) is connected to the lamp post (108); the wire harness connector (106) is provided to the extrusion type radiator (103);

wherein a bracket installation hole is provided to the substrate or in the center of the extrusion type radiator (103), and the extrusion type radiator (103) is fixed to the lamp post (108) by a street lamp installation fixing bolt (109) passing through the bracket installation hole and a lamp post fixing ring (116); the wire harness connector (106) is provided in the lamp post (108) connected to the extrusion type radiator (103).

16. The lamp of claim 11, wherein the lamp is an LED projection lamp, a lamp housing is used as an installation interface bracket structure, the LED projection lamp comprises the lamp housing (101) punch-formed by a metal sheet via a stamping process, an installation interface is provided on the lamp housing (101), an LED bulb (102) provided with a radiator is provided to the installation interface, a middle part of the lamp housing (101) is connected to a lamp post fixing sleeve (108) through a lamp post fixing member, and a decorative cover (114) is provided at a bottom of the lamp housing (101).

17. The lamp of claim 16, wherein the lamp housing (101) is circular, a group of circular ring-shaped installation interfaces are provided around the lamp post fixing sleeve (108) at a central top of the lamp housing (101), and an edgefold for reinforcing structural strength is provided at an edge of the lamp housing (101); the decorative cover (114) is provided in center of the bottom of the lamp housing (101); the installation interface includes a surface in contact with the LED bulb (102) and a hole connected to the LED bulb, on the lamp housing (101); a wire harness connector (106) is provided to the lamp post fixing sleeve (108), and the wire harness connector (106) is used for connecting a plurality of LED bulbs (102) to a power supply and a control circuit;

wherein the lamp post fixing member includes a fixing sleeve flange (112), a lamp post fixing sleeve bolt (111) and a reinforcing plate (113); the lamp post fixing sleeve (108) is fixedly connected to the lamp housing (101) by means of the fixing sleeve flange (112), lamp post fixing sleeve bolt (111) and the reinforcing plate (113).

18. The lamp of claim 11, wherein the lamp is an LED projection lamp, a lamp housing bracket is used as an installation interface bracket structure, the LED projection lamp comprises a lamp housing bracket (101) and an LED bulb (102), the lamp housing bracket (101) is a rectangular box with an open surface, an extrusion type double-faced radiator (103) is provided in the lamp housing bracket (101), an opening used for installing the extrusion type double-faced radiator (103) is provided to a surface opposite to the open surface of the lamp housing bracket (101), vent holes are provided to surfaces other than the open surface and the surface provided with the opening, and the lamp housing bracket (101) is installed and fixed by means of fixing assemblies provided on two sides of the lamp housing bracket (101); an installation interface used for installing the LED bulb (102) is provided on the extrusion type double-faced radiator (103).

19. The lamp of claim 18, wherein the fixing assemblies include a lamp fixing bracket (108) and a reinforcing plate (114), the reinforcing plate (114) is fixedly provided in the lamp fixing bracket (101), and the lamp fixing bracket (108) is connected to the reinforcing plate (114) outside the lamp housing bracket (101) for fixing the entire lamp housing bracket (101); the LED projection lamp using the extrusion type radiator further includes a wire harness connector (106) used for connecting a plurality of LED bulbs (102) to a power supply and a control circuit;

wherein the LED projection lamp using the extrusion type double-faced radiator further includes an angle adjusting assembly (112) and a lamp housing rear cover (113), the angle adjusting assembly (112) is provided at a position where the lamp fixing bracket (108) and the reinforcing plate (114) are connected, the lamp housing rear cover (113) is provided at an opening of the lamp housing bracket (101); a vent hole is provided to the lamp housing rear cover (113);

wherein the extrusion type double-faced radiator (103) includes a substrate, and fins are provided on two sides of the substrate; an installation interface used for installing the LED bulb (102) is provided at one side of the substrate, and circular or elliptic conical spaces are formed by cutting the fins around the installation interface of the substrate according to an illumination angle of the light emitted by the LED bulb to the extent of not shielding the light emitted by the LED bulb (102); the installation interface includes a surface in contact with the LED bulb (102) and a hole connected to the LED bulb on the extrusion type double-faced radiator (103).

20. The lamp of claim 11, wherein the lamp is an LED lawn lamp, the LED lawn lamp comprises an installation interface bracket combined member, an LED bulb (102) provided with a radiator is provided to the installation interface bracket combined member; a lampshade assembly punch-formed by a metal or die-cast by plastics is provided outside the installation interface bracket combined member; the installation interface bracket combined member comprises a pipe bracket (108) which is formed by segmenting a standard pipe, a lamp fixing flange (106) and a lampshade and bulb fixing bracket (110), the pipe bracket (108), the lamp fixing flange (106) and the lampshade and bulb fixing bracket (110) are connected, an installation interface used for installing the LED bulb (102) is provided on the lampshade and bulb fixing bracket (110), and the pipe bracket (108) is connected to the lamp fixing flange (106) and the lampshade and bulb fixing bracket (110); the lampshade assembly is connected to the installation interface bracket combined member by means of the lampshade and bulb fixing bracket (110).

21. The lamp of claim 20, wherein the installation interface includes a surface in contact with the LED bulb (102) and a hole connected to the LED bulb, on the lampshade and bulb fixing bracket (110); the lampshade and bulb fixing bracket (110) is punch-formed by a metal, a central portion of the lampshade and bulb fixing bracket (110) is connected to the pipe bracket (108), the lampshade and bulb fixing bracket (110) is engraved to be hollowed around its portion connected to the pipe bracket (108), so that passing through of a cable and formation of a chimney effect in the lampshade assembly are facilitated to ensure ventilating and radiating effects; a screw hole used for installing the lampshade assembly is provided at an edge of the lampshade and bulb fixing bracket (110);

wherein the lampshade assembly comprises a lampshade (101), a ventilating cover (111), a light emitting cover (114) and a shielding cover (115), which are cooperatively used, the lampshade (101) is covered outside the lampshade or bulb fixing bracket (110), the ventilating cover (111) is covered outside the pipe bracket (108), the shielding cover (115) is installed at an upper part of the LED bulb (102) and between the lampshade (101) and the ventilating cover (111), in order to prevent light from emitting into the ventilating cover (111) and decrease mosquitoes entering the ventilating cover (111), and the light emitting cover (114) is provided at a top of the lampshade (101); or, the lampshade assembly comprises a lampshade (101), a ventilating cover (111), an elongation cover (112), a light emitting cover gland (113) and a shielding cover (115), which are cooperatively used, the lampshade (101) is covered outside the lampshade or bulb fixing bracket (110), the ventilating cover (111) is covered outside the pipe bracket (108), the shielding cover (115) is installed at the upper part of the LED bulb (102) and between the lampshade (101) and the ventilating cover (111), in order to prevent light from emitting into the ventilating cover (111) and prevent mosquitoes from entering the airtight lampshade (101), the elongation cover (112) is provided at a bottom of the ventilating cover (111), and the light emitting cover gland (113) is provided at the top of the lampshade (101); or, the lampshade assembly comprises a lampshade (101), a ventilating cover (111), an elongation cover (112), a light emitting cover gland (113), a light emitting cover (114) and a shielding cover (115), which are cooperatively used, the lampshade (101) is covered outside the lampshade or bulb fixing bracket (110), the ventilating cover (111) is covered outside the pipe bracket (108), the elongation cover (112) is provided at the bottom of the ventilating cover (111), the shielding cover (115) is installed at the upper part of the LED bulb (102) and between the lampshade (101) and the ventilating cover (111), in order to prevent light from emitting into the ventilating cover (111) and prevent mosquitoes from entering the airtight lampshade (101), the light emitting cover (114) is provided in the lampshade (101) and at a top of the shielding cover (115) for locking the LED bulb (102), and a top of the light emitting cover (114) is fixed by the light emitting cover gland (113) provided at the top of the lampshade (101).

22. The lamp of claim 11, wherein the lamp is an LED screw lamp, an installation interface is provided to a radiator (103) of the LED screw lamp or a heat conductive converting plate (27) connected to a top of the radiator (103) for fixedly installing an LED bulb (102), and a lampshade (101) of the LED screw lamp is connected to the radiator (103) or the heat conductive converting plate (27) by adhesion, threaded connection or clamping; the installation interface includes a surface in contact with the LED bulb (102) and a hole connected to the LED bulb, on the radiator (103) or the heat conductive converting plate (27).

23. The lamp of claim 22, wherein the LED screw lamp includes a screw lamp cap (108), an intermediate connecting element (110), the radiator (103), the lampshade (101), or further includes a driving power supply (106) provided in the screw lamp cap (108); an electric connector assembly is provided at a joint of the LED bulb (102) and the LED screw lamp; the intermediate connecting element (110) on the screw lamp cap (108) is connected to the radiator (103) by means of threads thereon, or by means of a lamp cap fixing screw (111) or in a direct adhesion manner; or the heat conductive converting plate (27) is further provided to the radiator (103);

wherein the electric connector assembly comprises a connector socket (10), a fixing screw (25) and an adjusting rubber pad (24); the connector socket (10) is matched and connected to a connector plug (11) on the LED bulb, a three-hole flange is provided to the connector socket (10), the connector socket is fixed to the radiator (103) or the heat conductive converting plate (27) through the three-hole flange and the fixing screw (25) of the connector socket, and the fixed adjusting rubber pad (24) is further provided between the flange and the radiator (103) or the heat conductive converting plate (27) to ensure tightness of a waterproof surface; a conducting wire led out from the connector socket is welded to the lamp cap (108);

wherein the radiator (103) is a columnar radiator, the radiator has a radiator substrate thickness provided inwards at the maximal outer diameter of the cylinder and is provided with fins towards a center of the cylinder in a radial line, 2-3 layers of interrupted grooves are provided to the columnar radiator along an enclosed circular arc with the substrate as thickness, after the radiator is heated, external air naturally flows into the center of the radiator through the interrupted grooves to form convection so as to achieve a cooling effect;

or the radiator (103) is a convection radiator, the radiator has a radiator substrate thickness provided outwards from a cylindrical surface in center and is provided with fins formed outwards from the substrate in a radial line, and an arched shape is formed on a surface of each fin upwards to gradually increase an open area; the surface of the each fin is covered with a radiator outer cover, and a plurality of cut through air flow passages are formed between the outer cover and the fins; after the radiator is heated, air enters the radiator from a flow passage opening at a lower end and flows out of the radiator from a flow passage opening at a higher end to form a chimney effect, in order to achieve air convection for heat dissipation.

24. The lamp of claim 11, wherein the lamp is an LED cylindrical lamp, the LED cylindrical lamp includes a base bracket (108) and spring fixing clips (107), and the spring fixing clips (107) are provided on two sides of the base bracket (108); the cylindrical lamp lamp is provided with an installation interface (AZM) on the base bracket (108) for fixedly installing the LED bulb (102);

wherein the LED cylindrical lamp further includes a lampshade piece (101) and a lampshade piece supporting cover (110); the lampshade piece (101) is provided beneath the base bracket (108), and the lampshade piece supporting cover (110) is provided beneath the lampshade piece (101);

wherein the installation interface (AZM) includes a surface in contact with the LED bulb (102) and a hole connected to the LED bulb on the base bracket (108).

25. The lamp of claim 11, wherein the lamp is an LED ceiling lamp, the LED ceiling lamp includes a ceiling lamp base (106) and a radiator (103), a bulb installation interface is provided on the ceiling lamp base (106), and the radiator (103) is provided on the LED bulb installation interface; an installation interface (AZM) is provided at a center of a lower part of the radiator (103) for fixedly installing the LED bulb (102);

wherein a plurality of ventilation gaps are provided at an upper edge of the ceiling lamp base (106), the radiator (103) is fixed to the base (106) through a fixing screw (104), after the radiator (103) is heated during operation of the LED ceiling lamp, external air naturally flows into a center of the radiator along the ventilation gaps of the base (106) to form convection so as to achieve a cooling effect; the installation interface (AZM) includes a surface in contact with the LED bulb (102) and a hole connected to the LED bulb, on the radiator (103);

or the LED ceiling lamp further comprises a ceiling lampshade (101), and the ceiling lampshade (101) is connected to the ceiling lamp base (106) in a clamping or screw connecting manner;

or a vent hole A is provided at an edge of a bulb installation interface of the ceiling lamp base (106) in order to prevent mosquitoes from entering, the vent hole A is coated with a gauze (29); a vent hole B is provided on the ceiling lampshade (101) in order to prevent mosquitoes from entering, the vent hole B is coated with a gauze (29); external air may enter from the vent hole B and flows out from the vent hole A to achieve a convection radiating effect;

wherein the LED ceiling lamp further includes an electric connector assembly, the electric connector assembly includes a connector socket (10), a fixing screw (25) of the connector socket and a fixed adjusting rubber pad (24); the connector socket (10) is matched and connected to a connector plug (11) on the LED bulb (102), a three-hole flange is provided on the connector socket (10), and the connector socket is fixed with the radiator (103) by means of the three-hole flange and the fixing screw (25) of the connector socket, and the fixed adjusting rubber pad (24) is further provided between the flange and the radiator (103) to ensure tightness of a waterproof surface.

* * * * *